US006789331B1

(12) United States Patent
Ellis, III

(10) Patent No.: US 6,789,331 B1
(45) Date of Patent: Sep. 14, 2004

(54) SHOES SOLE STRUCTURES

(75) Inventor: Frampton E. Ellis, III, Arlington, VA (US)

(73) Assignee: Anatomic Research, Inc., Jasper, FL (US)

( * ) Notice: Subject to any disclaimer, the term of this patent is extended or adjusted under 35 U.S.C. 154(b) by 1156 days.

(21) Appl. No.: 08/462,531

(22) Filed: Jun. 5, 1995

Related U.S. Application Data

(63) Continuation-in-part of application No. 08/452,490, filed on May 30, 1995, which is a continuation-in-part of application No. 08/444,865, filed on May 19, 1995, now abandoned, which is a continuation of application No. 08/151,786, filed on Nov. 15, 1993, now abandoned, which is a continuation of application No. 08/142,120, filed on Oct. 28, 1993, now abandoned, which is a continuation of application No. 07/830,747, filed on Feb. 7, 1992, now abandoned, which is a continuation of application No. 07/686,598, filed on Apr. 17, 1991, now abandoned, which is a continuation of application No. 07/416,478, filed on Oct. 3, 1989, now abandoned.

(51) Int. Cl.[7] ..... A43B 5/00
(52) U.S. Cl. ..... 36/25 R; 36/114; 36/88; 36/30 R
(58) Field of Search ..... 36/25 R, 114, 36/32 R, 88, 89, 14, 15, 92, 93, 30 R

(56) References Cited

U.S. PATENT DOCUMENTS

| | | | |
|---|---|---|---|
| 288,127 | A | 11/1883 | Shepard |
| 532,429 | A | 1/1895 | Rogers |
| 1,283,335 | A | 10/1918 | Shillcock |
| 1,289,106 | A | 12/1918 | Bullock |
| 1,458,446 | A | 6/1923 | Shaeffer |
| 1,622,860 | A | 3/1927 | Cutler |
| 1,639,381 | A | 8/1927 | Manelas |
| 1,701,260 | A | 2/1929 | Fischer |
| 1,735,986 | A | 11/1929 | Wray |
| 1,853,034 | A | 4/1932 | Bradley |
| 2,120,987 | A | 6/1938 | Murray |
| 2,147,197 | A | 2/1939 | Glidden |
| 2,155,166 | A | 4/1939 | Kraft |
| 2,170,652 | A | 8/1939 | Brennan |

(List continued on next page.)

FOREIGN PATENT DOCUMENTS

| | | |
|---|---|---|
| AT | 200 963 | 12/1958 |
| CA | 1 138 194 | 12/1982 |
| CA | 1 176 458 | 10/1984 |

(List continued on next page.)

OTHER PUBLICATIONS

Williams, *Walking on Air, Case Alumnus*, Fall 1989, vol. LXVII, No. 6, pp. 4–8, Case Western Reserve University at Crawford Hills, Cleveland, OH.

(List continued on next page.)

*Primary Examiner*—M. D. Patterson
(74) *Attorney, Agent, or Firm*—Knoble, Yoshida & Dunleavy LLC

(57) ABSTRACT

In its simplest conceptual form, this invention relates to variations in the structure of such shoes having a sole contour which follows a theoretically ideal stability plane as a basic concept, but which deviates substantially therefrom outwardly, to provide greater than natural stability, so that joint motion of the wearer is restricted, especially the ankle joint; or, alternately, which deviates substantially therefrom inwardly, to provide less than natural stability, so that a greater freedom of joint motion is allowed. Alternately, substantial density variations or bottom sole designs are used instead of, or in combination with, substantial thickness variations for the same purpose. These shoe sole modifications are research indicating that they are necessary and useful to correct important interrelated anatomical/biomechanical imbalances or deformities of surprising large magnitude in both individuals or major population groups.

24 Claims, 38 Drawing Sheets

U.S. PATENT DOCUMENTS 2,179,942 A 11/1939 Lyne
2,328,242 A 8/1943 Witherill
2,433,329 A 12/1947 Adler et al.
2,434,770 A 1/1948 Lutey
2,627,676 A 2/1953 Hack
2,718,715 A 9/1955 Spilman
2,814,133 A * 11/1957 Herbst ..... 36/25 R
3,005,272 A 10/1961 Shelare et al.
3,100,354 A 8/1963 Lombard et al.
3,110,971 A 11/1963 Chang
3,305,947 A 2/1967 Kalsoy
3,308,560 A 3/1967 Jones
3,416,174 A * 12/1968 Novitske ..... 36/30 R
3,512,274 A 5/1970 McGrath
3,535,799 A 10/1970 Onitsuka
3,806,974 A 4/1974 Di Paolo
3,824,716 A 7/1974 Di Paolo
3,863,366 A * 2/1975 Auberry et al. ..... 36/14
3,958,291 A 5/1976 Spier
3,964,181 A 6/1976 Holcombe, Jr.
3,997,984 A 12/1976 Hayward
4,003,145 A 1/1977 Liebscher et al.
4,030,213 A * 6/1977 Daswick ..... 36/32 R
4,068,395 A 1/1978 Senter
4,083,125 A 4/1978 Benseler et al.
4,096,649 A 6/1978 Saurwein
4,098,011 A 7/1978 Bowerman et al.
4,128,951 A 12/1978 Tansill
4,141,158 A 2/1979 Benseler et al.
4,145,785 A 3/1979 Lacey
4,149,324 A 4/1979 Lesser et al.
4,161,828 A 7/1979 Benseler et al.
4,161,829 A 7/1979 Wayser
4,170,078 A 10/1979 Moss
4,183,156 A 1/1980 Rudy
4,194,310 A * 3/1980 Bowerman ..... 36/25 R
4,217,705 A 8/1980 Donzis
4,219,945 A 9/1980 Rudy
4,223,457 A 9/1980 Borgeas
4,227,320 A 10/1980 Borgeas
4,235,026 A 11/1980 Plagenhoef
4,240,214 A 12/1980 Sigle et al.
4,241,523 A 12/1980 Daswick
4,245,406 A * 1/1981 Landay et al. ..... 36/14
4,250,638 A 2/1981 Linnemann
4,258,480 A 3/1981 Famolare, Jr.
4,259,792 A 4/1981 Halberstadt
4,262,433 A 4/1981 Hagg et al.
4,263,728 A 4/1981 Frecentese
4,266,349 A 5/1981 Schmohl
4,268,980 A 5/1981 Gudas
4,271,606 A 6/1981 Rudy
4,272,858 A * 6/1981 Hlustik ..... 36/14
4,274,211 A 6/1981 Funck
4,297,797 A 11/1981 Meyers
4,302,892 A 12/1981 Adamik
4,305,212 A 12/1981 Coomer
4,308,671 A 1/1982 Bretschneider
4,309,832 A 1/1982 Hunt
4,316,332 A 2/1982 Giese et al.
4,316,335 A 2/1982 Giese et al.
4,319,412 A 3/1982 Muller et al.
4,322,895 A 4/1982 Hockerson
4,335,529 A 6/1982 Badalamenti
4,340,626 A 7/1982 Rudy
4,342,161 A 8/1982 Schmohl
4,348,821 A 9/1982 Daswick
4,354,319 A 10/1982 Block et al.
4,361,971 A 12/1982 Bowerman
4,366,634 A * 1/1983 Giese et al. ..... 36/32 R
4,370,817 A 2/1983 Ratanangsu
4,372,059 A 2/1983 Ambrose
4,398,357 A 8/1983 Batra
4,399,620 A 8/1983 Funck
4,449,306 A 5/1984 Cavanagh
4,451,994 A 6/1984 Fowler
4,454,662 A 6/1984 Stubblefield
4,455,765 A 6/1984 Sjöswärd
4,455,767 A * 6/1984 Bergmans ..... 36/32 R
4,468,870 A 9/1984 Sternberg
4,484,397 A 11/1984 Curley, Jr.
4,494,321 A 1/1985 Lawlor
4,505,055 A 3/1985 Bergmans
4,506,462 A 3/1985 Cavanagh
4,521,979 A 6/1985 Blaser
4,527,345 A 7/1985 Lopez Lopez
4,542,598 A 9/1985 Misevich et al.
4,546,559 A 10/1985 Dassler
4,557,059 A 12/1985 Misevich et al.
4,559,723 A 12/1985 Hamy et al.
4,559,724 A 12/1985 Norton
4,561,195 A 12/1985 Onoda et al.
4,577,417 A 3/1986 Cole
4,578,882 A 4/1986 Talarico, II
4,580,359 A 4/1986 Kurrash et al.
4,624,061 A 11/1986 Wezel et al.
4,624,062 A 11/1986 Autry
4,641,438 A 2/1987 Laird et al.
4,642,917 A 2/1987 Ungar
4,651,445 A 3/1987 Hannibal
4,670,995 A 6/1987 Huang
4,676,010 A 6/1987 Cheskin
4,694,591 A 9/1987 Banich et al.
4,697,361 A 10/1987 Ganter et al.
D293,275 S 12/1987 Bua
4,715,133 A 12/1987 Hartjes et al.
4,724,622 A 2/1988 Mills
D294,425 S 3/1988 Le
4,727,660 A 3/1988 Bernhard
4,730,402 A 3/1988 Norton et al.
4,731,939 A 3/1988 Parracho et al.
4,747,220 A 5/1988 Autry et al.
D296,149 S 6/1988 Diaz
D296,152 S 6/1988 Selbiger
4,748,753 A * 6/1988 Ju ..... 36/127
4,754,561 A 7/1988 Dufour
4,756,098 A 7/1988 Boggia
4,757,620 A 7/1988 Tiitola
4,759,136 A 7/1988 Stewart et al.
4,768,295 A 9/1988 Ito
4,785,557 A 11/1988 Kelley et al.
4,817,304 A 4/1989 Parker et al.
4,827,631 A 5/1989 Thornton
4,833,795 A 5/1989 Diaz
4,837,949 A 6/1989 Dufour
4,854,057 A 8/1989 Misevich et al.
4,858,340 A * 8/1989 Pasternak ..... 36/30 R
4,866,861 A 9/1989 Noone
4,876,807 A * 10/1989 Tiitola et al. ..... 36/114
4,890,398 A 1/1990 Thomasson
4,906,502 A 3/1990 Rudy
4,922,631 A 5/1990 Anderie
4,934,070 A 6/1990 Mauger
4,934,073 A 6/1990 Robinson
4,947,560 A 8/1990 Fuerst et al.
4,949,476 A 8/1990 Anderie
4,982,737 A 1/1991 Guttmann
4,989,349 A 2/1991 Ellis, III
D315,634 S 3/1991 Yung-Mao
5,010,662 A 4/1991 Dabuzhsky et al.
5,014,449 A 5/1991 Richard et al.

| | | | | |
|---|---|---|---|---|
| 5,024,007 A | | 6/1991 | DuFour | |
| 5,025,573 A | | 6/1991 | Giese et al. | |
| 5,052,130 A | | 10/1991 | Barry et al. | |
| 5,077,916 A | | 1/1992 | Beneteau | |
| 5,079,856 A | * | 1/1992 | Truelsen | 36/25 R |
| 5,092,060 A | | 3/1992 | Frachey et al. | |
| 5,131,173 A | | 7/1992 | Anderie | |
| 5,224,280 A | | 7/1993 | Preman et al. | |
| 5,224,810 A | | 7/1993 | Pitkin | |
| 5,237,758 A | | 8/1993 | Zachman | |
| 5,317,819 A | | 6/1994 | Ellis, III | |
| 5,543,194 A | | 8/1996 | Rudy | |
| 5,544,429 A | | 8/1996 | Ellis, III | |
| 5,909,948 A | | 6/1999 | Ellis, III | |
| 6,115,941 A | | 9/2000 | Ellis, III | |
| 6,115,945 A | | 9/2000 | Ellis, III | |
| 6,163,982 A | | 12/2000 | Ellis, III | |

FOREIGN PATENT DOCUMENTS

| | | | | |
|---|---|---|---|---|
| DE | B 23257 VII/71a | | 5/1956 | |
| DE | 1 888 119 | | 12/1963 | |
| DE | 1 287 477 | | 1/1969 | |
| DE | 1 290 844 | | 3/1969 | |
| DE | 1 685 260 | | 10/1971 | |
| DE | 27 06 645 | | 8/1978 | |
| DE | 27 37 765 | | 3/1979 | |
| DE | 28 05 426 | | 8/1979 | |
| DE | 30 24 587 | | 1/1982 | |
| DE | 32 45 182 | | 5/1983 | |
| DE | 33 17 462 | | 10/1983 | |
| DE | 36 29 245 | | 3/1988 | |
| EP | 0 048 965 | | 4/1982 | |
| EP | 0 083 449 | | 7/1983 | |
| EP | 0 130 816 | | 1/1985 | |
| EP | 0 185 781 | | 7/1986 | |
| EP | 0 206 511 | | 12/1986 | |
| EP | 0 213 257 | | 3/1987 | |
| EP | 0 215 974 | | 4/1987 | |
| EP | 0 238 995 | | 9/1987 | |
| EP | 0 260 777 | | 3/1988 | |
| EP | 0 301 331 | | 2/1989 | |
| EP | 0 329 391 | | 8/1989 | |
| EP | 0 410 087 | | 1/1991 | |
| FR | 602.501 | | 3/1926 | |
| FR | 925.961 | | 9/1947 | |
| FR | 1.004.472 | | 3/1952 | |
| FR | 1.323.455 | | 2/1963 | |
| FR | 2 006 270 | | 11/1971 | |
| FR | 2 261 721 | | 9/1975 | |
| FR | 2 511 850 | | 3/1983 | |
| FR | 2 622 411 | | 5/1989 | |
| GB | 16143 | | 9/1891 | |
| GB | 9 591 | | 4/1913 | |
| GB | 764956 | | 1/1957 | |
| GB | 807305 | | 1/1959 | |
| GB | 2 023 405 | | 1/1980 | |
| GB | 2 039 717 | | 8/1980 | |
| GB | 2 136 670 | | 9/1984 | |
| JP | 39-15597 | | 8/1964 | |
| JP | 45-5154 | | 3/1970 | |
| JP | 50-71132 | | 11/1975 | |
| JP | 57-139333 | | 8/1982 | |
| JP | 59-23525 | | 7/1984 | |
| JP | 61-55810 | | 4/1986 | |
| JP | 61-167810 | | 10/1986 | |
| JP | 1-195803 | | 8/1989 | |
| JP | 3-85102 | | 4/1991 | |
| JP | 4-279102 | | 10/1992 | |
| JP | 5-123204 | | 5/1993 | |
| NZ | 189890 | | 9/1981 | |
| WO | WO 87/07480 | | 12/1987 | |
| WO | WO 88/08263 | | 11/1988 | |
| WO | WO 89/06500 | | 7/1989 | |
| WO | WO 90/00358 | | 1/1990 | |
| WO | WO 91/00698 | | 1/1991 | |
| WO | WO 91/03180 | | 3/1991 | |
| WO | WO 91/04683 | | 4/1991 | |
| WO | WO 91/05491 | | 5/1991 | |
| WO | WO 91/10377 | | 7/1991 | |
| WO | WO 91/11124 | | 8/1991 | |
| WO | WO 91/11924 | | 8/1991 | |
| WO | WO 91/19429 | | 12/1991 | |
| WO | WO 92/07483 | | 5/1992 | |
| WO | 92018024 | * | 10/1992 | 36/25 R |
| WO | WO 93/13928 | | 7/1993 | |
| WO | WO 94/03080 | | 2/1994 | |
| WO | WO 97/00029 | | 1/1997 | |
| WO | WO 00/54616 | | 9/2000 | |
| WO | WO 00/64293 | | 11/2000 | |
| WO | WO 01/80678 A2 | | 11/2001 | |

OTHER PUBLICATIONS

Brooks advertisement, *Runner's World*, Jun. 1989, pp. 56+.

German description of adidas badminton shoe pre–1989(?).

Nigg et al., *Influence of Heel Flare and Midsole Construction on Pronation, Supination, and Impact Forces for Heel–Toe Running, International Journal of Sports Biomechanics*, 1988, 4, pp. 205–219.

Nigg et al., *The Influence of lateral heel flare of running shoes on pronation and impact forces, Medicine and Science in Sports and Exercise*, vol. 19, No. 3, 1987, pp. 294–302.

The Reebok Lineup, Fall 1987, cover and 1 page.

Cavanagh et al., *Biological Aspects of Modeling Shoe/Foot Interaction during Running, Sports Shoes and Playing Surfaces: Biomechanical Properties*, © 1984, pp. 24–25, 35–35, and 46, Human Kinetics Publishers, Inc., Champaign, IL.

Bleshschmidt, *The Structure of the Calcaneal Padding, Foot & Ankle*, vol. 2, No. 5, Mar. 1982, pp. 260–283.

Cavanagh, *The Running Shoe Book*, © 1980, pp. 176–180, Anderson World, Inc., Mountain View, CA.

Ellis, Executive Summary with seven figures.

Copy of originally filed specification for U.S. patent application Ser. No. 09/522,174, filed Mar. 9, 2000, Notice of Allowance date Apr. 26, 2001 (Ell–02.5).

Copy of originally filed specification for U.S. patent application Ser. No. 08/477,640, filed Jun. 7, 1995 (ELL–009/Con).

Copy of originally filed specification for U.S. patent application Ser. No. 09/648,792, filed Aug. 28, 2000 (ELL–010/Con).

Copy of originally filed specification for U.S. patent application Ser. No. 08/376,661, filed Jan. 23, 1995 (ELL–003/Con 3).

Copy of originally filed specification for U.S. patent application Ser. No. 09/734,905, filed Dec. 13, 2000 (ELL–012D/Div 1).

Copy of originally filed specification for U.S. patent application Ser. No. 09/785,200, filed Feb. 20, 2001 (ELL–012D/Div 2).

Copy of originally filed specification for U.S. patent application Ser. No. 09/710,952, filed Nov. 14, 2000 (ELL–003/Div 1).

Copy of originally filed specification for U.S. patent application Ser. No. 09/780,450, filed Feb. 12, 2001 (ELL–003/Div 2).

Copy of originally filed specification for U.S. patent application Ser. No. 09/790,626, filed Feb. 23, 2001 (ELL–003/Div 3).

Copy of originally filed specification for U.S. patent application Ser. No. 08/452,490, filed May 30, 1995 and U.S. patent application Ser. No. 08/473,974, filed Jun. 7, 1995 (ELL–004/Con 3 and ELL–012M).

Copy of originally filed specification for U.S. patent application Ser. No. 08/482,838, filed Jun. 7, 1995 (ELL–011/Con).

Copy of originally filed specification for U.S. patent application Ser. No. 08/033,468, filed Mar. 18, 1993 (ELL–006/Con).

Copy of originally filed specification for U.S. patent application Ser. No. 08/479,776, filed Jun. 7, 1995 (ELL–014B).

Copy of originally filed specification for U.S. patent application Ser. No. 08/473,212, filed Jun. 7, 1995 (ELL–012B).

* cited by examiner

RIGHT FOOT

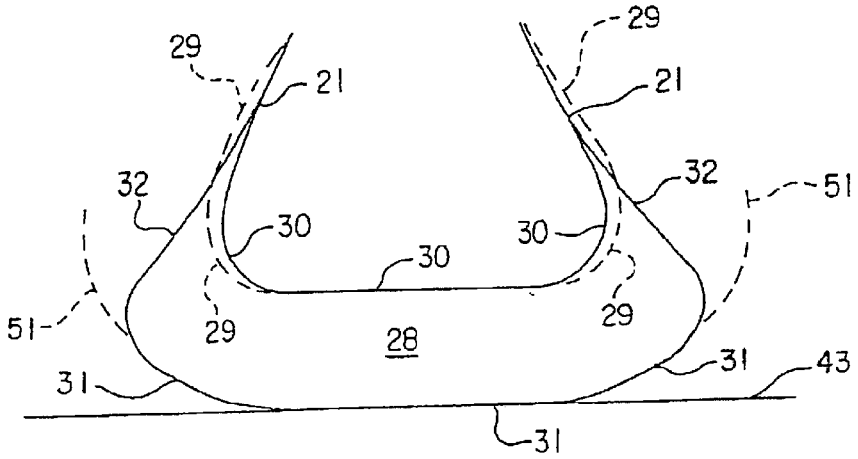
FIG. 10
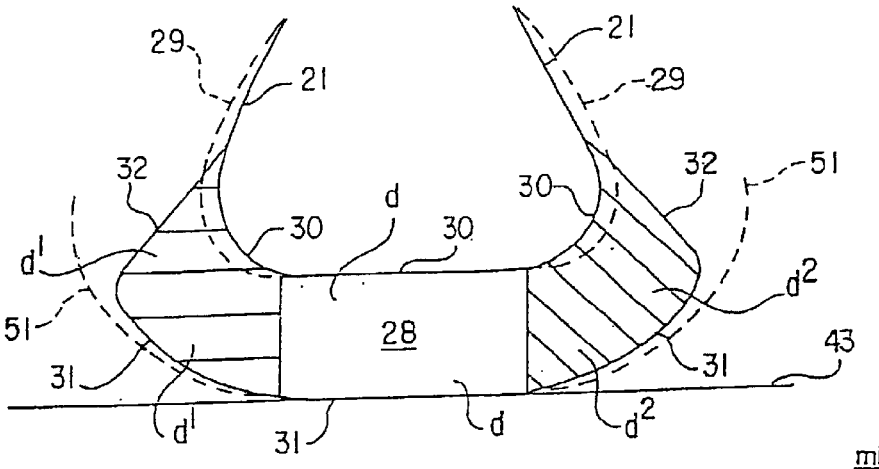
FIG. 11
midsole
Fig. 2
densitie
suppimp
also
hatching FIG. 22
FIG. 22A
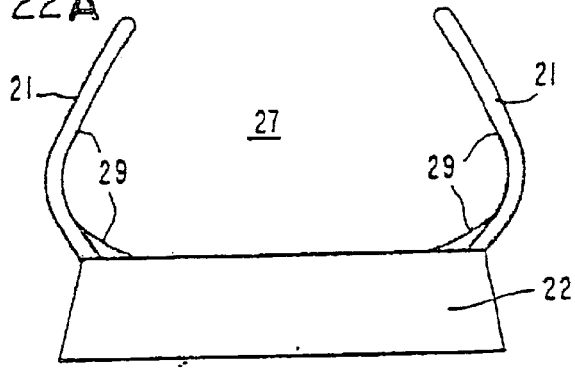
FIG. 22B
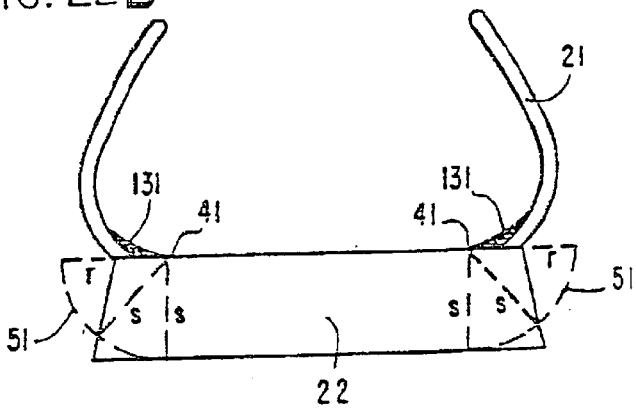
FIG. 22C
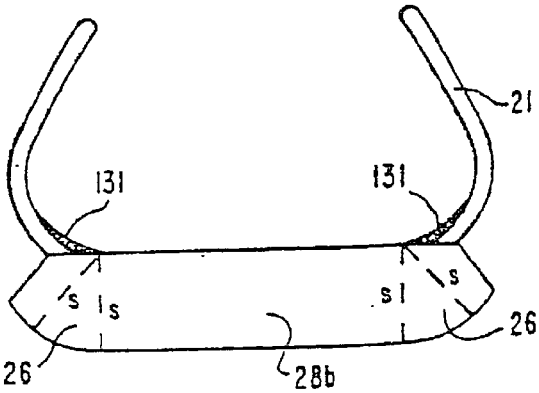

FIG. 23
FIG. 23A
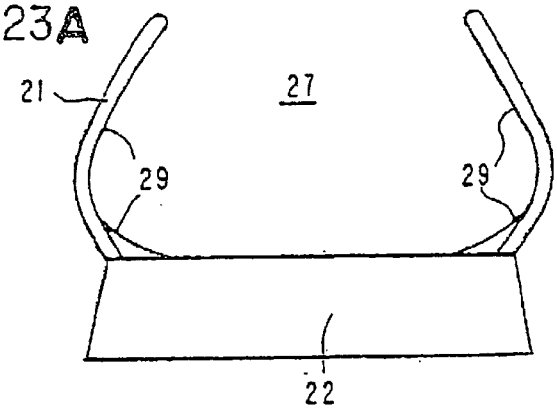
FIG. 23B
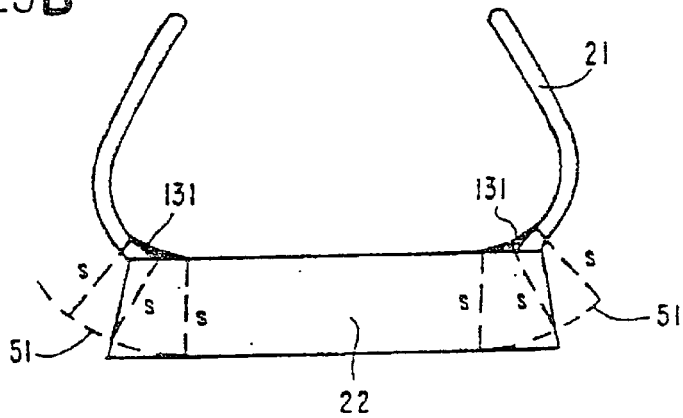
FIG. 23C
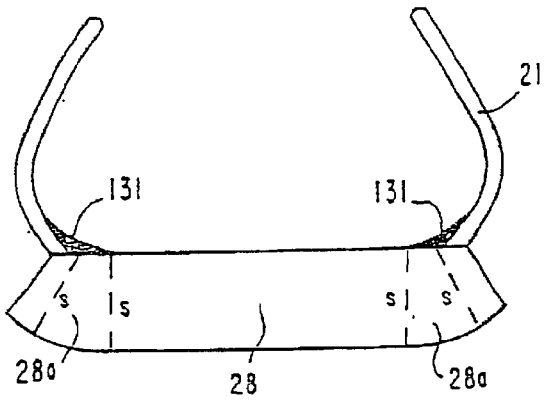

UNLOADED, UPRIGHT

LOADED MODERATELY, UPRIGHT

LOADED HEAVILY, UPRIGHT

LOADED HEAVILY, 20° LATERAL TILT (Midsoles only shown)

Frontal Plane Cross Section at Heel (Ankle Joint)

(d' is firme than d; $d^2$ firmest.

Scale: Life Size (Typical Amer. Size Men's 10D)

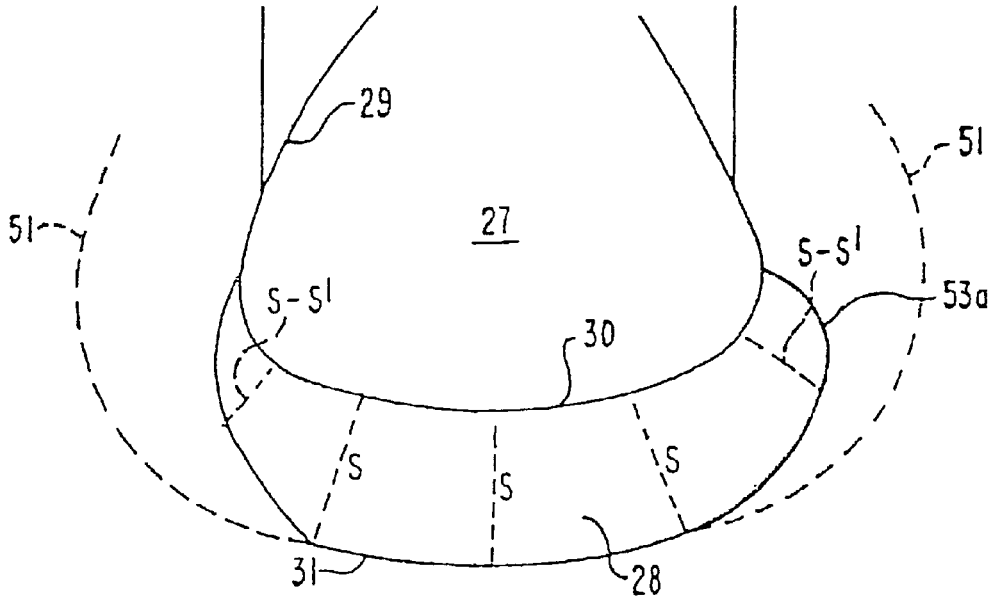
FIG. 48
FIG. 49
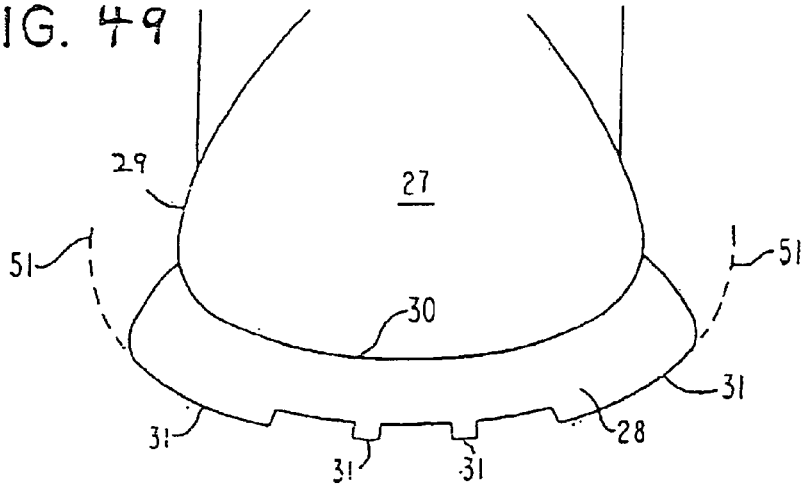

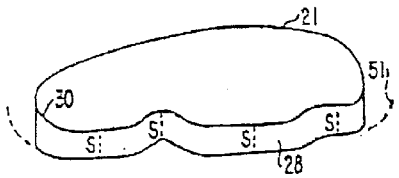
FIG. 54A
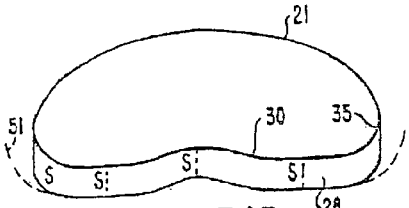
FIG. 54B
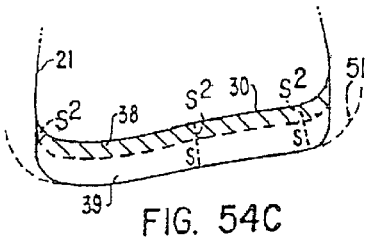
FIG. 54C
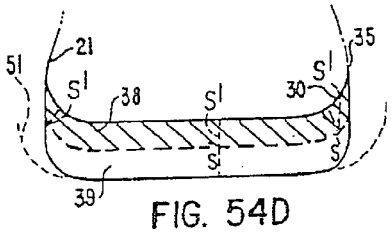
FIG. 54D
FIG. 54F
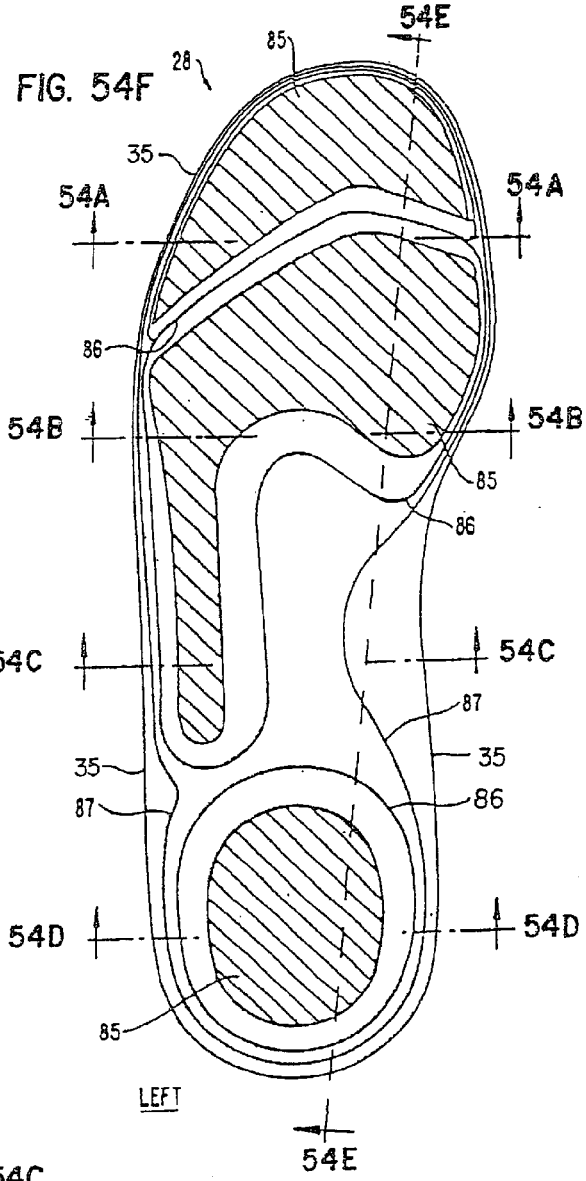
FIG. 54E
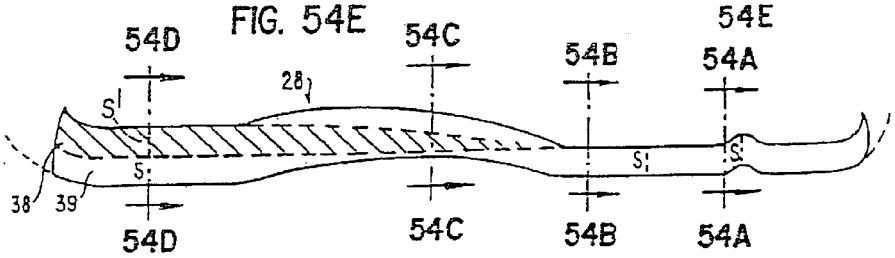

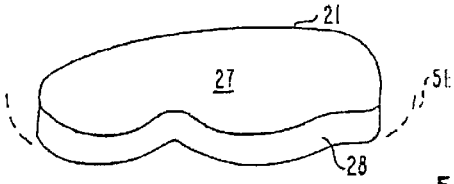
FIG. 55A
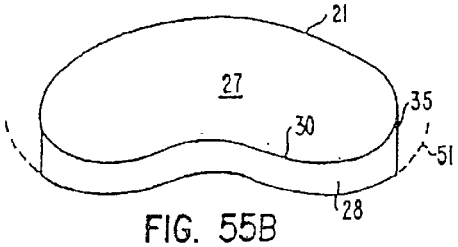
FIG. 55B
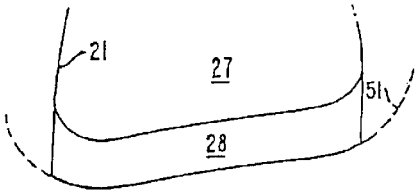
FIG. 55C
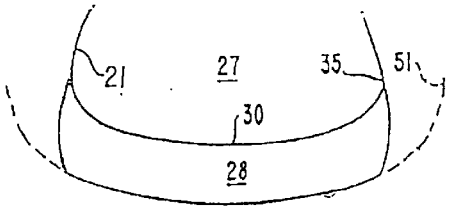
FIG. 55D
FIG. 56
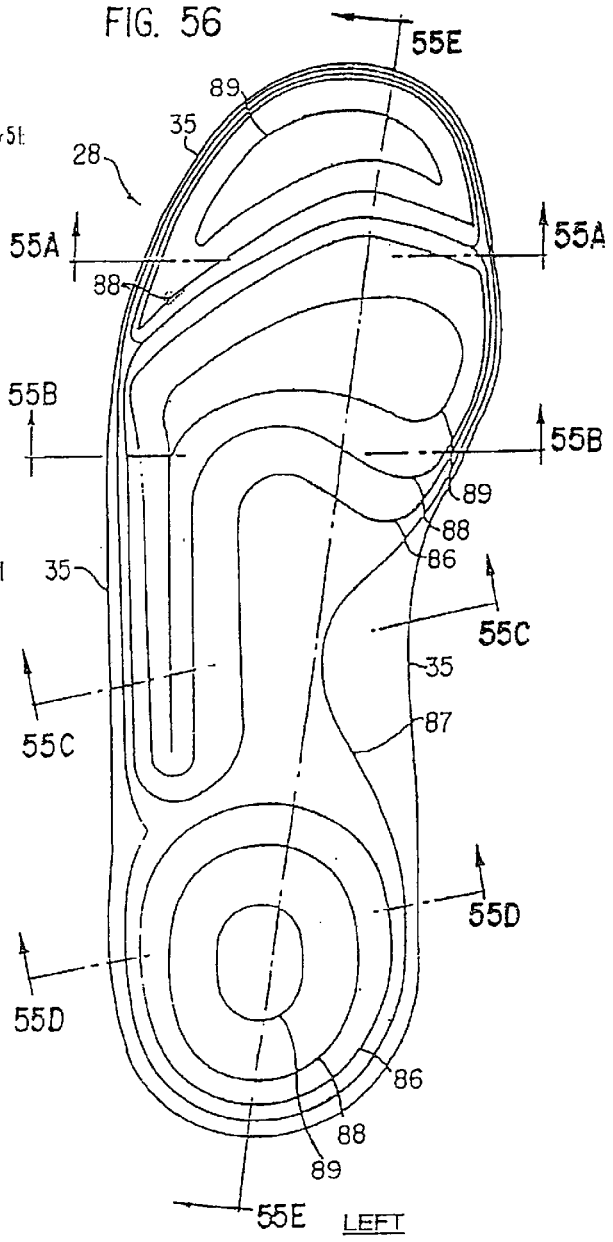
FIG. 55E
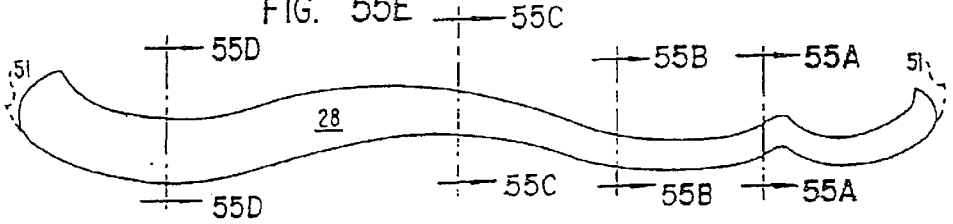

SHOES SOLE STRUCTURES

This application is a continuation-in-part of U.S. application Ser. No. 08/452,490, filed on May 30, 1995, which is a continuation of U.S. application Ser. No. 08/142,120, filed on Oct. 28, 1993, now abandoned, which is a continuation of U.S. application Ser. No. 07/830,747, filed on Feb. 7, 1992, now abandoned, which is a continuation of 07/416,478, filed Oct. 3, 1989, now abandoned; and a continuation-in-part of U.S. application Ser. No. 08/444,865, filed May 19, 1995, now abandoned, which is a continuation of U.S. application Ser. No. 08/151,786, filed Nov. 15, 1993, now abandoned, which is a continuation of U.S. application Ser. No. 07/686,598, filed Apr. 17, 1991, now abandoned.

BACKGROUND OF THE INVENTION

This invention relates generally to the structure of soles of shoes and other footwear, including soles of street shoes, hiking boots, sandals, slippers, and moccasins. More specifically, this invention relates to the structure of athletic shoe soles, including such examples as basketball and running shoes.

Still more particularly, this application explicitly includes an alternate definition of the inner surface of the theoretically ideal stability plane as being complementary to the shape of the wearer's foot, instead of conforming to the wearer's foot sole or to a shoe last approximating it either for a specific individual; such alternate definition is more like a standard shoe last that approximates the exact shape and size of the individual wearer's foot sole for mass production. This application also includes the broadest possible definition for the inner surface of the contoured shoe sole sides that still defines over the prior art, namely any position between roughly paralleling the wearer's foot sole and roughly paralleling the flat ground.

Still more particularly, in its simplest conceptual form, this invention relates to variations in the structure of such shoes having a sole contour which follows a theoretically ideal stability plane as a basic concept, but which deviates substantially therefrom outwardly, to provide greater than natural stability, so that joint motion of the wearer is restricted, especially the ankle joint; or, alternately, which deviates substantially therefrom inwardly, to provide less than natural stability, so that a greater freedom of joint motion is allowed. Alternately, substantial density variations or bottom sole designs are used instead of, or in combination with, substantial thickness variations for the same purpose. These shoe sole modifications are research indicating that they are necessary and useful to correct important interrelated anatomical/biomechanical imbalances or deformities of surprising large magnitude in both individuals or major population groups.

More particularly, in its simplest conceptual form, this invention is the structure of a conventional shoe sole that has been modified by having its sides bent up so that their inner surface conforms to a shape nearly identical but slightly smaller than the shape of the outer surface of the sides of the foot sole of the wearer (instead of the shoe sole sides conforming to the ground by paralleling it, as is conventional). The shoe sole sides are sufficiently flexible to bend out easily when the shoes are put on the wearer's feet and therefore the shoe soles gently hold the sides of the wearer's foot sole when on, providing the equivalent of custom fit in a mass-produced shoe sole.

Still more particularly, this invention relates to shoe sole structures that are formed to conform to the all or part of the shape of the wearer's foot sole, whether under a body weight load or unloaded, but without contoured stability sides as defined by the applicant.

Still more particularly, this invention relates to variations in the structure of such soles using a theoretically ideal stability plane as a basic concept, especially including structures exceeding that plane.

Finally, this invention relates to contoured shoe sole sides that provide support for sideways tilting of any angular amount from zero degrees to 180 degrees at least for such contoured sides proximate to any one or more or all of the essential stability or propulsion structures of the foot, as defined below and previously.

The parent '598 application clarified and expanded the applicant's earlier filed U.S. application Ser. No. 07/680,134, filed Apr. 3, 1991.

The applicant has introduced into the art the concept of a theoretically ideal stability plane as a structural basis for shoe sole designs. The theoretically ideal stability plane was defined by the applicant in previous copending applications as the plane of the surface of the bottom of the shoe sole, wherein the shoe sole conforms to the natural shape of the wearer's foot sole, particularly its sides, and has a constant thickness in frontal or transverse plane cross sections. Therefore, by definition, the theoretically ideal stability plane is the surface plane of the bottom of the shoe sole that parallels the surface of the wearer's foot sole in transverse or frontal plane cross sections.

The theoretically ideal stability plane concept as implemented into shoes such as street shoes and athletic shoes is presented in U.S. Pat. No. 4,989,349, issued Feb. 5, 1991 and U.S. Pat. No. 5,317,819, issued Jun. 7, 1994, both of which are incorporated by reference; and pending U.S. application Ser. No. 07/400,714, filed Aug. 30, 1989; Ser. No. 07/416,478, filed Oct. 3, 1989; Ser. No. 07/424,509, filed Oct. 20, 1989; Ser. No. 07/463,302, filed Jan. 10, 1990; Ser. No. 07/469,313, filed Jan. 24, 1990; Ser. No. 07/478,579, filed Feb. 8, 1990; Ser. No. 07/539,870, filed Jun. 18, 1990; Ser. No. 07/608,748, filed Nov. 5, 1990; Ser. No. 07/783,145, filed Oct. 28, 1991; and Ser. No. 07/926,523, filed Aug. 10, 1992.

PCT applications based on the above patents and applications have been published as WO 90/00358 of Jan. 25, 1990 (part of the '349 Patent, all of the '819 Patent and part of '714 application); WO 91/03180 of Mar. 21, 1991 (the remainder of the '714 application); WO 91/04683 of Apr. 18, 1991 (the '478 application); WO 91/05491 of May 02, 1991 (the '509 application); WO 91/10377 of Jul. 25, 1991 (the '302 application); WO 91/11124 of Aug. 08, 1991 (the '313 application); WO 91/11924 of Aug. 22, 1991 (the '579 application); WO 91/19429 of Dec. 26, 1991 (the '870 application); WO 92/07483 of May 14, 1992 (the '748 application); WO 92/18024 of Oct. 29, 1992 (the '598 application); and WO 94/03080 of Feb. 17, 1994 (the '523 application). All of above publications are incorporated by reference in this application to support claimed prior embodiments that are incorporated in combinations with new elements disclosed in this application.

This new invention is a modification of the inventions disclosed and claimed in the earlier applications and develops the application of the concept of the theoretically ideal stability plane to other shoe structures. Each of the applicant's applications is built directly on its predecessors and therefore all possible combinations of inventions or their component elements with other inventions or elements in prior and subsequent applications have always been specifically intended by the applicant. Generally, however, the applicant's applications are generic at such a fundamental level that it is not possible as a practical matter to describe every embodiment combination that offers substantial improvement over the existing art, as the length of this description of only some combinations will testify.

Accordingly, it is a general object of this invention to elaborate upon the application of the principle of the theoretically ideal stability plane to other shoe structures.

The purpose of the earlier '523 application was to specifically describe some of the most important combinations, especially those that constitute optimal ones, that exist between the applicant's U.S. patent application Ser. No. 07/400,714, filed Aug. 30, 1989, and subsequent patents filed by the applicant, particularly U.S. Ser. No. 07/416,478, filed Oct. 3, 1989, as well as some other combinations.

The '714 Application indicated that existing running shoes are unnecessarily unsafe. They profoundly disrupt natural human biomechanics. The resulting unnatural foot and ankle motion leads to what are abnormally high levels of running injuries.

Proof of the unnatural effect of shoes has come quite unexpectedly from the discovery that, at the extreme end of its normal range of motion, the unshod bare foot is naturally stable, almost unsprainable, while the foot equipped with any shoe, athletic or otherwise, is artificially unstable and abnormally prone to ankle sprains. Consequently, ordinary ankle sprains must be viewed as largely an unnatural phenomena, even though fairly common. Compelling evidence demonstrates that the stability of bare feet is entirely different from the stability of shoe-equipped feet.

The underlying cause of the universal instability of shoes is a critical but correctable design flaw. That hidden flaw, so deeply ingrained in existing shoe designs, is so extraordinarily fundamental that it has remained unnoticed until now. The flaw is revealed by a novel new biomechanical test, one that is unprecedented in its simplicity. It is easy enough to be duplicated and verified by anyone; it only takes a few minutes and requires no scientific equipment or expertise. The simplicity of the test belies its surprisingly convincing results. It demonstrates an obvious difference in stability between a bare foot and a running shoe, a difference so unexpectedly huge that it makes an apparently subjective test clearly objective instead. The test proves beyond doubt that all existing shoes are unsafely unstable.

The broader implications of this uniquely unambiguous discovery are potentially far-reaching. The same fundamental flaw in existing shoes that is glaringly exposed by the new test also appears to be the major cause of chronic overuse injuries, which are unusually common in running, as well as other sport injuries. It causes the chronic injuries in the same way it causes ankle sprains; that is, by seriously disrupting natural foot and ankle biomechanics.

It was a general object of the '714 invention to provide a shoe sole which, when under load and tilting to the side, deforms in a manner which closely parallels that of the foot of its wearer, while retaining nearly the same amount of contact of the shoe sole with the ground as in its upright state.

It was still another object of the '714 invention to provide a deformable shoe sole having the upper portion or the sides bent inwardly somewhat so that when worn the sides bend out easily to approximate a custom fit.

It was still another object of the '714 invention to provide a shoe having a naturally contoured sole which is abbreviated along its sides to only essential structural stability and propulsion elements, which are combined and integrated into the same discontinuous shoe sole structural elements underneath the foot, which approximate the principal structural elements of a human foot and their natural articulation between elements.

The '478 invention relates to variations in the structure of such shoes having a sole contour which follows a theoretically ideal stability plane as a basic concept, but which deviates therefrom outwardly, to provide greater than natural stability. Still more particularly, this invention relates to the use of structures approximating, but increasing beyond, a theoretically ideal stability plane to provide greater than natural stability for an individual whose natural foot and ankle biomechanical functioning have been degraded by a lifetime use of flawed existing shoes.

The '478 invention is a modification of the inventions disclosed and claimed in the earlier application and develops the application of the concept of the theoretically ideal stability plane to other shoe structures. As such, it presents certain structural ideas which deviate outwardly from the theoretically ideal stability plane to compensate for faulty foot biomechanics caused by the major flaw in existing shoe designs identified in the earlier patent applications.

The shoe sole designs in the '478 application are based on a recognition that lifetime use of existing shoes, the unnatural design of which is innately and seriously flawed, has produced actual structural changes in the human foot and ankle. Existing shoes thereby have altered natural human biomechanics in many, if not most, individuals to an extent that must be compensated for in an enhanced and therapeutic design. The continual repetition of serious interference by existing shoes appears to have produced individual biomechanical changes that may be permanent, so simply removing the cause is not enough. Treating the residual effect must also be undertaken.

Accordingly, it was a general object of the '478 invention to elaborate upon the application of the principle of the theoretically ideal stability plane to other shoe structures.

It was still another object of the '478 invention to provide a shoe having a sole contour which deviates outwardly in a constructive way from the theoretically ideal stability plane.

It was another object of the '478 invention to provide a sole contour having a shape naturally contoured to the shape of a human foot, but having a shoe sole thickness which is increases somewhat beyond the thickness specified by the theoretically ideal stability plane.

It is another object of this invention to provide a naturally contoured shoe sole having a thickness somewhat greater than mandated by the concept of a theoretically ideal stability plane, either through most of the contour of the sole, or at preselected portions of the sole.

It is yet another object of this invention to provide a naturally contoured shoe sole having a thickness which approximates a theoretically ideal stability plane, but which varies toward either a greater thickness throughout the sole or at spaced portions thereof, or toward a similar but lesser thickness.

The '302 invention relates to a shoe having an anthropomorphic sole that copies the underlying support, stability and cushioning structures of the human foot. Natural stability is provided by attaching a completely flexible but relatively inelastic shoe sole upper directly to the bottom sole, enveloping the sides of the midsole, instead of attaching it to the top surface of the shoe sole. Doing so puts the flexible side of the shoe upper under tension in reaction to destabilizing sideways forces on the shoe causing it to tilt. That tension force is balanced and in equilibrium because the bottom sole is firmly anchored by body weight, so the destabilizing sideways motion is neutralized by the tension in the flexible sides of the shoe upper. Still more particularly, this invention relates to support and cushioning which is provided by shoe sole compartments filled with a pressure-transmitting medium like liquid, gas, or gel. Unlike similar existing systems, direct physical contact occurs between the upper surface and the lower surface of the compartments, providing firm, stable support. Cushioning is provided by the transmitting medium progressively causing tension in the flexible and semi-elastic sides of the shoe sole. The compartments providing support and cushioning are similar in structure to the fat pads of the foot, which simultaneously provide both firm support and progressive cushioning.

Existing cushioning systems cannot provide both firm support and progressive cushioning without also obstructing the natural pronation and supination motion of the foot, because the overall conception on which they are based is inherently flawed. The two most commercially successful proprietary systems are Nike Air, based on U.S. Pat. No. 4,219,945 issued Sep. 2, 1980, U.S. Pat. No. 4,183,156 issued Sep. 15, 1980, U.S. Pat. No. 4,271,606 issued Jun. 9, 1981, and U.S. Pat. No. 4,340,626 issued Jul. 20, 1982; and Asics Gel, based on U.S. Pat. No. 4,768,295 issued Sep. 6, 1988. Both of these cushioning systems and all of the other less popular ones have two essential flaws.

First, all such systems suspend the upper surface of the shoe sole directly under the important structural elements of the foot, particularly the critical the heel bone, known as the calcaneus, in order to cushion it. That is, to provide good cushioning and energy return, all such systems support the foot's bone structures in buoyant manner, as if floating on a water bed or bouncing on a trampoline. None provide firm, direct structural support to those foot support structures; the shoe sole surface above the cushioning system never comes in contact with the lower shoe sole surface under routine loads, like normal weight-bearing. In existing cushioning systems, firm structural support directly under the calcaneus and progressive cushioning are mutually incompatible. In marked contrast, it is obvious with the simplest tests that the barefoot is provided by very firm direct structural support by the fat pads underneath the bones contacting the sole, while at the same time it is effectively cushioned, though this property is underdeveloped in habitually shoe shod feet.

Second, because such existing proprietary cushioning systems do not provide adequate control of foot motion or stability, they are generally augmented with rigid structures on the sides of the shoe uppers and the shoe soles, like heel counters and motion control devices, in order to provide control and stability. Unfortunately, these rigid structures seriously obstruct natural pronation and supination motion and actually increase lateral instability, as noted in the applicant's pending U.S. applications Ser. No. 07/219,387, filed on Jul. 15, 1988; Ser. No. 07/239,667, filed on Sep. 2, 1988; Ser. No. 07/400,714, filed on Aug. 30, 1989; Ser. No. 07/416,478, filed on Oct. 3, 1989; and Ser. No. 07/424,509, filed on Oct. 20, 1989, as well as in PCT Application No. PCT/US89/03076 filed on Jul. 14, 1989. The purpose of the inventions disclosed in these applications was primarily to provide a neutral design that allows for natural foot and ankle biomechanics as close as possible to that between the foot and the ground, and to avoid the serious interference with natural foot and ankle biomechanics inherent in existing shoes.

In marked contrast to the rigid-sided proprietary designs discussed above, the barefoot provides stability at it sides by putting those sides, which are flexible and relatively inelastic, under extreme tension caused by the pressure of the compressed fat pads; they thereby become temporarily rigid when outside forces make that rigidity appropriate, producing none of the destabilizing lever arm torque problems of the permanently rigid sides of existing designs.

The applicant's '302 invention simply attempts, as closely as possible, to replicate the naturally effective structures of the foot that provide stability, support, and cushioning.

Accordingly, it was a general object of the '302 invention to elaborate upon the application of the principle of the natural basis for the support, stability and cushioning of the barefoot to shoe structures.

It was still another object of the '302 invention to provide a shoe having a sole with natural stability provided by attaching a completely flexible but relatively inelastic shoe sole upper directly to the bottom sole, enveloping the sides of the midsole, to put the side of the shoe upper under tension in reaction to destabilizing sideways forces on a tilting shoe.

It was still another object of the '302 invention to have that tension force is balanced and in equilibrium because the bottom sole is firmly anchored by body weight, so the destabilizing sideways motion is neutralized by the tension in the sides of the shoe upper.

It was another object of the '302 invention to create a shoe sole with support and cushioning which is provided by shoe sole compartments, filled with a pressure-transmitting medium like liquid, gas, or gel, that are similar in structure to the fat pads of the foot, which simultaneously provide both firm support and progressive cushioning.

These and other objects of the invention will become apparent from a detailed description of the invention which follows taken with the accompanying drawings.

BRIEF SUMMARY OF THE INVENTION

This continuation-in-part application broadens the definition of the theoretically ideal stability plane, as defined in the '786 and all prior applications filed by the applicant. The '819 Patent and subsequent applications have defined the inner surface of the theoretically ideal stability plane as conforming to the shape of the wearer's foot, especially its sides, so that the inner surface of the applicant's shoe sole invention conforms to the outer surface of the wearer's foot sole, especially it sides, when measured in frontal plane or transverse plane cross sections.

This new application explicitly includes an upper shoe sole surface that is complementary to the shape of all or a portion the wearer's foot sole. In addition, this application describes shoe contoured sole side designs wherein the inner surface of the theoretically ideal stability plane lies at some point between conforming or complementary to the shape of the wearer's foot sole, that is—roughly paralleling the foot sole including its side—and paralleling the flat ground; that inner surface of the theoretically ideal stability plane becomes load-bearing in contact with the foot sole during foot inversion and eversion, which is normal sideways or lateral motion. The basis of this design was introduced in the applicant's '302 application relative to FIG. 9 of that application.

Additionally, this application describes shoe sole side designs wherein the lower surface of the theoretically ideal stability plane, which equates to the load-bearing surface of the bottom or outer shoe sole, of the shoe sole side portions is above the plane of the underneath portion of the shoe sole, when measured in frontal or transverse plane cross sections; that lower surface of the theoretically ideal stability plane becomes load-bearing in contact with the ground during foot inversion and eversion, which is normal sideways or lateral motion.

Although the inventions described in this application may in many cases be less optimal than those previously described by the applicant in earlier applications, they nonetheless distinguish over all prior art and still do provide a significant stability improvement over existing footwear and thus provide significantly increased injury prevention benefit compared to existing footwear.

In its simplest conceptual form, the applicant's earlier invention disclosed in his '714 application is the structure of a conventional shoe sole that has been modified by having its sides bent up so that their inner surface conforms to a shape nearly identical but slightly smaller than the shape of the outer surface of the foot sole of the wearer (instead of the shoe sole sides being flat on the ground, as is conventional). This concept is like that described in FIG. 3 of the applicant's Ser. No. 07/239,667 application; for the applicant's fully contoured design described in FIG. 15 of the '667 application, the entire shoe sole—including both the sides and the portion directly underneath the foot—is bent up to conform to a shape nearly identical but slightly smaller than the contoured shape of the unloaded foot sole of the wearer, rather than the partially flattened load-bearing foot sole shown in FIG. 3.

In this continuation-in-part application, the use of this invention with otherwise conventional shoes with any side sole portion, including contoured sides with uniform or any other thickness variation or density variation, including bottom sole tread variation, especially including those defined below by the applicant, is further clarified.

This theoretical or conceptual bending up must be accomplished in practical manufacturing without any of the puckering distortion or deformation that would necessarily occur if such a conventional shoe sole were actually bent up simultaneously along all of its the sides; consequently, manufacturing techniques that do not require any bending up of shoe sole material, such as injection molding manufacturing of the shoe sole, would be required for optimal results and therefore is preferable.

It is critical to the novelty of this fundamental concept that all layers of the shoe sole are bent up around the foot sole. A small number of both street and athletic shoe soles that are commercially available are naturally contoured to a limited extent in that only their bottom soles, which are about one quarter to one third of the total thickness of the entire shoe sole, are wrapped up around portions of the wearers' foot soles; the remaining soles layers, including the insole, midsole and heel lift (or heel) of such shoe soles, constituting over half of the thickness of the entire shoe sole, remains flat, conforming to the ground rather than the wearers' feet. (At the other extreme, some shoes in the existing art have flat midsoles and bottom soles, but have insoles that conform to the wearer's foot sole.)

Consequently, in existing contoured shoe soles, the total shoe sole thickness of the contoured side portions, including every layer or portion, is much less than the total thickness of the sole portion directly underneath the foot, whereas in the applicant's prior shoe sole inventions, including the '819 Patent and '714 and '478 application, as well as the applicant's other pending applications, the shoe sole thickness of the contoured side portions are the same as the thickness of the sole portion directly underneath the foot, meaning uniform thickness as measured in frontal or transverse plane cross sections, or at least similar to the thickness of the sole portion directly underneath the foot, meaning a thickness variation of up to 25 percent, as measured in frontal or transverse plane cross sections.

This continuation-in-part application explicitly defines those thickness variations, as measured in frontal or transverse plane cross sections, of the applicant's shoe soles from 26 percent up to 50 percent, which distinguishes over all known prior art; the earlier '478 application specified thickness and density variations of up to 25 percent.

In addition, for shoe sole thickness deviating outwardly in a constructive way from the theoretically ideal stability plane, the shoe sole thickness variation of the applicant's shoe soles is increased in this application from 51 percent to 100 percent, as measured in frontal or transverse plane cross sections.

This application similarly increases constructive density variations, as most typically measured in durometers on a Shore A scale, to include 26 percent up to 50 percent and from 51 percent to 200 percent. The same variations in shoe bottom sole design can provide similar effects to the variation in shoe sole density described above.

In addition, any of the above described thickness variations from a theoretically ideal stability plane can be used together with any of the above described density or bottom sole design variations. All portions of the shoe'sole are included in thickness and density measurement, including the sockliner or insole, the midsole (including heel lift or other thickness variation measured in the sagittal plane) and bottom or outer sole.

The above described thickness and density variations apply to the load-bearing portions of the contoured sides of the applicant's shoe sole inventions, the side portion being identified in FIG. 4 of the '819 Patent. Thickness and density variations described above are measured along the contoured side portion. The side portion of the fully contoured design introduced in the '819 Patent in FIG. 15 cannot be defined as explicitly, since the bottom portion is contoured like the sides, but should be measured by estimating the equivalent FIG. 4 figure; generally, like FIGS. 14 and FIG. 15 of the '819 Patent, assuming the flattened sole portion shown in FIG. 14 corresponds to a load-bearing equivalent of FIG. 15, so that the contoured sides of FIGS. 14 and FIG. 15 are essentially the same.

Alternately, the thickness and density variations described above can be measured from the center of the essential structural support and propulsion elements defined in the '819 Patent. Those elements are the base and lateral tuberosity of the calcaneus, the heads of the metatarsals, and the base of the fifth metatarsal, and the head of the first distal phalange, respectively. Of the metatarsal heads, only the first and fifth metatarsal heads are used for such measurement, since only those two are located on lateral portions of the foot and thus proximate to contoured stability sides of the applicant's shoe sole.

This major and conspicuous structural difference between the applicant's underlying concept and the existing shoe sole art is paralleled by a similarly dramatic functional difference between the two: the aforementioned equivalent or similar thickness of the applicant's shoe sole invention maintains intact the firm lateral stability of the wearer's foot, that stability as demonstrated when the foot is unshod and tilted out laterally in inversion to the extreme limit of the normal range of motion of the ankle joint of the foot. The sides of the applicant's shoe sole invention extend sufficiently far up the sides of the wearer's foot sole to maintain the lateral stability of the wearer's foot when bare.

In addition, the applicant's shoe sole invention maintains the natural stability and natural, uninterrupted motion of the wearer's foot when bare throughout its normal range of sideways pronation and supination motion occurring during all load-bearing phases of locomotion of the wearer, including when the wearer is standing, walking, jogging and running, even when the foot is tilted to the extreme limit of that normal range, in contrast to unstable and inflexible conventional shoe soles, including the partially contoured existing art described above. The sides of the applicant's shoe sole invention extend sufficiently far up the sides of the wearer's foot sole to maintain the natural stability and uninterrupted motion of the wearer's foot when bare. The exact thickness and material density of the shoe sole sides and their specific contour will be determined empirically for individuals and groups using standard biomechanical techniques of gait analysis to determine those combinations that best provide the barefoot stability described above.

Finally, the shoe sole sides are made of material sufficiently flexible to bend out easily when the shoes are put on the wearer's feet and therefore the shoe soles gently hold the sides of the wearer's foot sole when on, providing the equivalent of custom fit in a mass-produced shoe sole. In general, the applicant's preferred shoe sole embodiments include the structural and material flexibility to deform in parallel to the natural deformation of the wearer's foot sole as if it were bare and unaffected by any of the abnormal foot biomechanics created by rigid conventional shoe sole.

At the same time, the applicant's preferred shoe sole embodiments are sufficiently firm to provide the wearer's foot with the structural support necessary to maintain normal pronation and supination, as if the wearer's foot were bare; in contrast, the excessive softness of many of the shoe sole materials used in shoe soles in the existing art cause instability in the form of abnormally excessive foot pronation and supination.

Directed to achieving the aforementioned objects and to overcoming problems with prior art shoes, a shoe according to the '714 invention comprises a sole having at least a portion thereof following the contour of a theoretically ideal stability plane, and which further includes rounded edges at the finishing edge of the sole after the last point where the constant shoe sole thickness is maintained. Thus, the upper surface of the sole does not provide an unsupported portion that creates a destabilizing torque and the bottom surface does not provide an unnatural pivoting edge.

In another aspect in the '714 application, the shoe includes a naturally contoured sole structure exhibiting natural deformation which closely parallels the natural deformation of a foot under the same load. In a preferred embodiment, the naturally contoured side portion of the sole extends to contours underneath the load-bearing foot. In another embodiment, the sole portion is abbreviated along its sides to essential support and propulsion elements wherein those elements are combined and integrated into the same discontinuous shoe sole structural elements underneath the foot, which approximate the principal structural elements of a human foot and their natural articulation between elements. The density of the abbreviated shoe sole can be greater than the density of the material used in an unabbreviated shoe sole to compensate for increased pressure loading. The essential support elements include the base and lateral tuberosity of the calcaneus, heads of the metatarsal, and the base of the fifth metatarsal.

The '714 application shoe sole is naturally contoured, paralleling the shape of the foot in order to parallel its natural deformation, and made from a material which, when under load and tilting to the side, deforms in a manner which closely parallels that of the foot of its wearer, while retaining nearly the same amount of contact of the shoe sole with the ground as in its upright state under load. A deformable shoe sole according to the invention may have its sides bent inwardly somewhat so that when worn the sides bend out easily to approximate a custom fit.

Directed to achieving the aforementioned objects and to overcoming problems with prior art shoes, a shoe according to the '478 invention comprises a sole having at least a portion thereof following approximately the contour of a theoretically ideal stability plane, preferably applied to a naturally contoured shoe sole approximating the contour of a human foot. In the applicant's shoe sole inventions, the shoe sole thickness of the contoured side portions are at least similar to the thickness of the sole portion directly underneath the foot, meaning either a thickness variation from 5 to 10 percent or from 11 to 25 percent, as measured in frontal or transverse plane cross sections.

In another aspect of the '478 invention, the shoe includes a naturally contoured sole structure exhibiting natural deformation which closely parallels the natural deformation of a foot under the same load, and having a contour which approximates, but increases beyond the theoretically ideal stability plane. When the shoe sole thickness is increased beyond the theoretically ideal stability plane, greater than natural stability results; when thickness is decreased, greater than natural motion results.

In a preferred embodiment of the '478 invention, such variations are consistent through all frontal plane cross sections so that there are proportionally equal increases to the theoretically ideal stability plane from front to back. That is to say, a 25 percent thickness increase in the lateral stability sides of the forefoot of the shoe sole would also have a 25 percent increases in lateral stability sides proximate to the base of the fifth metatarsal of a wearer's foot and a 25 increase in the lateral stability sides of the heel of the shoe sole. In alternative embodiments, the thickness may increase, then decrease at respective adjacent locations, or vary in other thickness sequences. The thickness variations may be symmetrical on both sides, or asymmetrical, particularly since it may be desirable to provide greater stability for the medial side than the lateral side to compensate for common pronation problems. The variation pattern of the right shoe can vary from that of the left shoe. Variation in shoe sole density or bottom sole tread can also provide reduced but similar effects.

This invention relates to shoe sole structures that are formed to conform to the all or part of the shape of the wearer's foot sole, either under a body weight load (defined as one body weight or alternately as any body weight force), but without contoured stability sides as defined by the applicant.

Still more particularly, this invention relates to variations in the structure of such soles using a theoretically ideal stability plane as a basic concept, especially including structures exceeding that plane.

Finally, this invention relates to contoured shoe sole sides that provide support for sideways tilting of any angular amount from zero degrees to 150 degrees at least for such contoured sides proximate to any one or more or all of the essential stability or propulsion structures of the foot, as defined below and previously.

These and other features of the invention will become apparent from the detailed description of the invention which follows.

BRIEF DESCRIPTION OF THE DRAWINGS

FIGS. 1–3 are from the '714 application; FIGS. 4–8 are from the '478 application; and FIG. 9 is from the '302 application.

FIG. 2 shows variations in the relative density of the shoe sole including the shoe insole to maximize an ability of the sole to deform naturally.

FIG. 3 shows a shoe having naturally contoured sides bent inwardly somewhat from a normal size so then when worn the shoe approximates a custom fit.

FIG. 4 shows a frontal plane cross section at the heel portion of a shoe with naturally contoured sides like those of FIG. 24, wherein a portion of the shoe sole thickness is increased beyond the theoretically ideal stability plane.

FIG. 5 is a view similar to FIG. 4, but of a shoe with fully contoured sides wherein the sole thickness increases with increasing distance from the center line of the ground-engaging portion of the sole.

FIG. 6 is a view similar to FIGS. 29 and 30 showing still another density variation, one which is asymmetrical.

FIG. 7 shows an embodiment like FIG. 25 but wherein a portion of the shoe sole thickness is decreased to less than the theoretically ideal stability plane.

FIG. 8 shows a bottom sole tread design that provides a similar density variation as that in FIG. 6.

FIG. 9 is the applicant's new shoe sole design in a sequential series of frontal plane cross sections of the heel at the ankle joint area that corresponds exactly to the FIG. 42 series below.

FIG. 10 is the applicant's custom fit design utilizing downsized flexible contoured shoe sole sides in combination with a thickness greater than the theoretically ideal stability plane.

FIG. 11 is the same custom fit design in combination with shoe sole side portions having a material with greater density than the sole portion.

FIGS. 12–23 are from the '714 application.

FIG. 12 is a rear view of a heel of a foot for explaining the use of a stationery sprain simulation test.

FIG. 13 is a rear view of a conventional running shoe unstably rotating about an edge of its sole when the shoe sole is tilted to the outside.

FIG. 14 is a diagram of the forces on a foot when rotating in a shoe of the type shown in FIG. 2.

FIG. 15 is a view similar to FIG. 3 but showing further continued rotation of a foot in a shoe of the type shown in FIG. 2.

FIG. 16 is a force diagram during rotation of a shoe having motion control devices and heel counters.

FIG. 17 is another force diagram during rotation of a shoe having a constant shoe sole thickness, but producing a destabilizing torque because a portion of the upper sole surface is unsupported during rotation.

FIG. 18 shows an approach for minimizing destabilizing torque by providing only direct structural support and by rounding edges of the sole and its outer and inner surfaces.

FIG. 19 shows a shoe sole having a fully contoured design but having sides which are abbreviated to the essential structural stability and propulsion elements that are combined and integrated into discontinuous structural elements underneath the foot that simulate those of the foot.

FIG. 20 is a diagram serving as a basis for an expanded discussion of a correct approach for measuring shoe sole thickness.

FIG. 21 shows several embodiments wherein the bottom sole includes most or all of the special contours of the new designs and retains a flat upper surface.

FIG. 22, in FIGS. 22A–22C, show frontal plane cross sections of an enhancement to the previously-described embodiment.

FIG. 23 shows, in FIGS. 23A–23C, the enhancement of FIG. 39 applied to the naturally contoured sides embodiment of the invention.

FIG. 24 shows, in frontal plane cross section at the heel portion of a shoe, the applicant's prior invention of a shoe sole with naturally contoured sides based on a theoretically ideal stability plane.

FIG. 25 shows, again in frontal plane cross section, the most general case of the applicant's prior invention, a fully contoured shoe sole that follows the natural contour of the bottom of the foot as well as its sides, also based on the theoretically ideal stability plane.

FIG. 26, as seen in FIGS. 26A to 26C in frontal plane cross section at the heel, shows the applicant's prior invention for conventional shoes, a quadrant-sided shoe sole, based on a theoretically ideal stability plane.

FIG. 27 is based on FIG. 1B but also shows, for purposes of illustration, on the right side a relative thickness increase of the contoured shoe sole side for that portion of the contoured shoe sole side beyond the limit of the full range of normal sideways foot inversion and eversion motion, and on the left side, a similar relative density increase.

FIG. 28 is a view similar to FIGS. 4 ,5 & 27 wherein the sole thicknesses vary in diverse sequences.

FIG. 29 is a frontal plane cross section showing a density variation in the midsole.

FIG. 30 is a view similar to FIG. 29 wherein the firmest density material is at the outermost edge of the midsole contour.

FIG. 31 shows a variation in the thickness of the sole for the quadrant embodiment which is greater than a theoretically ideal stability plane.

FIG. 32 shows a quadrant embodiment as in FIG. 31 wherein the density of the sole varies.

FIG. 33 shows embodiments like FIGS. 24 through 26 but wherein a portion of the shoe sole thickness is decreased to less than the theoretically ideal stability plane.

FIG. 34 show embodiments with sides both greater and lesser than the theoretically ideal stability plane.

FIG. 35 is a perspective view of a typical athletic shoe for running known to the prior art to which the invention is applicable.

FIG. 36 illustrates in a close-up frontal plane cross section of the heel at the ankle joint the typical shoe of existing art, undeformed by body weight, when tilted sideways on the bottom edge.

FIG. 37 shows, in the same close-up cross section as FIG. 2, the applicant's prior invention of a naturally contoured shoe sole design, also tilted out.

FIG. 38 shows a rear view of a barefoot heel tilted laterally 20 degrees.

FIG. 39 shows, in a frontal plane cross section at the ankle joint area of the heel, the applicant's new invention of tension stabilized sides applied to his prior naturally contoured shoe sole.

FIG. 40 shows, in a frontal plane cross section close-up, the FIG. 5 design when tilted to its edge, but undeformed by load.

FIG. 41 shows, in frontal plane cross section at the ankle joint area of the heel, the FIG. 5 design when tilted to its edge and naturally deformed by body weight, though constant shoe sole thickness is maintained undeformed.

FIG. 42 is a sequential series of frontal plane cross sections of the barefoot heel at the ankle joint area. FIG. 8A is unloaded and upright; FIG. 8B is moderately loaded by full body weight and upright; FIG. 8C is heavily loaded at peak landing force while running and upright; and FIG. 8D is heavily loaded and tilted out laterally to its about 20 degree maximum.

FIG. 43 is the applicant's new shoe sole design in a sequential series of frontal plane cross sections of the heel at the ankle joint area that corresponds exactly to the FIG. 8 series above.

FIG. 44 is two perspective views and a close-up view of the structure of fibrous connective tissue of the groups of fat cells of the human heel. FIG. 10A shows a quartered section of the calcaneus and the fat pad chambers below it; FIG. 10B shows a horizontal plane close-up of the inner structures of an individual chamber; and FIG. 10D shows a horizontal section of the whorl arrangement of fat pad underneath the calcaneus.

FIGS. 45–58 are new to this continuation-in-part application.

FIG. 45 is similar to FIG. 4, but shows more extreme thickness increase variations.

FIG. 46 is similar to FIG. 5, but shows more extreme thickness increase variations.

FIG. 47 is similar to FIG. 6, but shows more extreme density variations.

FIG. 48 is similar to FIG. 7, but shows more extreme thickness decrease variations.

FIG. 49 is similar to FIG. 8, but shows more extreme bottom sole tread pattern variations.

FIG. 50 is similar to. FIG. 10, but shows more extreme thickness increase variations FIG. 51 is similar to FIG. 11, but shows more extreme density variations.

FIG. 52 is similar to FIG. 1A, but shows on the right side an upper shoe sole surface of the contoured side that is complementary to the shape of the wearer's foot-sole; on the left side FIG. 52 shows an upper surface between complementary and parallel to the flat ground and a lower surface of the contoured shoe sole side that is not in contact with the ground.

FIG. 53 is like FIG. 27 of the '819 Patent, but with angular measurements of the contoured shoe sole sides indicated from zero degrees to 180 degrees.

FIG. 54 is similar to FIG. 19 of the '819 Patent, but without contoured stability sides.

FIGS. 55–56 are similar to FIGS. 20–21 of the '819 Patent, but without contoured stability sides.

FIG. 57 is similar to FIG. 34, which is FIG. 15 of the '478 application showing the applicant's design with the outer surface defined by a part of a quadrant, but with more extreme thickness variations.

DETAILED DESCRIPTION OF THE PREFERRED EMBODIMENTS

Figure 1A:
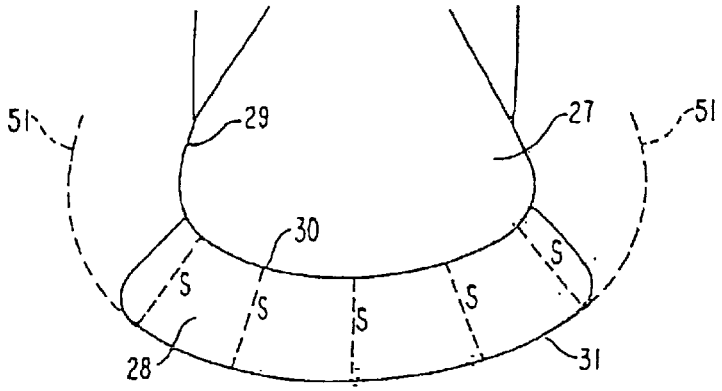
FIGS. 1A to 1C [8] illustrate functionally the principles of natural deformation as applied to the shoe soles of the '667 and '714 invention.
Figure 1B:
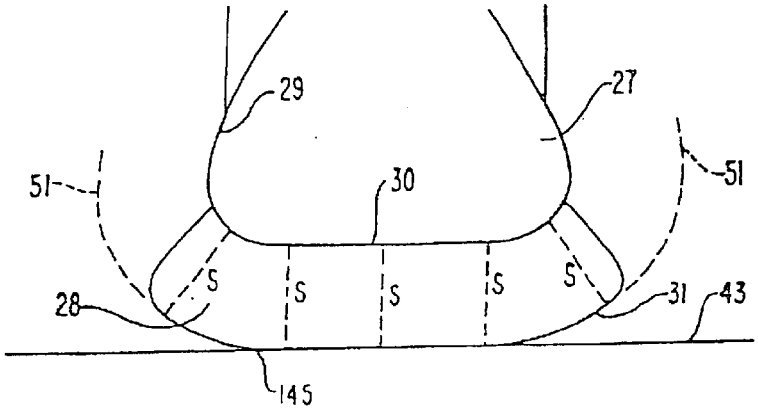
Figure 1C:
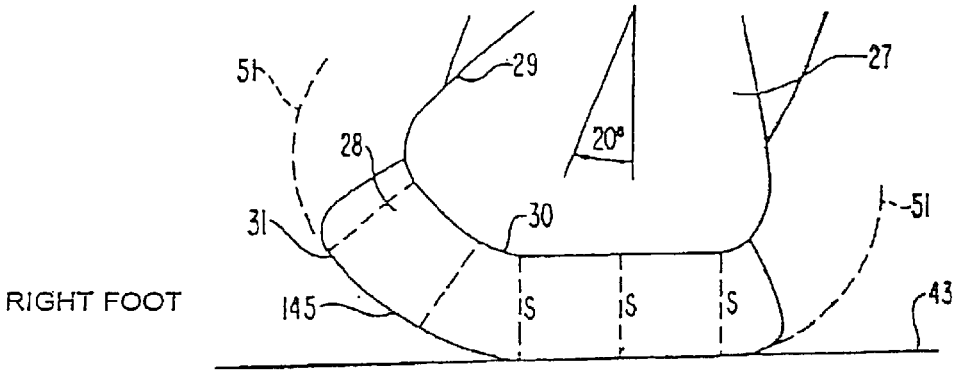
Figure 1D:
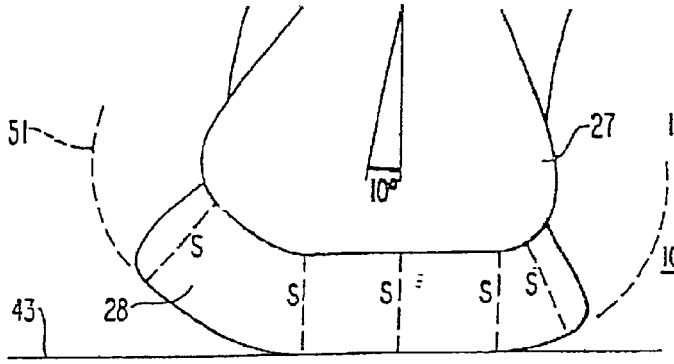
FIGS. 1 through 9 are from prior copending applications of the applicant, with some new textual specification added.
Figure 1G:
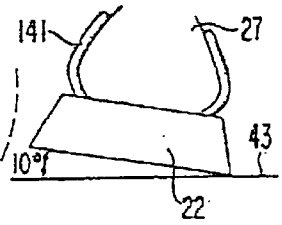
Figure 1E:
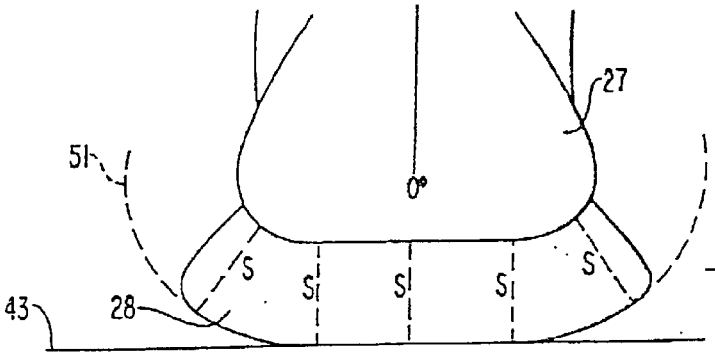
Figure 1H:
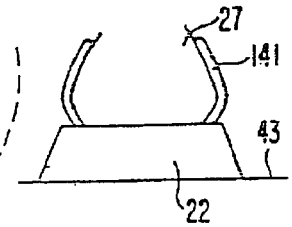
Figure 1F:
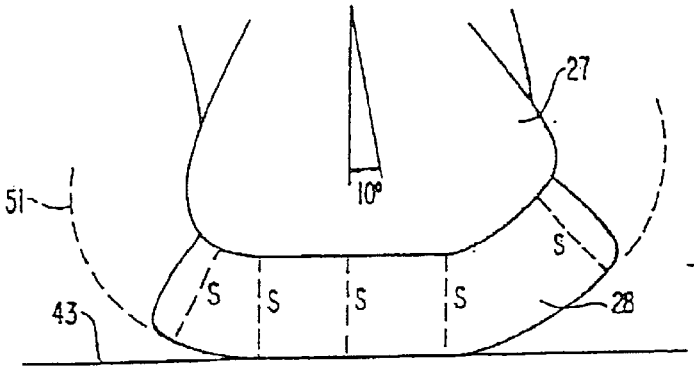
Figure 1I:
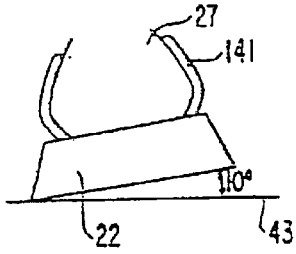

FIGS. 1A–C illustrate, in frontal or transverse plane cross sections in the heel area, the applicant's concept of the theoretically ideal stability plane applied to shoe soles.

FIGS. 1A–1C illustrate clearly the principle of natural deformation as it applies to the applicant's design, even though design diagrams like those preceding (and in his previous applications already referenced) are normally shown in an ideal state, without any functional deformation, obviously to show their exact shape for proper construction. That natural structural shape, with its contour paralleling the foot, enables the shoe sole to deform naturally like the foot. In the applicant's invention, the natural deformation feature creates such an important functional advantage it will be illustrated and discussed here fully. Note in the figures that even when the shoe sole shape is deformed, the constant shoe sole thickness in the frontal plane feature of the invention is maintained.

FIG. 1A is FIG. 8A in the applicant's U.S. Patent application Ser. No. 07/400,714 and FIG. 15 in his Ser. No. 07/239,667 Application. FIG. 1A shows a fully contoured shoe sole design that follows the natural contour of all of the foot sole, the bottom as well as the sides. The fully contoured shoe sole assumes that the resulting slightly rounded bottom when unloaded will deform under load as shown in FIG. 1B and flatten just as the human foot bottom is slightly round unloaded but flattens under load. Therefore, the shoe sole material must be of such composition as to allow the natural deformation following that of the foot. The design applies particularly to the heel, but to the rest of the shoe sole as well. By providing the closes match to the natural shape of the foot, the fully contoured design allows the foot to function as naturally as possible. Under load, FIG. 1A would deform by flattening to look essentially like FIG. 1B.

FIGS. 1A and 1B show in frontal plane cross section the essential concept underlying this invention, the theoretically ideal stability plane which is also theoretically ideal for efficient natural motion of all kinds, including running, jogging or walking. For any given individual, the theoretically ideal stability plane 51 is determined, first, by the desired shoe sole thickness (s) in a frontal plane cross section, and, second, by the natural shape of the individual's foot surface 29.

For the case shown in FIG. 1B, the theoretically ideal stability plane for any particular individual (or size average of individuals) is determined, first, by the given frontal plane cross section shoe sole thickness (s); second, by the natural shape of the individual's foot; and, third, by the frontal plane cross section width of the individual's load-bearing footprint which is defined as the supper surface of the shoe sole that is in physical contact with and supports the human foot sole.

FIG. 1B is FIG. 8B of the '714 application and shows the same fully contoured design when upright, under normal load (body weight) and therefore deformed naturally in a manner very closely paralleling the natural deformation under the same load of the foot. An almost identical portion of the foot sole that is flattened in deformation is also flatten in deformation in the shoe sole. FIG. 1C is FIG. 8C of the '714 application and shows the same design when tilted outward 20 degrees laterally, the normal barefoot limit; with virtually equal accuracy it shows the opposite foot tilted 20 degrees inward, in fairly severe pronation. As shown, the deformation of the shoe sole 28 again very closely parallels that of the foot, even as it tilts. Just as the area of foot contact is almost as great when tilted 20 degrees, the flattened area of the deformed shoe sole is also nearly the same as when upright. Consequently, the barefoot fully supported structurally and its natural stability is maintained undiminished, regardless of shoe tilt. In marked contrast, a conventional shoe, shown in FIG. 12, makes contact with the ground with only its relatively sharp edge when tilted and is therefore inherently unstable.

The capability to deform naturally is a design feature of the applicant's naturally contoured shoe sole designs, whether fully contoured or contoured only at the sides, though the fully contoured design is most optimal and is the most natural, general case, as note in the referenced Sep. 2, 1988, Application, assuming shoe sole material such as to allow natural deformation. It is an important feature because, by following the natural deformation of the human foot, the naturally deforming shoe sole can avoid interfering with the natural biomechanics of the foot and ankle.

FIG. 1C also represents with reasonable accuracy a shoe sole design corresponding to FIG. 1B, a naturally contoured shoe sole with a conventional built-in flattening deformation, as in FIG. 14 of the above referenced Sep. 2, 1988, Application, except that design would have a slight crimp at 145. Seen in this light, the naturally contoured side design in FIG. 1B is a more conventional, conservative design that is a special case of the more generally fully contoured design in FIG. 1A, which is the closest to the natural form of the foot, but the least conventional.

Figure 3:
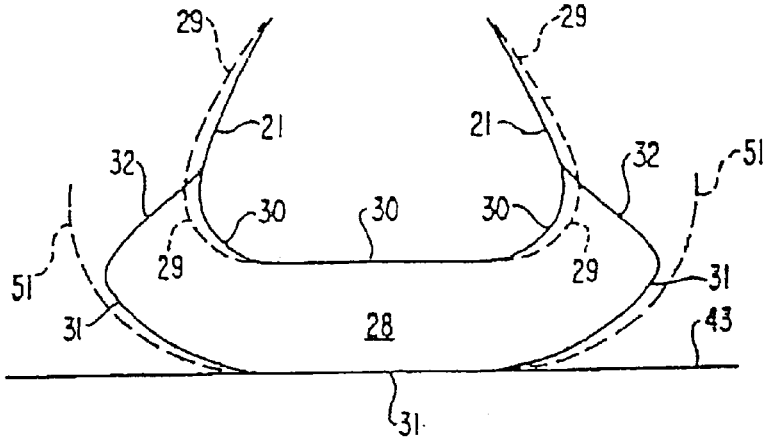

In its simplest conceptual form, the applicant's FIG. 1 invention is the structure of a conventional shoe sole that has been modified by having its sides bent up so that their inner surface conforms to the shape of the outer surface of the foot sole of the wearer (instead of the shoe sole sides being flat on the ground, as is conventional); this concept is like that described in FIG. 3 of the applicant's Ser. No. 07/239,667 application. For the applicant's fully contoured design, the entire shoe sole—including both the sides and the portion directly underneath the foot—is bent up to conform to the shape of the unloaded foot sole of the wearer, rather than the partially flattened load-bearing foot sole shown in FIG. 3.

This theoretical or conceptual bending up must be accomplished in practical manufacturing without any of the puckering distortion or deformation that would necessarily occur if such a conventional shoe sole were actually bent up simultaneously along all of its the sides; consequently, manufacturing techniques that do not require any bending up of shoe sole material, such as injection molding manufacturing of the shoe sole, would be required for optimal results and therefore is preferable.

It is critical to the novelty of this fundamental concept that all layers of the shoe sole are bent up around the foot sole. A small number of both street and athletic shoe soles that are commercially available are naturally contoured to a limited extent in that only their bottom soles, which are about one quarter to one third of the total thickness of the entire shoe sole, are wrapped up around portions of the wearer's foot soles; the remaining sole layers, including the insole, the midsole and the heel lift (or heel) of such shoe soles, constituting over half of the thickness of the entire shoe sole, remains flat, conforming to-the ground rather than the wearers' feet.

Consequently, in existing contoured shoe soles, the shoe sole thickness of the contoured side portions is much less than the thickness of the sole portion directly underneath the foot, whereas in the applicant's shoe sole inventions in the '819 Patent the shoe sole thickness of the contoured side portions are the same as the thickness of the sole portion directly underneath the foot.

This major and conspicuous structural difference between the applicant's underlying concept and the existing shoe sole art is paralleled by a similarly dramatic functional difference between the two: the aforementioned equivalent or similar thickness of the applicant's shoe sole invention maintains intact the firm lateral stability of the wearer's foot, as demonstrated when the foot is unshod and tilted out laterally in inversion to the extreme limit of the normal range of motion of the ankle joint of the foot; in a similar demonstration in a conventional shoe sole, the wearer's foot and ankle are unstable. The sides of the applicant's shoe sole invention extend sufficiently far up the sides of the wearer's foot sole to maintain the lateral stability of the wearer's foot when bare.

In addition, the applicant's shoe sole invention maintains the natural stability and natural, uninterrupted motion of the wearer's foot when bare throughout its normal range of sideways pronation and supination motion occurring during all load-bearing phases of locomotion of the wearer, including when said wearer is standing, walking, jogging and running, even when said foot is tilted to the extreme limit of that normal range, in contrast to unstable and inflexible conventional shoe soles, including the partially contoured existing art described above. The sides of the applicant's shoe sole invention extend sufficiently far up the sides of the wearer's foot sole to maintain that natural stability and uninterrupted motion.

For the FIG. 1 shoe sole invention, the amount of any shoe sole side portions coplanar with the theoretically ideal stability plane is determined by the degree of shoe sole stability desired and the shoe sole weight and bulk required to provide said stability; the amount of said coplanar contoured sides that is provided said shoe sole being sufficient to maintain intact the firm stability of the wearer's foot throughout the range of foot inversion and eversion motion typical of the use for which the shoe is intended and also typical of the kind of wearer—such as normal or excessive pronator—for which said shoe is intended.

Figure 15:
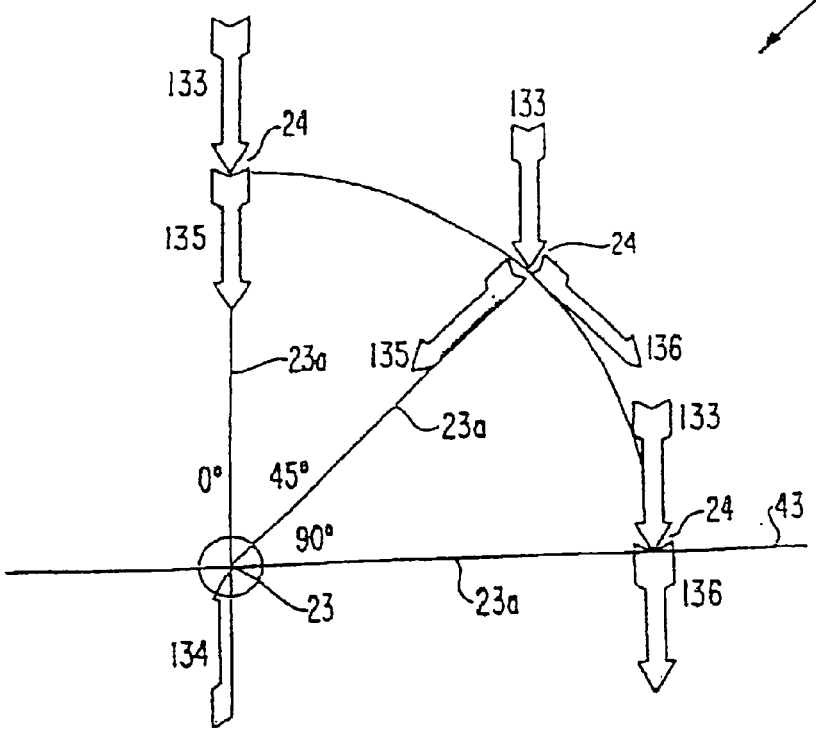

As mentioned earlier, FIG. 1A is FIG. 15 in the applicant's Ser. No. 07/239,667 Application; however, it does not show the heel lift 38 which is included in the original FIG. 15. That heel lift is shown with constant frontal or transverse plane thickness, since it is oriented conventionally in alignment with the frontal or transverse plane and perpendicular to the long axis of the shoe sole; consequently, the thickness of the heel lift decreases uniformly in the frontal or transverse plane between the heel and the forefoot when moving forward along the long axis of the shoe sole. However, the conventional heel wedge, or toe taper or other shoe sole thickness variations in the sagittal plane along the long axis of the shoe sole, can be located at an angle to the conventional alignment.

For example, the heel wedge can be rotated inward in the horizontal plane so that it is located perpendicular to the subtalar axis, which is located in the heel area generally about 20 to 25 degrees medially, although a different angle can be used base on individual or group testing; such a orientation may provide better, more natural support to the subtalar joint, through which critical pronation and supination motion occur. The applicant's theoretically ideal stability plane concept would teach that such a heel wedge orientation would require constant shoe sole thickness in a vertical plane perpendicular to the chosen subtalar joint axis, instead of the frontal plane.

Figure 2:
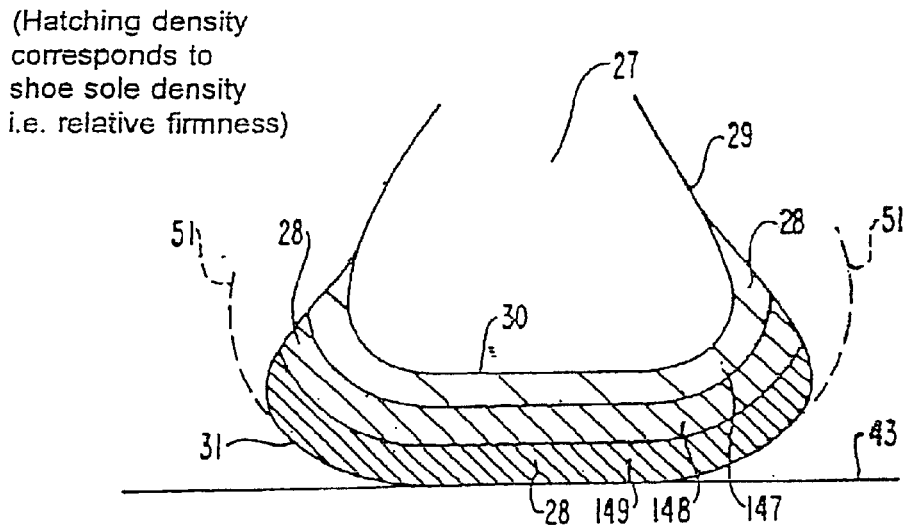
Figure 9:
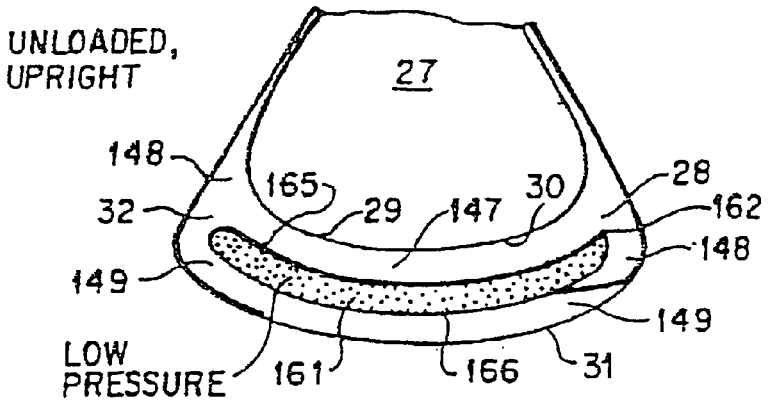

FIG. 2 is FIG. 9 of the '714 application and shows, in frontal or transverse plane cross section in the heel area, the preferred relative density of the shoe sole, including the insole as a part, order to maximize the shoe sole's ability to deform naturally following the natural deformation of the foot sole. Regardless of how many shoe sole layers (including insole) or laminations of differing material densities and flexibility are used in total, the softest and most flexible material 147 should be closest to the foot sole, with a progression through less soft 148 to the firmest and least flexible 149 at the outermost shoe sole layer, the bottom sole. This arrangement helps to avoid the unnatural side lever arm/torque problem mentioned in the previous several figures.

FIG. 3, which is a frontal or transverse plane cross section at the heel, is FIG. 10 from the applicant's copending U.S. patent application Ser. No. 07/400,714, filed Aug. 30, 1989. FIG. 3 illustrates that the applicant's naturally contoured shoe sole sides can be made to provide a fit so close as to approximate a custom fit. By molding each mass-produced shoe size with sides that are bent in somewhat from the position 29 they would normally be in to conform to that standard size shoe last, the shoe soles so produced will very gently hold the sides of each individual foot exactly. Since the shoe sole is designed as described in connection with FIG. 2 (FIG. 9 of the applicant's copending application Ser. No. 07/400,714) to deform easily and naturally like that of the bare foot, it will deform easily to provide this designed-in custom fit. The greater the flexibility of the shoe sole sides, the greater the range of individual foot size. This approach applies to the fully contoured design described here in FIG. 1A (FIG. 8A of the '714 application) and in FIG. 15, U.S. patent application Ser. No. 07/239,667 (filed 02 Sep. 1988), as well, which would be even more effective than the naturally contoured sides design shown in FIG. 3.

Figure 27:
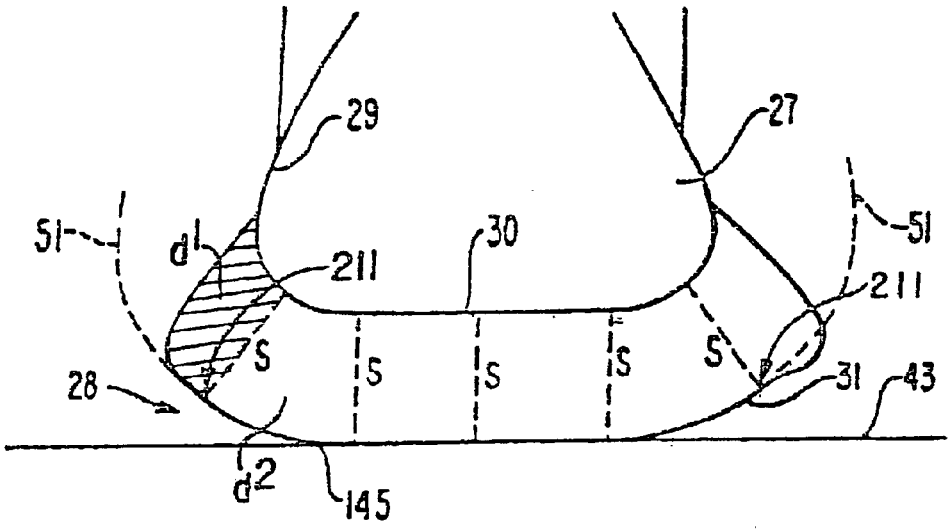

Besides providing a better fit, the intentional undersizing of the flexible shoe sole sides allows for simplified design of shoe sole lasts, since they can be designed according to the simple geometric methodology described in the textual specification of FIG. 27, U.S. application Ser. No. 07/239,667 (filed 02 Sep. 1988). That geometric approximation of the true actual contour of the human is close enough to provide a virtual custom fit, when compensated for by the flexible undersizing from standard shoe lasts described above.

Expanding on the '714 Application, a flexible undersized version of the fully contoured design described in FIG. 1A (and 8A of the '714 application) can also be provided by a similar geometric approximation. As a result, the undersized flexible shoe sole sides allow the applicant's shoe sole inventions based on the theoretically ideal stability plane to be manufactured in relatively standard sizes in the same manner as are shoe uppers, since the flexible shoe sole sides can be built on standard shoe lasts, even though conceptually those sides conform closely to the specific shape of the individual wearer's foot sole, because the flexible sides bend to conform when on the wearer's foot sole.

FIG. 3 shows the shoe sole structure when not on the foot of the wearer; the dashed line 29 indicates the position of the shoe last, which is assumed to be a reasonably accurate approximation of the shape of the outer surface of the wearer's foot sole, which determines the shape of the theoretically ideal stability plane 51. Thus, the dashed lines 29 and 51 show what the positions of the inner surface 30 and outer surface 31 of the shoe sole would be when the shoe is put on the foot of the wearer. Numbering with the figures in this application is consistent with the numbering used in prior applications of the applicant.

The FIG. 3 invention provides a way make the inner surface 30 of the contoured shoe sole, especially its sides, conform very closely to the outer surface 29 of the foot sole of a wearer. It thus makes much more practical the applicant's earlier underlying naturally contoured designs shown in FIGS. 1A–C. The shoe sole structures shown in FIG. 1, then, are what the FIG. 3 shoe sole structure would be when on the wearer's foot, where the inner surface 30 of the shoe upper is bent out to virtually coincide with the outer surface of the foot sole of the wearer 29 (the figures in this and prior applications show one line to emphasize the conceptual coincidence of what in fact are two lines; in real world embodiments, some divergence of the surface, especially under load and during locomotion would be unavoidable).

In its simplest conceptual form, the applicant's invention is the structure of a conventional shoe sole that has been modified by having its sides bent up so that their inner surface conforms to a shape nearly identical but slightly smaller than the shape of the outer surface of the foot sole of the wearer (instead of the shoe sole sides being flat on the ground, as is conventional); this concept is like that described in FIG. 3 of the applicant's Ser. No. 07/239,667 application. For the applicant's fully contoured design described in FIG. 15 of the '667 application, the entire shoe sole—including both the sides and the portion directly underneath the foot—is bent up to conform to a shape nearly identical but slightly smaller than the contoured shape of the unloaded foot sole of the wearer, rather than the partially flattened load-bearing foot sole shown in FIG. 3.

This theoretical or conceptual bending up must be accomplished in practical manufacturing without any of the puckering distortion or deformation that would necessarily occur if such a conventional shoe sole were actually bent up simultaneously along all of its the sides; consequently, manufacturing techniques that do not require any bending up of shoe sole material, such as injection molding manufacturing of the shoe sole, would be required for optimal results and therefore is preferable.

It is critical to the novelty of this fundamental concept that all layers of the shoe sole are bent up around the foot sole. A small number of both street and athletic shoe soles that are commercially available are naturally contoured to a limited extent in that only their bottom soles, which are about one quarter to one third of the total thickness of the entire shoe sole, are wrapped up around portions of the wearers' foot soles; the midsole and heel lift (or heel) of such shoe soles, constituting over half of the thickness of the entire shoe sole, remains flat, conforming to the ground rather than the wearers' feet. (At the other extreme, some shoes in the existing art have flat midsoles and bottom soles, but have insoles that conform to the wearer's foot sole.).

Consequently, in existing contoured shoe soles, the shoe sole thickness of the contoured side portions is much less than the thickness of the sole portion directly underneath the foot, whereas in the applicant's shoe sole inventions the shoe sole thickness of the contoured side portions are the same as the thickness of the sole portion directly underneath the foot.

This major and conspicuous structural difference between the applicant's underlying concept and the existing shoe sole art is paralleled by a similarly dramatic functional difference between the two: the aforementioned equivalent thickness of the applicant's shoe sole invention maintains intact the firm lateral stability of the wearer's foot, as demonstrated when the foot is unshod and tilted out laterally in inversion to the extreme limit of the normal range of motion of the ankle joint of the foot; in a similar demonstration in a conventional shoe sole, the wearer's foot and ankle are unstable. The sides of the applicant's shoe sole invention extend sufficiently far up the sides of the wearer's foot sole to maintain the lateral stability of the wearer's foot when bare.

In addition, the applicant's shoe sole invention maintains the natural stability and natural, uninterrupted motion of the wearer's foot when bare throughout its normal range of sideways pronation and supination motion occurring during all load-bearing phases of locomotion of the wearer, including when the wearer is standing, walking, jogging and running, even when said foot is tilted to the extreme limit of that normal range, in contrast to unstable and inflexible conventional shoe soles, including the partially contoured existing art described above. The sides of the applicant's shoe sole invention extend sufficiently far up the sides of the wearer's foot sole to maintain the natural stability and uninterrupted motion of the wearer's foot when bare.

For the FIG. 3 shoe sole invention, the amount of any shoe sole side portions coplanar with the theoretically ideal stability plane is determined by the degree of shoe sole stability desired and the shoe sole weight and bulk required to provide said stability; the amount of said coplanar contoured sides that is provided said shoe sole being sufficient to maintain intact the firm stability of the wearer's foot throughout the range of foot inversion and eversion motion typical of the use for which the shoe is intended and also typical of the kind of wearer such as normal or excessive pronator—for which said shoe is intended.

The shoe sole sides of the FIG. 3 invention are sufficiently flexible to bend out easily when the shoes are put on the wearer's feet and therefore the shoe soles gently hold the sides of the wearer's foot sole when on, providing the equivalent of custom fit in a mass-produced shoe sole. In general, the applicant's preferred shoe sole embodiments include the structural and material flexibility to deform in parallel to the natural deformation of the wearer's foot sole as if it were bare and unaffected by any of the abnormal foot biomechanics created by rigid conventional shoe sole.

At the same time, the applicant's preferred shoe sole embodiments are sufficiently firm to provide the wearer's foot with the structural support necessary to maintain normal pronation and supination, as if the wearer's foot were bare; in contrast, the excessive softness of many of the shoe sole materials used in shoe soles in the existing art cause abnormal foot pronation and supination.

Figure 28:
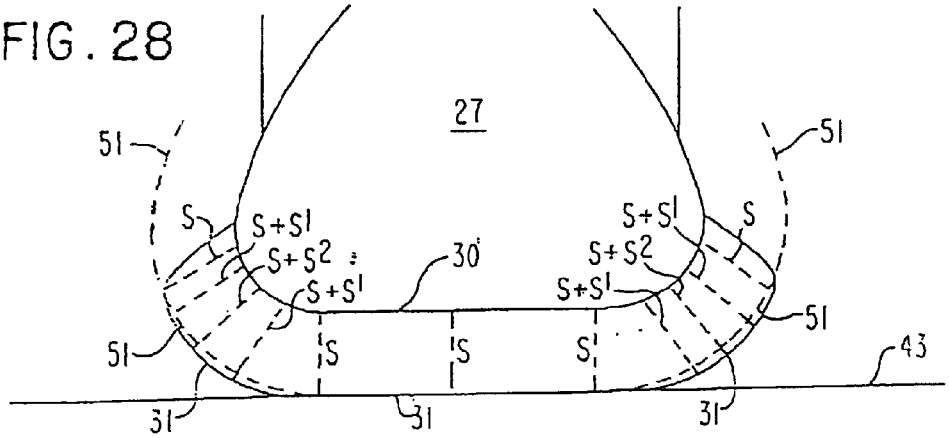

FIG. 3 is a frontal or transverse plane cross section at the heel, so the structure is shown at one of the essential structural support and propulsion elements, as specified by applicant in his copending Ser. No. 07/239,667 application in its FIG. 21 specification. The essential structural support elements are the base and lateral tuberosity of the calcaneus 95, the heads of the metatarsals 96, and the base of the fifth metatarsal 97; the essential propulsion element is the head of the first distal phalange 98. The FIG. 3 shoe sole structure can be abbreviated along its sides to only the essential structural support and propulsion elements, like FIG. 21 of the '667 application. The FIG. 3 design can also be abbreviated underneath the shoe sole to the same essential structural support and propulsion elements, as shown in FIG. 28 of the '667 Application.

As mentioned earlier regarding FIG. 1A, the applicant has previously shown heel lifts with constant frontal or transverse plane thickness, since it is oriented conventionally in alignment with the frontal or transverse plane and perpendicular to the long axis of the shoe sole. However, the heel wedge (or toe taper or other shoe sole thickness variations in the sagittal plane-along the long axis of the shoe sole) can be located at an angle to the conventional alignment in the FIG. 3 design.

For example, the heel wedge can be rotated inward in the horizontal plane so that it is located perpendicular to the subtalar axis, which is located in the heel area generally about 20 to 25 degrees medially, although a different angle can be used base on individual or group testing; such a orientation may provide better, more natural support to the subtalar joint, through which critical pronation and supination motion occur. The applicant's theoretically ideal stability plane concept would teach that such a heel wedge orientation would require constant shoe sole thickness in a vertical plane perpendicular to the chosen subtalar joint axis, instead of the frontal plane.

The sides of the shoe sole structure described under FIG. 3 can also be used to form a slightly less optimal structure: a conventional shoe sole that has been modified by having its sides bent up so that their inner surface conforms to shape nearly identical but slightly larger than the shape of the outer surface of the foot sole of the wearer, instead of the shoe sole sides being flat on the ground, as is conventional. Clearly, the closer the sides are to the shape of the wearer's foot sole, the better as a general rule, but any side position between flat on the ground and conforming like FIG. 3 to a shape slightly smaller than the wearer's shape is both possible and more effective than conventional flat shoe sole sides. And in some cases, such as for diabetic patients, it may be optimal to have relatively loose shoe sole sides providing no conforming pressure of the shoe sole on the tender foot sole; in such cases, the shape of the flexible shoe uppers, which can even be made with very elastic materials such as lycra and spandex, can provide the capability for the shoe, including the shoe sole, to conform to the shape of the foot.

As discussed earlier by the applicant, the critical functional feature of a shoe sole is that it deforms under a weight-bearing load to conform to the foot sole just as the foot sole deforms to conform to the ground under a weight-bearing load. So, even though the foot sole and the shoe sole may start in different locations—the shoe sole sides can even be conventionally flat on the ground—the critical functional feature of both is that they both conform under load to parallel the shape of the ground, which conventional shoes do not, except when exactly upright. Consequently, the applicant's shoe sole invention, stated most broadly, includes any shoe sole—whether conforming to the wearer's foot sole or to the ground or some intermediate position, including a shape much smaller than the wearer's foot sole—that deforms to conform to the theoretically ideal stability plane, which by definition itself deforms in parallel with the deformation of the wearer's foot sole under weight-bearing load.

Of course, it is optimal in terms of preserving natural foot biomechanics, which is the primary goal of the applicant, for the shoe sole to conform to the foot sole when on the foot, not just when under a weight-bearing load. And, in any case, all of the essential structural support and propulsion elements previously identified by the applicant in discussing FIG. 3 must be supported by the foot sole.

To the extent the shoe sole sides are easily flexible, as has already been specified as desirable, the position of the shoe sole sides before the wearer puts on the shoe is less important, since the sides will easily conform to the shape of the wearer's foot when the shoe is put on that foot. In view of that, even shoe sole sides that conform to a shape more than slightly smaller than the shape of the outer surface of the wearer's foot sole would function in accordance with the applicant's general invention, since the flexible sides could bend out easily a considerable relative distance and still conform to the wearer's foot sole when on the wearer's foot.

Figure 4:
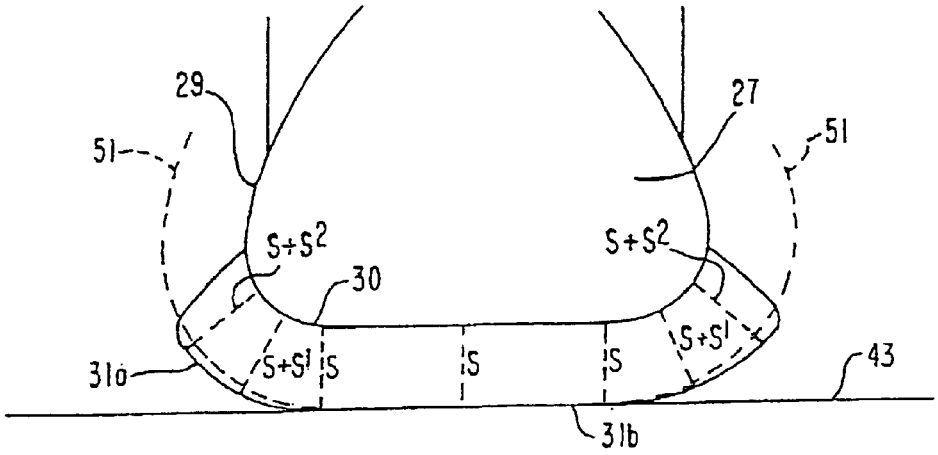

FIG. 4 is FIG. 4 from the applicant's copending U.S. patent application Ser. No. 07/416,478, filed Oct. 3, 1989. FIG. 4 illustrates, in frontal or transverse plane cross section in the heel area, the applicant's new invention of shoe sole side thickness increasing beyond the theoretically ideal stability plane to increase stability somewhat beyond its natural level. The unavoidable trade-off resulting is that natural motion would be restricted Somewhat and the weight of the shoe sole would increase somewhat.

FIG. 4 shows a situation wherein the thickness of the sole at each of the opposed sides is thicker at the portions of the sole 31*a* by a thickness which gradually varies continuously from a thickness (s) through a thickness (s+s1), to a thickness (s+s2).

These designs recognize that lifetime use of existing shoes, the design of which has an inherent flaw that continually disrupts natural human biomechanics, has produced thereby actual structural changes in a human foot and ankle to an extent that must be compensated for. Specifically, one of the most common of the abnormal effects of the inherent existing flaw is a weakening of the long arch of the foot, increasing pronation. These designs therefore modify the applicant's preceding designs to provide greater than natural stability and should be particularly useful to individuals, generally with low arches, prone to pronate excessively, and could be used only on the medial side. Similarly, individuals with high arches and a tendency to over supinate and lateral ankle sprains would also benefit, and the design could be used only on the lateral side. A shoe for the general population that compensates for both weaknesses in the same shoe would incorporate the enhanced stability of the design compensation on both sides.

The new design in FIG. 4 (like FIGS. 1 and 2 of the '478 application) allows the shoe sole to deform naturally closely paralleling the natural deformation of the barefoot under load; in addition, shoe sole material must be of such composition as to allow the natural deformation following that of the foot.

The new designs retain the essential novel aspect of the earlier designs; namely, contouring the shape of the shoe sole to the shape of the human foot. The difference is that the shoe sole thickness in the frontal plane is allowed to vary rather than remain uniformly constant. More specifically, FIG. 4 (and FIGS. 5, 6, 7, and 11 of the '478 application) show, in frontal plane cross sections at the heel, that the shoe sole thickness can increase beyond the theoretically ideal stability plane 51, in order to provide greater than natural stability. Such variations (and the following variations) can be consistent through all frontal plane cross sections, so that there are proportionately equal increases to the theoretically ideal stability plane 51 from the front of the shoe sole to the back, or that the thickness can vary, preferably continuously, from one frontal plane to the next.

The exact amount of the increase in shoe sole thickness beyond the theoretically ideal stability plane is to be determined empirically. Ideally, right and left shoe soles would be custom designed for each individual based on an biomechanical analysis of the extent of his or her foot and ankle disfunction in order to provide an optimal individual correction. If epidemiological studies indicate general corrective patterns for specific categories of individuals or the population as a whole, then mass-produced corrective shoes with soles incorporating contoured sides exceeding the theoretically ideal stability plane would be possible. It is expected that any such mass-produced corrective shoes for the general population would have contoured side portion thicknesses exceeding the theoretically ideal stability plane by an amount of 5 percent to 10 percent , preferably at least in that part of the contoured side which becomes wearer's body weight load-bearing during the full range of inversion and eversion, which is sideways or lateral foot motion. More specific groups or individuals with more severe disfunction could have an empirically demonstrated need for greater corrective thicknesses of the contoured side portion on the order of 11 to 25 percent more than the theoretically ideal stability plane, again, preferably at least in that part of the contoured side which becomes wearer's body weight load-bearing during the full range of inversion and eversion, which is sideways or lateral foot motion. The optimal contour for the increased contoured side thickness may also be determined empirically.

As described in the '478 Application, in its simplest conceptual form, the applicant's FIG. 4 invention is the structure of a conventional shoe sole that has been modified by having its sides bent up so that their inner surface conforms to a shape of the outer surface of the foot sole of the wearer (instead of the shoe sole sides conforming to the ground by paralleling it, as is conventional); this concept is like that described in FIG. 3 of the applicant's Ser. No. 07/239,667 application. For the applicant's fully contoured design described in FIG. 15 of the '667 application, the entire shoe sole—including both the sides and the portion directly underneath the foot—is bent up to conform to a shape nearly identical but slightly smaller than the contoured shape of the unloaded foot sole of the wearer, rather than the partially flattened load-bearing foot sole shown in FIG. 4.

This theoretical or conceptual bending up must be accomplished in practical manufacturing without any of the puckering distortion or deformation that would necessarily occur if such a conventional shoe sole were actually bent up simultaneously along all of its the sides; consequently, manufacturing techniques that do not require any bending up of shoe sole material, such as injection molding manufacturing of the shoe sole, would be required for optimal results and therefore is preferable.

It is critical to the novelty of this fundamental concept that all layers of the shoe sole in FIG. 4 are bent up around the foot sole. A small number of both street and athletic shoe soles that are commercially available are naturally contoured to a limited extent in that only their bottom soles, which are about one quarter to one third of the total thickness of the entire shoe sole, are wrapped up around portions of the wearers' foot soles; the midsole and heel lift (or heel) of such shoe soles, constituting over half of the thickness of the entire shoe sole, remains flat, conforming to the ground rather than the wearers' feet. (At the other extreme, some shoes in the existing art have flat midsoles and bottom soles, but have insoles that conform to the wearer's foot sole.)

Consequently, in existing contoured shoe soles, the total shoe sole thickness of the contoured side portions, including every layer or portion, is much less than the total thickness of the sole portion directly underneath the foot, whereas in the applicant's '478 shoe sole invention the shoe sole thickness of the contoured side portions are at least similar to the thickness of the sole portion directly underneath the foot, meaning a thickness variation of up to 25 percent, as measured in frontal or transverse plane cross sections.

This major and conspicuous structural difference between the applicant's underlying concept and the existing shoe sole art is paralleled by a similarly dramatic functional difference between the two: the aforementioned similar thickness of the applicant's shoe sole invention maintains intact the firm lateral stability of the wearer's foot, as demonstrated when the foot is unshod and tilted out laterally in inversion to the extreme limit of the normal range of motion of the ankle joint of the foot; in a similar demonstration in a conventional shoe sole, the wearer's foot and ankle are unstable. The sides of the applicant's shoe sole invention extend sufficiently far up the sides of the wearer's foot sole to maintain the lateral stability of the wearer's foot when bare.

In addition, the applicant's shoe sole invention maintains the natural stability and natural, uninterrupted motion of the wearer's foot when bare throughout its normal range of sideways pronation and supination motion occurring during all load-bearing phases of locomotion of the wearer, including when the wearer is standing, walking, jogging and running, even when said foot is tilted to the extreme limit of that normal range, in contrast to unstable and inflexible conventional shoe soles, including the partially contoured existing art described above. The sides of the applicant's shoe sole invention extend sufficiently far up the sides of the wearer's foot sole to maintain the natural stability and uninterrupted motion of the wearer's foot when bare. The exact thickness of the shoe sole sides and their specific contour will be determined empirically for individuals and groups using standard biomechanical techniques of gait analysis to determine those combinations that best provide the barefoot stability described above.

For the FIG. 4 shoe sole invention, the amount of any shoe sole side portions coplanar with the theoretically ideal stability plane is determined by the degree of shoe sole stability desired and the shoe sole weight and bulk required to provide said stability; the amount of said coplanar contoured sides that is provided said shoe sole being sufficient to maintain intact the firm stability of the wearer's foot throughout the range of foot inversion and eversion motion typical of the use for which the shoe is intended and also typical of the kind of wearer—such as normal or excessive pronator—for which said shoe is intended.

In general, the applicant's preferred shoe sole embodiments include the structural and material flexibility to deform in parallel to the natural deformation of the wearer's foot sole as if it were bare and unaffected by any of the abnormal foot biomechanics created by rigid conventional shoe sole.

At the same time, the applicant's preferred shoe sole embodiments are sufficiently firm to provide the wearer's foot with the structural support necessary to maintain normal pronation and supination, as if the wearer's foot were bare; in contrast, the excessive softness of many of the shoe sole materials used in shoe soles in the existing art cause abnormal foot pronation and supination.

As mentioned earlier regarding FIG. 1A, the applicant has previously shown heel lifts with constant frontal or transverse plane thickness, since it is oriented conventionally in alignment with the frontal or transverse plane and perpendicular to the long axis of the shoe sole. However, the heel wedge (or toe taper or other shoe sole thickness variations in the sagittal plane along the long axis of the shoe sole) can be located at an angle to the conventional alignment in the FIG. 4 design.

For example, the heel wedge can be located perpendicular to the subtalar axis, which is located in the heel area generally about 20 to 25 degrees medially, although a different angle can be used base on individual or group testing; such a orientation may provide better, more natural support to the subtalar joint, through which critical pronation and supination motion occur. The applicant's theoretically ideal stability plane concept would teach that such a heel wedge orientation would require constant shoe sole thickness in a vertical plane perpendicular to the chosen subtalar joint axis, instead of the frontal plane.

Figure 5:
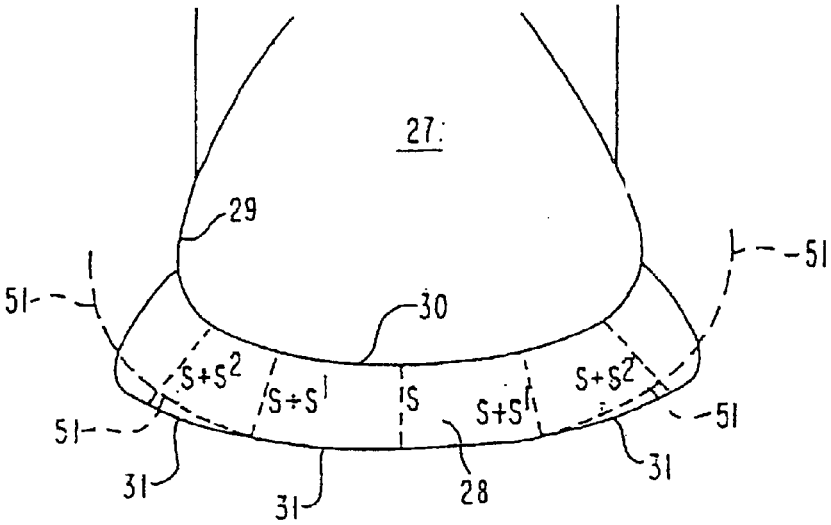

FIG. 5 is FIG. 5 in the applicant's copending U.S. patent application Ser. 07/416,478 and shows, in frontal or transverse plane cross section in the heel area, a variation of the enhanced fully contoured design wherein the shoe sole begins to thicken beyond the theoretically ideal stability plane 51 at the contoured sides portion, preferably at least in that part of the contoured side which becomes wearer's body weight load-bearing during the full range of inversion and eversion, which is sideways or lateral foot motion. FIGS. 4 and 5, illustrate a frontal plane thickness measurement as determined by the length of a line extending from a point on the sole inner surface, in a direction perpendicular to a line tangent to the sole inner surface at said point on the sole inner surface to the sole outer surface, as viewed in a frontal plane cross section when the shoe sole is in an upright, unloaded condition.

Figure 6:
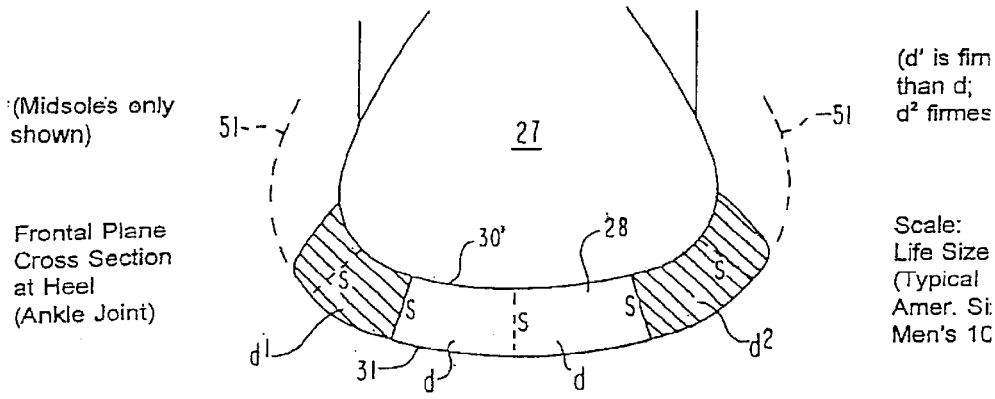

FIG. 6 is FIG. 10 in the applicant's copending '478 Application and shows, in frontal or transverse plane cross section in the heel area, that similar variations in shoe midsole (other portions of the shoe sole area not shown) density can provide similar but reduced effects to the variations in shoe sole thickness described previously in FIGS. 4 and 5. The major advantage of this approach is that the structural theoretically ideal stability plane is retained, so that naturally optimal stability and efficient motion are retained to the maximum extent possible. These constructive density variations are most typically measured in durometers on a Shore A scale, to include from 5 percent to 10 percent and from 11 percent up to 25 percent. The density variations are located preferably at least in that part of the contoured side which becomes wearer's body weight load-bearing during the full range of inversion and eversion, which is sideways or lateral foot motion.

The '478 Application showed midsole only, since that is where material density variation has historically been most common. Density variations can and do, of course, also occur in other layers of the shoe sole, such as the bottom sole and the inner sole, and can occur in any combination and in symmetrical or asymmetrical patterns between layers or between frontal or transverse plane cross sections.

The major and conspicuous structural difference between the applicant's underlying concept and the existing shoe sole art is paralleled by a similarly dramatic functional difference between the two: the aforementioned similar thickness of the applicant's shoe sole invention maintains intact the firm lateral stability of the wearer's foot, as demonstrated when the foot is unshod and tilted out laterally in inversion to the extreme limit of the normal range of motion of the ankle joint of the foot; in a similar demonstration in a conventional shoe sole, the wearer's foot and ankle are unstable. The sides of the applicant's shoe sole invention extend sufficiently far up the sides of the wearer's foot sole to maintain the lateral stability of the wearer's foot when bare.

In addition, the applicant's shoe sole invention maintains the natural stability and natural, uninterrupted motion of the wearer's foot when bare throughout its normal range of sideways pronation and supination motion occurring during all load-bearing phases of locomotion of the wearer, including when the wearer is standing, walking, jogging and running, even when said foot is tilted to the extreme limit of that normal range, in contrast to unstable and inflexible conventional shoe soles, including the partially contoured existing art described above. The sides of the applicant's shoe sole invention extend sufficiently far up the sides of the wearer's foot sole to maintain the natural stability and uninterrupted motion of the wearer's foot when bare. The exact material density of the shoe sole sides will be determined empirically for individuals and groups using standard biomechanical techniques of gait analysis to determine those combinations that best provide the barefoot stability described above.

For the FIG. 6 shoe sole invention, the amount of any shoe sole side portions coplanar with the theoretically ideal stability plane is determined by the degree of shoe sole stability desired and the shoe sole weight and bulk required to provide said stability; the amount of said coplanar contoured sides that is provided said shoe sole being sufficient to maintain intact the firm stability of the wearer's foot throughout the range of foot inversion and eversion motion typical of the use for which the shoe is intended and also typical of the kind of wearer—such as normal or excessive pronator—for which said shoe is intended.

In general, the applicant's preferred shoe sole embodiments include the structural and material flexibility to deform in parallel to the natural deformation of the wearer's foot sole as if it were bare and unaffected by any of the abnormal foot biomechanics created by rigid conventional shoe sole.

At the same time, the applicant's preferred shoe sole embodiments are sufficiently firm to provide the wearer's foot with the structural support necessary to maintain normal pronation and supination, as if the wearer's foot were bare; in contrast, the excessive softness of many of the shoe sole materials used in shoe soles in the existing art cause abnormal foot pronation and supination.

As mentioned earlier regarding FIG. 1A, the applicant has previously shown heel lifts with constant frontal or transverse plane thickness, since it is oriented conventionally in alignment with the frontal or transverse plane and perpendicular to the long axis of the shoe sole. However, the heel wedge (or toe taper or other shoe sole thickness variations in the sagittal plane along the long axis of the shoe sole) can be located at an angle to the conventional alignment in the FIG. 4 design.

For example, the heel wedge can be located perpendicular to the subtalar axis, which is located in the heel area generally about 20 to 25 degrees medially, although a different angle can be used base on individual or group testing; such a orientation may provide better, more natural support to the subtalar joint, through which critical pronation and supination motion occur. The applicant's theoretically ideal stability plane concept would teach that such a heel wedge orientation would require constant shoe sole thickness in a vertical plane perpendicular to the chosen subtalar joint axis, instead of the frontal plane.

Figure 7:
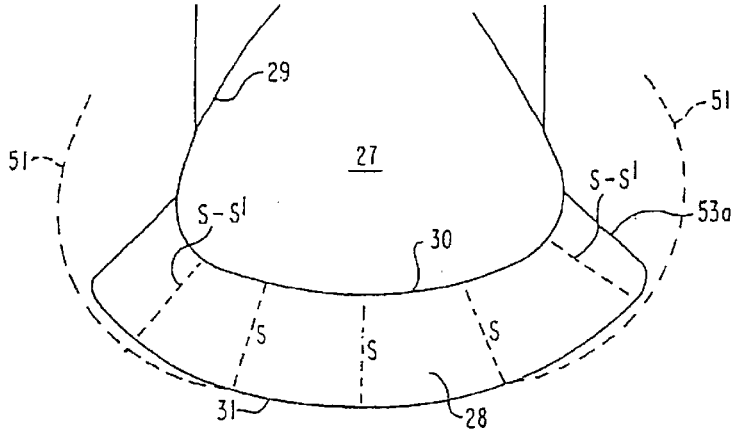
Figure 14A:
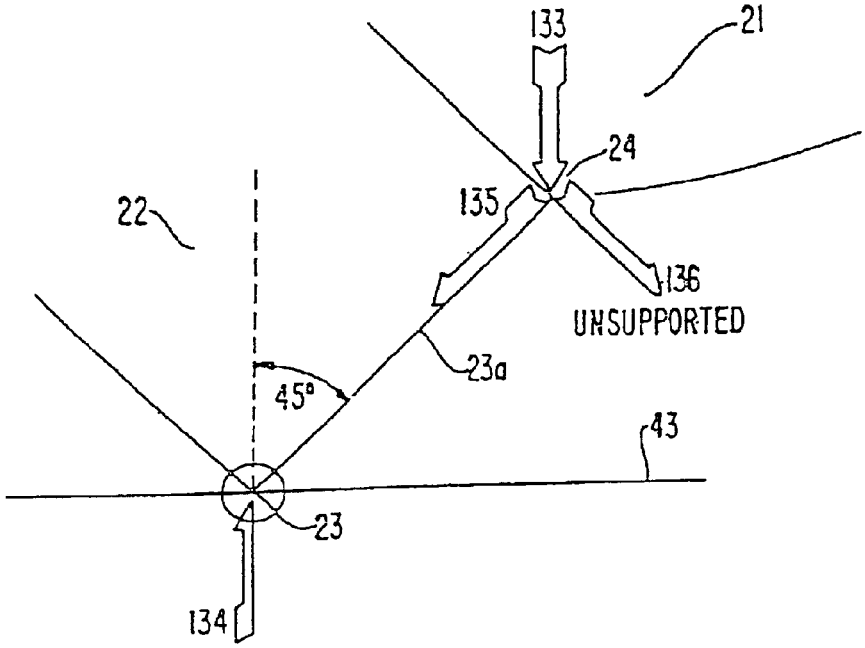
Figure 14B:
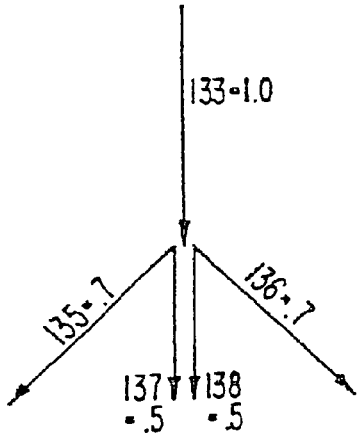

FIG. 7 is FIG. 14B of the applicant's '478 Application and shows, in frontal or transverse plane cross sections in the heel area, embodiments like those in FIG. 4 through 6 but wherein a portion of the shoe sole thickness is decreased to less than the theoretically ideal stability plane, the amount of the thickness variation as defined for FIG. 4 and 5 above, preferably at least in that part of the contoured side which becomes wearer's body weight load-bearing during the full range of inversion and eversion, which is sideways or lateral foot motion. It is anticipated that some individuals with foot and ankle biomechanics that have been degraded by existing shoes may benefit from such embodiments, which would provide less than natural stability but greater freedom and motion, and less shoe sole weight and bulk. FIG. 7 shows a embodiment like the fully contoured design in FIG. 5, but with a show sole thickness decreasing with increasing distance from the center portion of the sole.

Figure 8:
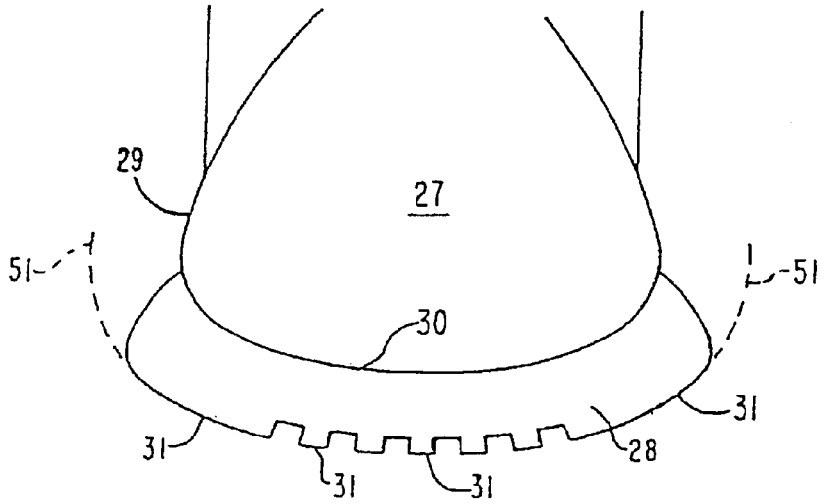
Figure 13:
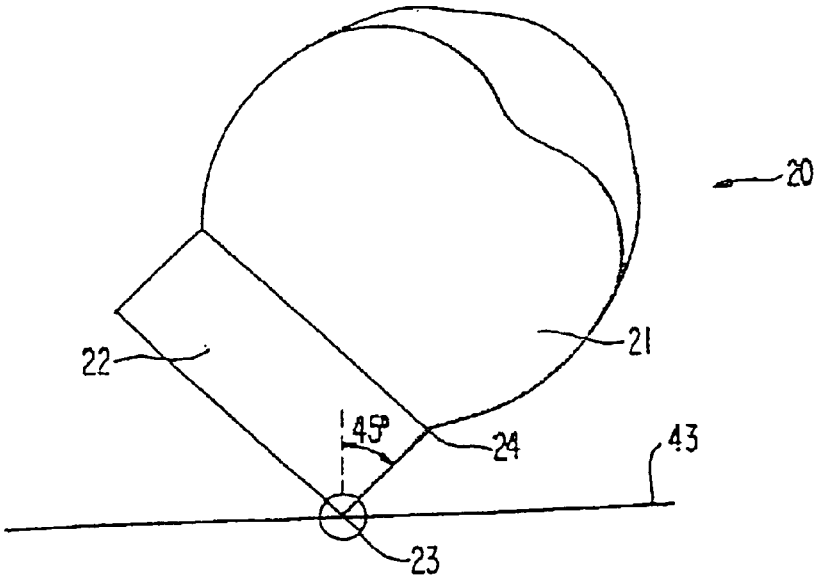

FIG. 8 is FIG. 13 of the '478 Application and shows, in frontal or transverse plane cross section, a bottom sole tread design that provides about the same overall shoe sole density variation as that provided in FIG. 6 by midsole density variation. The less supporting tread there is under any particular portion of the shoe sole, the less effective overall shoe density there is, since the midsole above that portion will deform more easily than if it were fully supported.

FIG. 8 from the '478 is illustrative of the applicant's point that bottom sole tread patterns, just like midsole or bottom sole or inner sole density, directly affect the actual structural support the foot receives from the shoe sole. Not shown, but a typical example in the real world, is the popular "center of pressure" tread pattern, which is like a backward horseshoe attached to the heel that leaves the heel area directly under the calcaneus unsupported by tread, so that all of the weight bearing load in the heel area is transmitted to outside edge treads. Variations of this pattern are extremely common in athletic shoes and are nearly universal in running shoes, of which the 1991 Nike 180 model and the Avia "cantilever" series are examples.

The applicant's '478 shoe sole invention can, therefore, utilize bottom sole tread patterns like any these common examples, together or even in the absence of any other shoe sole thickness or density variation, to achieve an effective thickness greater than the theoretically ideal stability plane, in order to achieve greater stability than the shoe sole would otherwise provide, as discussed earlier under FIGS. 4–6.

Since shoe bottom or outer sole tread patterns can be fairly irregular and/or complex and can thus make difficult the measurement of the outer load-bearing surface of the shoe sole. Consequently, thickness variations in small portions of the shoe sole that will deform or compress without significant overall resistance under a wearer's body weight load to the thickness of the overall load-bearing plane of the shoe out sole should be ignored during measurement, whether such easy deformation is made possible by very high point pressure or by the use of relatively compressible outsole (or underlying midsole) materials.

Portions of the outsole bottom surface composed of materials (or made of a delicate structure, much like the small raised markers on new tire treads to prove the tire is brand new and unused) that wear relatively quickly, so that thickness variations that exist when the shoe sole is new and unused, but disappear quickly in use, should also be ignored when measuring shoe sole thickness in frontal or transverse plane cross sections. Similarly, midsole thickness variations of unused shoe soles due to the use of materials or structures that compact or expand quickly after use should also be ignore when measuring shoe sole thickness in frontal or transverse plane cross sections.

The applicant's shoe sole invention maintains intact the firm lateral stability of the wearer's foot, that stability as demonstrated when the foot is unshod and tilted out laterally in inversion to the extreme limit of the normal range of motion of the ankle joint of the foot. The sides of the applicant's shoe sole invention extend sufficiently far up the sides of the wearer's foot sole to maintain the lateral stability of the wearer's foot when bare.

In addition, the applicant's shoe sole invention maintains the natural stability and natural, uninterrupted motion of the wearer's foot when bare throughout its normal range of sideways pronation and supination motion occurring during all load-bearing phases of locomotion of the wearer, including when the wearer is standing, walking, jogging and running, even when the foot is tilted to the extreme limit of that normal range, in contrast to unstable and inflexible conventional shoe soles, including the partially contoured existing art described above. The sides of the applicant's shoe sole invention extend sufficiently far up the sides of the wearer's foot sole to maintain the natural stability and uninterrupted motion of the wearer,s foot when bare. The exact thickness and material density of the bottom sole tread, as well as the shoe sole sides and their specific contour, will be determined empirically for individuals and groups using standard biomechanical techniques of gait analysis to determine those combinations that best provide the barefoot stability described above.

FIG. 9 is FIG. 9A from the applicant's copending U.S. patent application Ser. No. 07/463,302, filed Jan. 10, 1990. FIG. 9A shows, also in cross sections at the heel, a naturally contoured shoe sole design that parallels as closely as possible the overall natural cushioning and stability system of the barefoot (described in FIG. 8 of the '302 Application), including a cushioning compartment 161 under support structures of the foot containing a pressure-transmitting medium like gas, gel, or liquid, like the subcalcaneal fat pad under the calcaneus and other bones of the foot; consequently, FIGS. 9A–D from '302, shown completely in FIGS. 43A–D in this application, directly correspond to FIGS. 8A–D of '302, shown as FIGS. 42A–D in this application. The optimal pressure-transmitting medium is that which most closely approximates the fat pads of the foot; silicone gel is probably most optimal of materials currently readily available, but future improvements are probable; since it transmits pressure indirectly, in that it compresses in volume under pressure, gas is significantly less optimal. The gas, gel, or liquid, or any other effective material, can be further encapsulated itself, in addition to the sides of the shoe sole, to control leakage and maintain uniformity, as is common conventionally, and can be subdivided into any practical number of encapsulated areas within a compartment, again as is common conventionally. The relative thickness of the cushioning compartment 161 can vary, as can the bottom sole 149 and the upper midsole 147, and can be consistent or differ in various areas of the shoe sole; the optimal relative sizes should be those that approximate most closely those of the average human foot, which suggests both smaller upper and lower soles and a larger cushioning compartment than shown in FIG. 9. And the cushioning compartments or pads 161 can be placed anywhere from directly underneath the foot, like an insole, to directly above the bottom sole. Optimally, the amount of compression created by a given load in any cushioning compartment 161 should be tuned to approximate as closely as possible the compression under the corresponding fat pad of the foot.

The function of the subcalcaneal fat pad is not met satisfactorily with existing proprietary cushioning systems, even those featuring gas, gel or liquid as a pressure transmitting medium. In contrast to those artificial systems, the new design shown is FIG. 9 conforms to the natural contour of the foot and to the natural method of transmitting bottom pressure into side tension in the flexible but relatively non-stretching (the actual optimal elasticity will require empirical studies) sides of the shoe sole.

Existing cushioning systems like Nike Air or Asics Gel do not bottom out under moderate loads and rarely if ever do so even partially under extreme loads; the upper surface of the cushioning device remains suspended above the lower surface. In contrast, the new design in FIG. 9 provides firm support to foot support structures by providing for actual contact between the lower surface 165 of the upper midsole 147 and the upper surface 166 of the bottom sole 149 when fully loaded under moderate body weight pressure, as indicated in FIG. 9B, or under maximum normal peak landing force during running, as indicated in FIG. 9C, just as the human foot does in FIGS. 42B and 42C. The greater the downward force transmitted through the foot to the shoe, the greater the compression pressure in the cushioning compartment 161 and the greater the resulting tension of the shoe sole sides.

FIG. 9D shows the same shoe sole design when fully loaded and tilted to the natural 20 degree lateral limit, like FIG. 41D. FIG. 9D shows that an added stability benefit of the natural cushioning system for shoe soles is that the effective thickness of the shoe sole is reduced by compression on the side so that the potential destabilizing lever arm represented by the shoe sole thickness is also reduced, so foot and ankle stability is increased. Another benefit of the FIG. 9 design is that the upper midsole shoe surface can move in any horizontal direction, either sideways or front to back in order to absorb shearing forces; that shearing motion is controlled by tension in the sides. Note that the right side of FIGS. 9A–D is modified to provide a natural crease or upward taper 162, which allows complete side compression without binding or bunching between the upper and lower shoe sole layers 147, 148, and 149; the shoe sole crease 162 parallels exactly a similar crease or taper 163 in the human foot.

Another possible variation of joining shoe upper to shoe bottom sole is on the right (lateral) side of FIGS. 9A–D, which makes use of the fact that it is optimal for the tension absorbing shoe sole sides, whether shoe upper or bottom sole, to coincide with the Theoretically Ideal Stability Plane along the side of the shoe sole beyond that point reached when the shoe is tilted to the foot's natural limit, so that no destabilizing shoe sole lever arm is created when the shoe is tilted fully, as in FIG. 9D. The joint may be moved up slightly so that the fabric side does not come in contact with the ground, or it may be cover with a coating to provide both traction and fabric protection.

It should be noted that the FIG. 9 design provides a structural basis for the shoe sole to conform very easily to the natural shape of the human foot and to parallel easily the natural deformation flattening of the foot during load-bearing motion on the ground. This is true even if the shoe sole is made conventionally with a flat sole, as long as rigid structures such as heel counters and motion control devices are not used; though not optimal, such a conventional flat shoe made like FIG. 9 would provide the essential features of the new invention resulting in significantly improved cushioning and stability. The FIG. 9 design could also be applied to intermediate-shaped shoe soles that neither conform to the flat ground or the naturally contoured foot. In addition, the FIG. 9 design can be applied to the applicant's other designs, such as those described in his pending U.S. application Ser. No. 07/416,478, filed on Oct. 3, 1989.

In summary, the FIG. 9 design shows a shoe construction for a shoe, including: a shoe sole with a compartment or compartments under the structural elements of the human foot, including at least the heel; the compartment or compartments contains a pressure-transmitting medium like liquid, gas, or gel; a portion of the upper surface of the shoe sole compartment firmly contacts the lower surface of said compartment during normal load-bearing; and pressure from the load-bearing is transmitted progressively at least in part to the relatively inelastic sides, top and bottom of the shoe sole compartment or compartments, producing tension.

The applicant's FIG. 9 invention can be combined with the FIG. 3 invention, although the combination is not shown; the FIG. 9 invention can be combined with FIGS. 10 and 11 below. Also not shown, but useful combinations, is the applicant's FIGS. 3, 10 and 11 inventions with all of the applicant's deformation sipes inventions, the first of a sequence of applications on various embodiments of that sipes invention is U.S. Ser. No. 07/424,509, filed Oct. 20, 1989, and with his inventions based on other sagittal plane or long axis shoe sole thickness variations described in U.S. application Ser. No. 07/469,313, filed Jan. 24, 1990.

All of the applicant's shoe sole invention mentioned immediately above maintain intact the firm lateral stability of the wearer's foot, that stability as demonstrated when the wearer's foot is unshod and tilted out laterally in inversion to the extreme limit of the normal range of motion of the ankle joint of the foot; in a similar demonstration in a conventional shoe sole, the wearer's foot and ankle are unstable. The sides of the applicant's shoe sole invention extend sufficiently far up the sides of the wearer's foot sole to maintain the lateral stability of the wearer's foot when bare.

In addition, the applicant's invention maintains the natural stability and natural, uninterrupted motion of the foot when bare throughout its normal range of sideways pronation and supination motion occurring during all load-bearing phases of locomotion of the wearer, including when said wearer is standing, walking, jogging and running, even when the foot is tilted to the extreme limit of that normal range, in contrast to unstable and inflexible conventional shoe soles, including the partially contoured existing art described above. The sides of the applicant's shoe sole invention extend sufficiently far up the sides of the wearer's foot sole to maintain the natural stability and uninterrupted motion of the wearer's foot when bare. The exact material density of the shoe sole sides will be determined empirically for individuals and groups using standard biomechanical techniques of gait analysis to determine those combinations that best provide the barefoot stability described above.

For the shoe sole combination inventions list immediately above, the amount of any shoe sole side portions coplanar with the theoretically ideal stability plane is determined by the degree of shoe sole stability desired and the shoe sole weight and bulk required to provide said stability; the amount of said coplanar contoured sides that is provided said shoe sole being sufficient to maintain intact the firm stability of the wearer's foot throughout the range of foot inversion and eversion motion typical of the use for which the shoe is intended and also typical of the kind of wearer—such as normal or as excessive pronator—for which said shoe is intended.

Finally, the shoe sole sides are sufficiently flexible to bend out easily when the shoes are put on the wearer's feet and therefore the shoe soles gently hold the sides of the wearer's foot sole when on, providing the equivalent of custom fit in a mass-produced shoe sole. In general, the applicant's preferred shoe sole embodiments include the structural and material flexibility to deform in parallel to the natural deformation of the wearer's foot sole as if it were bare and unaffected by any of the abnormal foot biomechanics created by rigid conventional shoe sole.

At the same time, the applicant's preferred shoe sole embodiments are sufficiently firm to provide the wearer's foot with the structural support necessary to maintain normal pronation and supination, as if the wearer's foot were bare; in contrast, the excessive softness of many of the shoe sole materials used in shoe soles in the existing art cause abnormal foot pronation and supination.

FIG. 10 was new with this '598 application and is a combination of the shoe sole structure concepts of FIG. 3 and FIG. 4; it combines the custom fit design with the contoured sides greater than the theoretically ideal stability plane. It would apply as well to the FIG. 7 design with contoured sides less than the theoretically ideal stability plane, but that combination is not shown. It would also apply to the FIG. 8 design, which shows a bottom sole tread design, but that combination is also not shown.

While the FIG. 3 custom fit invention is novel for shoe sole structures as defined by the theoretically ideal stability plane, which specifies constant shoe sole thickness in frontal or transverse plane, the FIG. 3 custom fit invention is also novel for shoe sole structures with sides that exceed the theoretically ideal stability plane: that is, a shoe sole with thickness greater in the sides than underneath the foot. It would also be novel for shoe sole structures with sides that are less than the theoretically ideal stability plane, within the parameters defined in the '714 application. And it would be novel for a shoe sole structure that provides stability like the barefoot, as described in FIGS. 1 and 2 of the '714 application.

In its simplest conceptual form, the applicant's invention is the structure of a conventional shoe sole that has been modified by having its sides bent up so that their inner surface conforms to a shape nearly identical but slightly smaller than the shape of the outer surface of the foot sole of the wearer (instead of the shoe sole sides conforming to the ground by paralleling it, as is conventional); this concept is like that described in FIG. 3 of the applicant's Ser. No. 07/239,667 application. For the applicant's fully contoured design described in FIG. 15 of the '667 Application, the entire shoe sole—including both the sides and the portion directly underneath the foot—is bent up to conform to a shape nearly identical but slightly smaller than the contoured shape of the unloaded foot sole of the wearer, rather than the partially flattened load-bearing foot sole shown in FIG. 3.

This theoretical or conceptual bending up must be accomplished in practical manufacturing without any of the puckering distortion or deformation that would necessarily occur if such a conventional shoe sole were actually bent up simultaneously along all of its the sides; consequently, manufacturing techniques that do not require any bending up of shoe sole material, such as injection molding manufacturing of the shoe sole, would be required for optimal results and therefore is preferable.

It is critical to the novelty of this fundamental concept that all layers of the shoe sole are bent up around the foot sole. A small number of both street and athletic shoe soles that are commercially available are naturally contoured to a limited extent in that only their bottom soles, which are about one quarter to one third of the total thickness of the entire shoe sole, are wrapped up around portions of the wearers' foot soles; the midsole and heel lift (or heel) of such shoe soles, constituting over half of the thickness of the entire shoe sole, remains flat, conforming to the ground rather than the wearers' feet. (At the other extreme, some shoes in the existing art have flat midsoles and bottom soles, but have insoles that conform to the wearer's foot sole.).

Consequently, in existing contoured shoe soles, the total shoe sole thickness of the contoured side portions, including every layer or portion, is much less than the total thickness of the sole portion directly underneath the foot, whereas in the applicant's prior shoe sole inventions the shoe sole thickness of the contoured side portions are at least similar to the thickness of the sole portion directly underneath the foot, meaning a thickness variation of up to 25 percent, as measured in frontal or transverse plane cross sections.

This major and conspicuous structural difference between the applicant's underlying concept and the existing shoe sole art is paralleled by a similarly dramatic functional difference between the two: the aforementioned similar thickness of the applicant's shoe sole invention maintains intact the firm lateral stability of the wearer's foot, that stability as demonstrated when the wearer's foot is unshod and tilted out laterally in inversion to the extreme limit of the normal range of motion of the ankle joint of the foot; in a similar demonstration in a conventional shoe sole, the wearer's foot and ankle are unstable. The sides of the applicant's shoe sole invention extend sufficiently far up the sides of the wearer's foot sole to maintain the lateral stability of the wearer's foot when bare.

In addition, the applicant's invention maintains the natural stability and natural, uninterrupted motion of the foot when bare throughout its normal range of sideways pronation and supination motion occurring during all load-bearing phases of locomotion of the wearer, including when said wearer is standing, walking, jogging and running, even when the foot is tilted to the extreme limit of that normal range, in contrast to unstable and inflexible conventional shoe soles, including the partially contoured existing art described above. The sides of the applicant's shoe sole invention extend sufficiently far up the sides of the wearer's foot sole to maintain the natural stability and uninterrupted motion of the wearer's foot when bare. The exact thickness and material density of the shoe sole sides and their specific contour will be determined empirically for individuals and groups using standard biomechanical techniques of gait analysis to determine those combinations that best provide the barefoot stability described above.

For the FIG. 10 shoe sole invention, the amount of any shoe sole side portions coplanar with the theoretically ideal stability plane is determined by the degree of shoe sole stability desired and the shoe sole weight and bulk required to provide said stability; the amount of said coplanar contoured sides that is provided said shoe sole being sufficient to maintain intact the firm stability of the wearer's foot throughout the range of foot inversion and eversion motion typical of the use for which the shoe is intended and also typical of the kind of wearer—such as normal or as excessive pronator—for which said shoe is intended.

Finally, the shoe sole sides are sufficiently flexible to bend out easily when the shoes are put on the wearer's feet and therefore the shoe soles gently hold the sides of the wearer's foot sole when on, providing the equivalent of custom fit in a mass-produced shoe sole. In general, the applicant's preferred shoe sole embodiments include the structural and material flexibility to deform in parallel to the natural deformation of the wearer's foot sole as if it were bare and unaffected by any of the abnormal foot biomechanics created by rigid conventional shoe sole.

At the same time, the applicant's preferred shoe sole embodiments are sufficiently firm to provide the wearer's foot with the structural support necessary to maintain normal pronation and supination, as if the wearer's foot were bare; in contrast, the excessive softness of many of the shoe sole materials used in shoe soles in the existing art cause abnormal foot pronation and supination.

As mentioned earlier regarding FIG. 1A and FIG. 3, the applicant has previously shown heel lift with constant frontal or transverse plane thickness, since it is oriented conventionally in alignment with the frontal or transverse plane and perpendicular to the long axis of the shoe sole. However, the heel wedge (or toe taper or other shoe sole thickness variations in the sagittal plane along the long axis of the shoe sole) can be located at an angle to the conventional alignment in the FIG. 10 design.

For example, the heel wedge can be located perpendicular to the subtalar axis, which is located in the heel area generally about 20 to 25 degrees medially, although a different angle can be used base on individual or group testing; such a orientation may provide better, more natural support to the subtalar joint, through which critical pronation and supination motion occur. The applicant's theoretically ideal stability plane concept would teach that such a heel wedge orientation would require constant shoe sole thickness in a vertical plane perpendicular to the chosen subtalar joint axis, instead of the frontal plane.

Besides providing a better fit, the intentional undersizing of the flexible shoe sole sides allows for simplified design of shoe sole lasts, since the shoe last needs only to be approximate to provide a virtual custom fit, due to the flexible sides. As a result, the undersized flexible shoe sole sides allow the applicant's FIG. 10 shoe sole invention based on the theoretically ideal stability plane to be manufactured in relatively standard sizes in the same manner as are shoe uppers, since the flexible shoe sole sides can be built on standard shoe lasts, even though conceptually those sides conform to the specific shape of the individual wearer's foot sole, because the flexible sides bend to so conform when on the wearer's foot sole.

FIG. 10 shows the shoe sole structure when not on the foot of the wearer; the dashed line 29 indicates the position of the shoe last, which is assumed to be a reasonably accurate approximation of the shape of the outer surface of the wearer's foot sole, which determines the shape of the theoretically ideal stability plane 51. Thus, the dashed lines 29 and 51 show what the positions of the inner surface 30 and outer surface 31 of the shoe sole would be when the shoe is put on the foot of the wearer.

The FIG. 10 invention provides a way make the inner surface 30 of the contoured shoe sole, especially its sides, conform very closely to the outer surface 29 of the foot sole of a wearer. It thus makes much more practical the applicant's earlier underlying naturally contoured designs shown in FIGS. 4 and 5. The shoe sole structures shown in FIG. 4 and 5, then, are what the FIG. 10 shoe sole structure would be when on the wearer's load-bearing foot, where the inner surface 30 of the shoe upper is bent out to virtually coincide with the outer surface of the foot sole of the wearer 29 (the figures in this and prior applications show one line to emphasize the conceptual coincidence of what in fact are two lines; in real world embodiments, some divergence of the surface, especially under load and during locomotion would be unavoidable).

The sides of the shoe sole structure described under FIG. 10 can also be used to form a slightly less optimal structure:

a conventional shoe sole that has been modified by having its sides bent up so that their inner surface conforms to shape nearly identical but slightly larger than the shape of the outer surface of the foot sole of the wearer, instead of the shoe sole sides being flat on the ground, as is conventional. Clearly, the closer the sides are to the shape of the wearer's foot sole, the better as a general rule, but any side position between flat on the ground and conforming like FIG. 10 to a shape slightly smaller than the wearer's shape is both possible and more effective than conventional flat shoe sole sides. And in some cases, such as for diabetic patients, it may be optimal to have relatively loose shoe sole sides providing no conforming pressure of the shoe sole on the tender foot sole; in such cases, the shape of the flexible shoe uppers, which can even be made with very elastic materials such as lycra and spandex, can provide the capability for the shoe, including the shoe sole, to conform to the shape of the foot.

As discussed earlier by the applicant, the critical functional feature of a shoe sole is that it deforms under a weight-bearing load to conform to the foot sole just as the foot sole deforms to conform to the ground under a weight-bearing load. So, even though the foot sole and the shoe sole may start in different locations—the shoe sole sides can even be conventionally flat on the ground—the critical functional feature of both is that they both conform under load to parallel the shape of the ground, which conventional shoes do not, except when exactly upright. Consequently, the applicant's shoe sole invention, stated most broadly, includes any shoe sole—whether conforming to the wearer's foot sole or to the ground or some intermediate position, including a shape much smaller than the wearer's foot sole—that deforms to conform to a shape at least similar to the theoretically ideal stability plane, which by definition itself deforms in parallel with the deformation of the wearer's foot sole under weight-bearing load.

Of course, it is optimal in terms of preserving natural foot biomechanics, which is the primary goal of the applicant, for the shoe sole to conform to the foot sole when on the foot, not just when under a weight-bearing load. And, in any case, all of the essential structural support and propulsion elements previously identified by the applicant earlier in discussing FIG. 3 must be supported by the foot sole.

To the extent the shoe sole sides are easily flexible, as has already been specified as desirable, the position of the shoe sole sides before the wearer puts on the shoe is less important, since the sides will easily conform to the shape of the wearer's foot when the shoe is put on that foot. In view of that, even shoe sole sides that conform to a shape more than slightly smaller than the shape of the outer surface of the wearer's foot sole would function in accordance with the applicant's general invention, since the flexible sides could bend out easily a considerable relative distance and still conform to the wearer's foot sole when on the wearer's foot.

FIG. 11 is new with this application and is a combination of the shoe sole structure concepts of FIG. 3 and FIG. 6; it combines the custom fit design with the contoured sides having material density variations that produce an effect similar to variations in shoe sole thickness shown in FIGS. 4, 5, and 7; only the midsole is shown. The density variation pattern shown in FIG. 2 can be combined with the type shown in FIG. 11. The density pattern can be constant in all cross sections taken along the long the long axis of the shoe sole or the pattern can vary.

The applicant's FIG. 11 shoe sole invention maintains intact the firm lateral stability of the wearer's foot, that stability as demonstrated when the wearer's foot is unshod and tilted out laterally in inversion to the extreme limit of the normal range of motion of the ankle joint of the foot; in a similar demonstration in a conventional shoe sole, the wearer's foot and ankle are unstable. The sides of the applicant's shoe sole invention extend sufficiently far up the sides of the wearer's foot sole to maintain the lateral stability of the wearer's foot when bare.

In addition, the applicant's invention maintains the natural stability and natural, uninterrupted motion of the foot when bare throughout its normal range of sideways pronation and supination motion occurring during all load-bearing phases of locomotion of the wearer, including when said wearer is standing, walking, jogging and running, even when the foot is tilted to the extreme limit of that normal range, in contrast to unstable and inflexible conventional shoe soles, including the partially contoured existing art described above. The sides of the applicant's shoe sole invention extend sufficiently far up the sides of the wearer's foot sole to maintain the natural stability and uninterrupted motion of the wearer's foot when bare. The exact material density of the shoe sole sides will be determined empirically for individuals and groups using standard biomechanical techniques of gait analysis to determine those combinations that best provide the barefoot stability described above.

For the FIG. 11 shoe sole invention, the amount of any shoe sole side portions coplanar with the theoretically ideal stability plane is determined by the degree of shoe sole stability desired and the shoe sole weight and bulk required to provide said stability; the amount of said coplanar contoured sides that is provided said shoe sole being sufficient to maintain intact the firm stability of the wearer's foot throughout the range of foot inversion and eversion motion typical of the use for which the shoe is intended and also typical of the kind of wearer—such as normal or as excessive pronator—for which said shoe is intended.

Finally, the shoe sole sides are sufficiently flexible to bend out easily when the shoes are put on the wearer's feet and therefore the shoe soles gently hold the sides of the wearer's foot sole when on, providing the equivalent of custom fit in a mass-produced shoe sole. In general, the applicant's preferred shoe sole embodiments include the structural and material flexibility to deform in parallel to the natural deformation of the wearer's foot sole as if it were bare and unaffected by any of the abnormal foot biomechanics created by rigid conventional shoe sole.

At the same time, the applicant's preferred shoe sole embodiments are sufficiently firm to provide the wearer's foot with the structural support necessary to maintain normal pronation and supination, as if the wearer's foot were bare; in contrast, the excessive softness of many of the shoe sole materials used in shoe soles in the existing art cause abnormal foot pronation and supination.

As mentioned earlier regarding FIG. 1A and FIG. 3, the applicant has previously shown heel lift with constant frontal or transverse plane thickness, since it is oriented conventionally in alignment with the frontal or transverse plane and perpendicular to the long axis of the shoe sole. However, the heel wedge (or toe taper or other shoe sole thickness variations in the sagittal plane along the long axis of the shoe sole) can be located at an angle to the conventional alignment in the FIG. 1A design.

For example, the heel wedge can be located perpendicular to the subtalar axis, which is located in the heel area generally about 20 to 25 degrees medially, although a different angle can be used base on individual or group testing; such a orientation may provide better, more natural support to the subtalar joint, through which critical pronation and supination motion occur. The applicant's theoretically ideal stability plane concept would teach that such a heel wedge orientation would require constant shoe sole thickness in a vertical plane perpendicular to the chosen subtalar joint axis, instead of the frontal plane.

Besides providing a better fit, the intentional undersizing of the flexible shoe sole sides allows for simplified design of shoe sole lasts, since the shoe last needs only to be approximate to provide a virtual custom fit, due to the flexible sides. As a result, the undersized flexible shoe sole sides allow the applicant's FIG. 10 shoe sole invention based on the theoretically ideal stability plane to be manufactured in relatively standard sizes in the same manner as are shoe uppers, since the flexible shoe sole sides can be built on standard shoe lasts, even though conceptually those sides conform to the specific shape of the individual wearer's foot sole, because the flexible sides bend to so conform when on the wearer's foot sole.

Besides providing a better fit, the intentional undersizing of the flexible shoe sole sides allows for simplified design of shoe sole lasts, since they can be designed according to the simple geometric methodology described in the textual specification of FIG. 27, U.S. application Ser. No. 07/239, 667 (filed 02 Sep. 1988). That geometric approximation of the true actual contour of the human is close enough to provide a virtual custom fit, when compensated for by the flexible undersizing from standard shoe lasts described above.

A flexible undersized version of the fully contoured design described in FIG. 11 can also be provided by a similar geometric approximation. As a result, the undersized flexible shoe sole sides allow the applicant's shoe sole inventions based on the theoretically ideal stability plane to be manufactured in relatively standard sizes in the same manner as are shoe uppers, since the flexible shoe sole sides can be built on standard shoe lasts, even though conceptually those sides conform closely to the specific shape of the individual wearer's foot sole, because the flexible sides bend to conform when on the wearer's foot sole.

FIG. 11 shows the shoe sole structure when not on the foot of the wearer; the dashed line 29 indicates the position of the shoe last, which is assumed to be a reasonably accurate approximation of the shape of the outer surface of the wearer's foot sole, which determines the shape of the theoretically ideal stability plane 51. Thus, the dashed lines 29 and 51 show what the positions of the inner surface 30 and outer surface 31 of the shoe sole would be when the shoe is put on the foot of the wearer.

The FIG. 11 invention provides a way make the inner surface 30 of the contoured shoe sole, especially its sides, conform very closely to the outer surface 29 of the foot sole of a wearer. It thus makes much more practical the applicant's earlier underlying naturally contoured designs shown in FIG. 1A–C and FIG. 6. The shoe sole structure shown in FIG. 61, then, is what the FIG. 11 shoe sole structure would be when on the wearer's foot, where the inner surface 30 of the shoe upper is bent out to virtually coincide with the outer surface of the foot sole of the wearer 29 (the figures in this and prior applications show one line to emphasize the conceptual coincidence of what in fact are two lines; in real world embodiments, some divergence of the surface, especially under load and during locomotion would be unavoidable).

The sides of the shoe sole structure described under FIG. 11 can also be used to form a slightly less optimal structure: a conventional shoe sole that has been modified by having its sides bent up so that their inner surface conforms to shape nearly identical but slightly larger than the shape of the outer surface of the foot sole of the wearer, instead of the shoe sole sides being flat on the ground, as is conventional. Clearly, the closer the sides are to the shape of the wearer's foot sole, the better as a general rule, but any side position between flat on the ground and conforming like FIG. 11 to a shape slightly smaller than the wearer's shape is both possible and more effective than conventional flat shoe sole sides. And in some cases, such as for diabetic patients, it may be optimal to have relatively loose shoe sole sides providing no conforming pressure of the shoe sole on the tender foot sole; in such cases, the shape of the flexible shoe uppers, which can even be made with very elastic materials such as lycra and spandex, can provide the capability for the shoe, including the shoe sole, to conform to the shape of the foot.

As discussed earlier by the applicant, the critical functional feature of a shoe sole is that it deforms under a weight-bearing load to conform to the foot sole just as the foot sole deforms to conform to the ground under a weight-bearing load. So, even though the foot sole and the shoe sole may start in different locations—the shoe sole sides can even be conventionally flat on the ground—the critical functional feature of both is that they both conform under load to parallel the shape of the ground, which conventional shoes do not, except when exactly upright. Consequently, the applicant's shoe sole invention, stated most broadly, includes any shoe sole—whether conforming to the wearer's foot sole or to the ground or some intermediate position, including a shape much smaller than the wearer's foot sole—that deforms to conform to the theoretically ideal stability plane, which by definition itself deforms in parallel with the deformation of the wearer's foot sole under weight-bearing load.

Of course, it is optimal in terms of preserving natural foot biomechanics, which is the primary goal of the applicant, for the shoe sole to conform to the foot sole when on the foot, not just when under a weight-bearing load. And, in any case, all of the essential structural support and propulsion elements previously identified by the applicant earlier in discussing FIG. 3 must be supported by the foot sole.

To the extent the shoe sole sides are easily flexible, as has already been specified as desirable, the position of the shoe sole sides before the wearer puts on the shoe is less important, since the sides will easily conform to the shape of the wearer's foot when the shoe is put on that foot. In view of that, even shoe sole sides that conform to a shape more than slightly smaller than the shape of the outer surface of the wearer's foot sole would function in accordance with the applicant's general invention, since the flexible sides could bend out easily a considerable relative distance and still conform to the wearer's foot sole when on the wearer's foot.

The applicant's shoe sole inventions described in FIGS. 4, 10 and 11 all attempt to provide structural compensation for actual structural changes in the feet of wearers that have occurred from a lifetime of use of existing shoes, which have a major flaw that has been identified and described earlier by the applicant. As a result, the biomechanical motion of even the wearer's bare feet have been degraded from what they would be if the wearer's feet had not been structurally changed. Consequently, the ultimate design goal of the applicant's inventions is to provide un-degraded barefoot motion. That means to provide wearers with shoe soles that compensate for their flawed barefoot structure to an extent sufficient to provide foot and ankle motion equivalent to that of their bare feet if never shod and therefore not flawed.

Determining the biomechanical characteristics of such un-flawed bare feet will be difficult, either on an individual or group basis. The difficulty for many groups of wearers will be in finding un-flawed, never-shod barefoot from similar genetic groups, assuming significant genetic differences exist, as seems at least possible if not probable.

The ultimate goal of the applicant's invention is to provide shoe sole structures that maintain the natural stability and natural, uninterrupted motion of the foot when bare throughout its normal range of sideways pronation and supination motion occurring during all load-bearing phases of locomotion of a wearer who has never been shod in conventional shoes, including when said wearer is standing, walking, jogging and running, even when the foot is tilted to the extreme limit of that normal range, in contrast to unstable and inflexible conventional shoe soles.

FIGS. 12–23 are FIGS. 1–7 and 11–15, respectively, from the '714 application.

Figure 12:
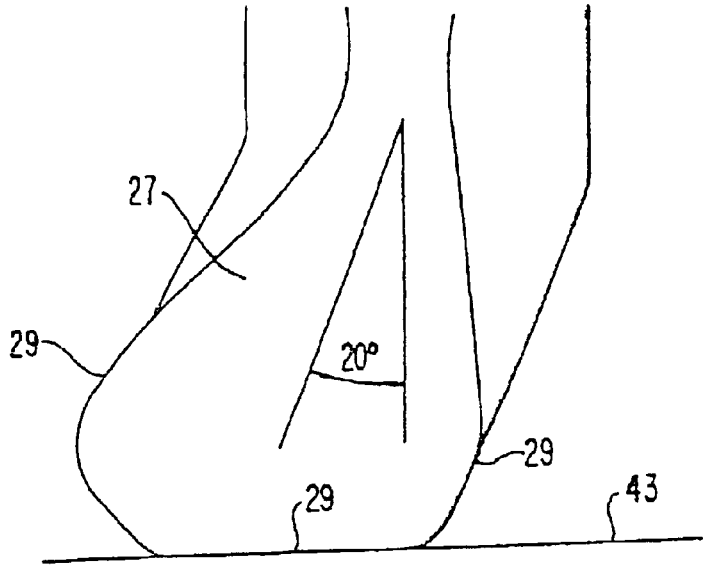

FIG. 12 shows in a real illustration a foot 27 in position for a new biomechanical test that is the basis for the discovery that ankle sprains are in fact unnatural for the bare foot. The test simulates a lateral ankle sprain, where the foot 27—on the ground 43—rolls or tilts to the outside, to the extreme end of its normal range of motion, which is usually about 20 degrees at the heel 29, as shown in a rear view of a bare (right) heel in FIG. 12. Lateral (inversion) sprains are the most common ankle sprains, accounting for about three-fourths of all.

The especially novel aspect of the testing approach is to perform the ankle spraining simulation while standing stationary. The absence of forward motion is the key to the dramatic success of the test because otherwise it is impossible to recreate for testing purposes the actual foot and ankle motion that occurs during a lateral ankle sprain, and simultaneously to do it in a controlled manner, while at normal running speed or even jogging slowly, or walking. Without the critical control achieved by slowing forward motion all the way down to zero, any test subject would end up with a sprained ankle.

That is because actual running in the real world is dynamic and involves a repetitive force maximum of three times one's full body weight for each footstep, with sudden peaks up to roughly five or six times for quick stops, missteps, and direction changes, as might be experienced when spraining an ankle. In contrast, in the static simulation test, the forces are tightly controlled and moderate, ranging from no force at all up to whatever maximum amount that is comfortable.

The Stationary Sprain Simulation Test (SSST) consists simply of standing stationary with one foot bare and the other shod with any shoe. Each foot alternately is carefully tilted to the outside up to the extreme end of its range of motion, simulating a lateral ankle sprain.

The Stationary Sprain Simulation Test clearly identifies what can be no less than a fundamental flaw in existing shoe design. It demonstrates conclusively that nature's biomechanical system, the bare foot, is far superior in stability to man's artificial shoe design. Unfortunately, it also demonstrates that the shoe's severe instability overpowers the natural stability of the human foot and synthetically creates a combined biomechanical system that is artificially unstable. The shoe is the weak link.

The test shows that the bare foot is inherently stable at the approximate 20 degree end of normal joint range because of the wide, steady foundation the bare heel 29 provides the ankle joint, as seen in FIG. 12. In fact, the area of physical contact of the bare heel 29 with the ground 43 is not much less when tilted all the way out to 20 degrees as when upright at 0 degrees.

The new Stationary Sprain Simulation Test provides a natural yardstick, totally missing until now, to determine whether any given shoe allows the foot within it to function naturally. If a shoe cannot pass this simple litmus test, it is positive proof that a particular shoe is interfering with natural foot and ankle biomechanics. The only question is the exact extent of the interference beyond that demonstrated by the new test.

Conversely, the applicant's designs are the only designs with shoe soles thick enough to provide cushioning (thin-soled and heel-less moccasins do pass the test, but do not provide cushioning and only moderate protection) that will provide naturally stable performance, like the bare foot, in the Stationary Sprain Simulation Test.

FIG. 13 shows that, in complete contrast the foot equipped with a conventional running shoe, designated generally by the reference numeral 20 and having an upper 21, though initially very stable while resting completely flat on the ground, becomes immediately unstable when the shoe sole 22 is tilted to the outside. The tilting motion lifts from contact with the ground all of the shoe sole 22 except the artificially sharp edge of the bottom outside corner. The shoe sole instability increases the farther the foot is rolled laterally. Eventually, the instability induced by the shoe itself is so great that the normal load-bearing pressure of full body weight would actively force an ankle sprain if not controlled. The abnormal tilting motion of the shoe does not stop at the barefoot's natural 20 degree limit, as you can see from the 45 degree tilt of the shoe heel in FIG. 13.

That continued outward rotation of the shoe past 20 degrees causes the foot to slip within the shoe, shifting its position within the shoe to the outside edge, further increasing the shoe's structural instability. The slipping of the foot within the shoe is caused by the natural tendency of the foot to slide down the typically flat surface of the tilted shoe sole; the more the tilt, the stronger the tendency. The heel is shown in FIG. 13 because of its primary importance in sprains due to its direct physical connection to the ankle ligaments that are torn in an ankle sprain and also because of the heel's predominant role within the foot in bearing body weight.

It is easy to see in the two figures how totally different the physical shape of the natural bare foot is compared to the shape of the artificial shoe sole. It is strikingly odd that the two objects, which apparently both have the same biomechanical function, have completely different physical shapes. Moreover, the shoe sole clearly does not deform the same way the human foot sole does, primarily as a consequence of its dissimilar shape.

FIG. 14A illustrates that the underlying problem with existing shoe designs is fairly easy to understand by looking closely at the principal forces acting on the physical structure of the shoe sole. When the shoe is tilted outwardly, the weight of the body held in the shoe upper 21 shifts automatically to the outside edge of the shoe sole 22. But, strictly due to its unnatural shape, the tilted shoe sole 22 provides absolutely no supporting physical structure directly underneath the shifted body weight where it is critically needed to support that weight. An essential part of the supporting foundation is missing. The only actual structural support comes from the sharp corner edge 23 of the shoe sole 22, which unfortunately is not directly under the force of the body weight after the shoe is tilted. Instead, the corner edge 23 is offset well to the inside.

As a result of that unnatural misalignment, a lever arm 23*a* is set up through the shoe sole 22 between two interacting forces (called a force couple): the force of gravity on the body (usually known as body weight 133) applied at the point 24 in the upper 21 and the reaction force 134 of the ground, equal to and opposite to body weight when the shoe is upright. The force couple creates a force moment, commonly called torque, that forces the shoe 20 to rotate to the outside around the sharp corner edge 23 of the bottom sole 22, which serves as a stationary pivoting point 23 or center of rotation.

Unbalanced by the unnatural geometry of the shoe sole when tilted, the opposing two forces produce torque, causing the shoe 20 to tilt even more. As the shoe 20 tilts further, the torque forcing the rotation becomes even more powerful, so the tilting process becomes a self-reenforcing cycle. The more the shoe tilts, the more destabilizing torque is produced to further increase the tilt.

The problem may be easier to understand by looking at the diagram of the force components of body weight shown in FIG. 14A.

When the shoe sole 22 is tilted out 45 degrees, as shown, only half of the downward force of body weight 133 is physically supported by the shoe sole 22; the supported force component 135 is 71% of full body weight 133. The other half of the body weight at the 45 degree tilt is unsupported physically by any shoe sole structure; the unsupported component is also 71% of full body weight 133. It therefore produces strong destabilizing outward tilting rotation, which is resisted by nothing structural except the lateral ligaments of the ankle.

FIG. 14B show that the full force of body weight 133 is split at 45 degrees of tilt into two equal components: supported 135 and unsupported 136, each equal to 0.707 of full body weight 133. The two vertical components 137 and 138 of body weight 133 are both equal to 0.50 of full body weight. The ground reaction force 134 is equal to the vertical component 137 of the supported component 135.

FIG. 15 show a summary of the force components at shoe sole tilts of 0, 45 and 90 degrees. FIG. 15, which uses the same reference numerals as in FIG. 14, shows that, as the outward rotation continues to 90 degrees, and the foot slips within the shoe while ligaments stretch and/or break, the destabilizing unsupported force component 136 continues to grow. When the shoe sole has tilted all the way out to 90 degrees (which unfortunately does happen in the real world), the sole 22 is providing no structural support and there is no supported force component 135 of the full body weight 133. The ground reaction force at the pivoting point 23 is zero, since it would move to the upper edge 24 of the shoe sole.

At that point of 90 degree tilt, all of the full body weight 133 is directed into the unresisted and unsupported force component 136, which is destabilizing the shoe sole very powerfully. In other words, the full weight of the body is physically unsupported and therefore powering the outward rotation of the shoe sole that produces an ankle sprain. Insidiously, the farther ankle ligaments are stretched, the greater the force on them.

In stark contrast, untilted at 0 degrees, when the shoe sole is upright, resting flat on the ground, all of the force of body weight 133 is physically supported directly by the shoe sole and therefore exactly equals the supported force component 135, as also shown in FIG. 15. In the untilted position, there is no destabilizing unsupported force component 136.

Figure 16:
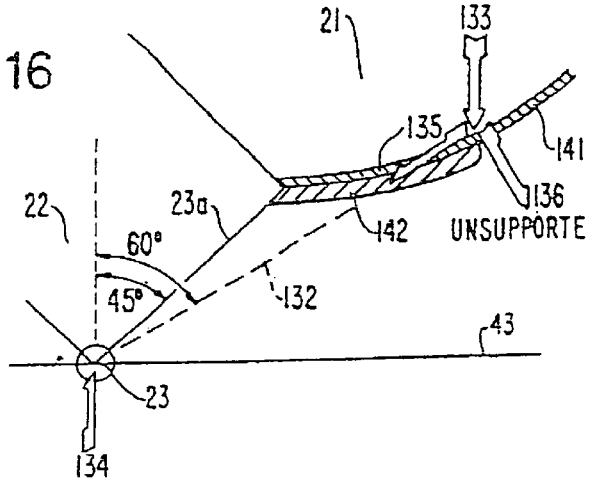

FIG. 16 illustrates that the extremely rigid heel counter 141 typical of existing athletic shoes, together with the motion control device 142 that are often used to strongly reinforce those heel counters (and sometimes also the sides of the mid- and forefoot), are ironically counterproductive. Though they are intended to increase stability, in fact they decrease it. FIG. 16 shows that when the shoe 20 is tilted out, the foot is shifted within the upper 21 naturally against the rigid structure of the typical motion control device 142, instead of only the outside edge of the shoe sole 22 itself. The motion control support 142 increases by almost twice the effective lever arm 132 (compared to 23*a*) between the force couple of body weight and the ground reaction force at the pivot point 23. It doubles the destabilizing torque and also increases the effective angle of tilt so that the destabilizing force component 136 becomes greater compared to the supported component 135, also increasing the destabilizing torque. To the extent the foot shifts further to the outside, the problem becomes worse. Only by removing the heel counter 141 and the motion control devices 142 can the extension of the destabilizing lever arm be avoided. Such an approach would primarily rely on the applicant's contoured shoe sole to "cup" the foot (especially the heel), and to a much lesser extent the non-rigid fabric or other flexible material of the upper 21, to position the foot, including the heel, on the shoe. Essentially, the naturally contoured sides of the applicant's shoe sole replace the counter-productive existing heel counters and motion control devices, including those which extend around virtually all of the edge of the foot.

Figure 17:
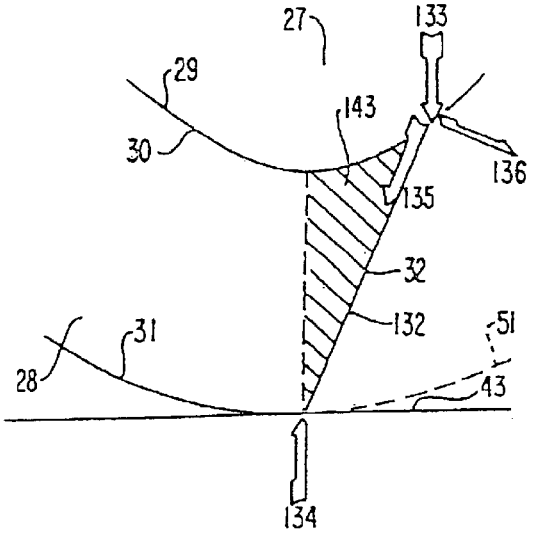

FIG. 17 shows that the same kind of torsional problem, though to a much more moderate extent, can be produced in the applicant's naturally contoured design of the applicant's earlier filed applications. There, the concept of a theoretically-ideal stability plane was developed in terms of a sole 28 having a lower surface 31 and an upper surface 30 which are spaced apart by a predetermined distance which remains constant throughout the sagittal frontal planes. The outer surface 27 of the foot is in contact with the upper surface 30 of the sole 28. Though it might seem desirable to extend the inner surface 30 of the shoe sole 28 up around the sides of the foot 27 to further support it (especially in creating anthropomorphic designs), FIG. 17 indicates that only that portion of the inner shoe sole 28 that is directly supported structurally underneath by the rest of the shoe sole is effective in providing natural support and stability. Any point on the upper surface 30 of the shoe sole 28 that is not supported directly by the constant shoe sole thickness (as measured by a perpendicular to a tangent at that point and shown in the shaded area 143) will tend to produce a moderate destabilizing torque. To avoid creating a destabilizing lever arm 132, only the supported contour sides and non-rigid fabric or other material can be used to position the foot on the shoe sole 28.

Figure 18:
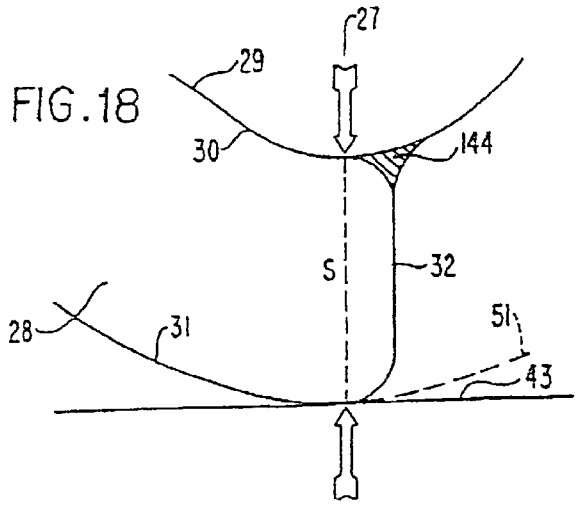

FIG. 18 illustrates an approach to minimize structurally the destabilizing lever arm 3.2 and therefore the potential torque problem. After the last point where the constant shoe sole thickness (s) is maintained, the finishing edge of the shoe sole 28 should be tapered gradually inward from both the top surface 30 and the bottom surface 31, in order to provide matching rounded or semi-rounded edges. In that way, the upper surface 30 does not provide an unsupported portion that creates a destabilizing torque and the bottom surface 31 does not provide an unnatural pivoting edge. The gap 144 between shoe sole 28 and foot sole 29 at the edge of the shoe sole can be "caulked" with exceptionally soft sole material as indicated in FIG. 18 that, in the aggregate (i.e. all the way around the edge of the shoe sole), will help position the foot in the shoe sole. However, at any point of pressure when the shoe tilts, it will deform easily so as not to form an unnatural lever causing a destabilizing torque.

FIG. 19 illustrates a fully contoured design, but abbreviated along the sides to only essential structural stability and propulsion shoe sole elements as shown in FIG. 21 of U.S. patent application Ser. No. 07/239,667 (filed 02 Sep. 1988) combined with the freely articulating structural elements underneath the foot as shown in FIG. 28 of the same patent application. The unifying concept is that, on both the sides and underneath the main load-bearing portions of the shoe sole, only the important structural (i.e. bone) elements of the foot should be supported by the shoe sole, if the natural flexibility of the foot is to be paralleled accurately in shoe sole flexibility, so that the shoe sole does not interfere with the foot's natural motion. In a sense, the shoe sole should be composed of the same main structural elements as the foot and they should articulate with each other just as do the main joints of the foot.

Figure 19A:
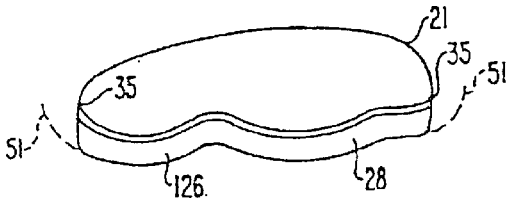
Figure 19B:
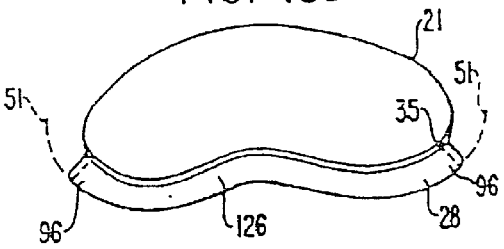
Figure 19C:
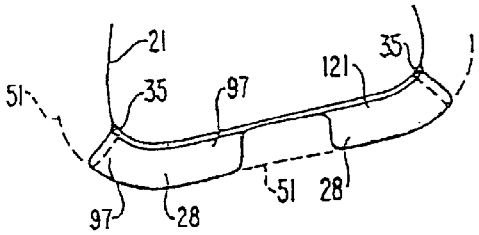
Figure 19D:
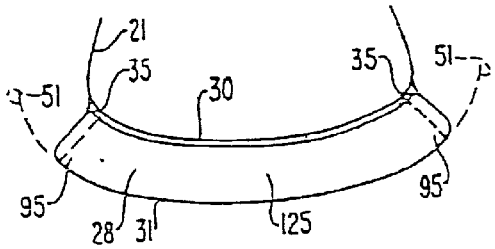
Figure 19E:
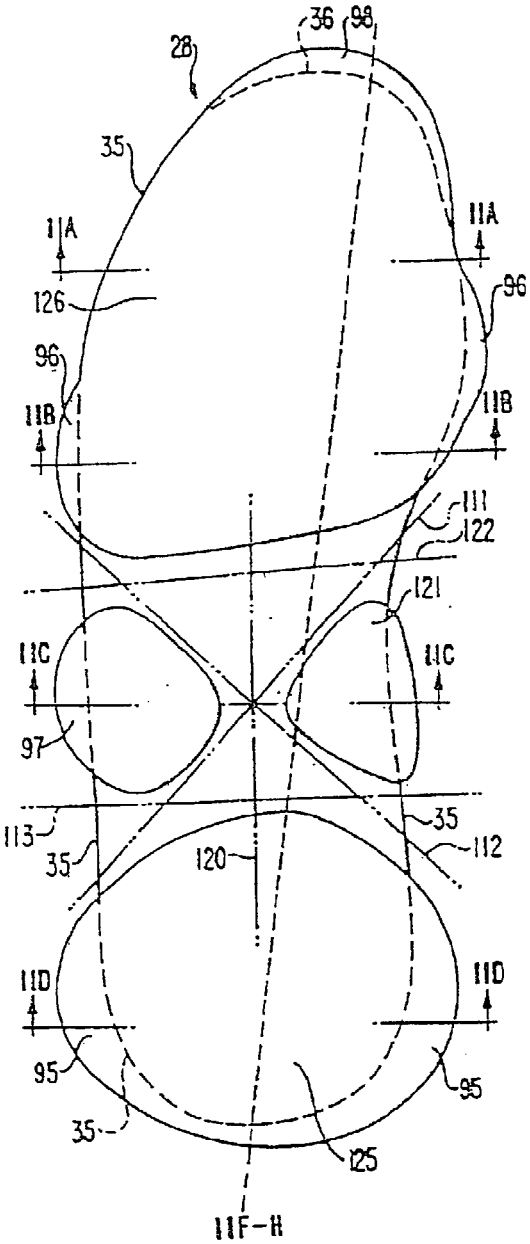
Figure 19E:
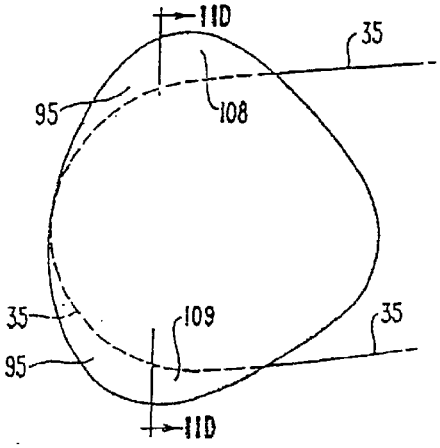

FIG. 19E shows the horizontal plane bottom view of the right foot corresponding to the fully contoured design previously described, but abbreviated along the sides to only essential structural support and propulsion elements. Shoe sole material density can be increased in the unabbreviated essential elements to compensate for increased pressure loading there. The essential structural support elements are the base and lateral tuberosity of the calcaneus 95, the heads of the metatarsals 96, and the base of the fifth metatarsal 97 (and the adjoining cuboid in some individuals). They must be supported both underneath and to the outside edge of the foot for stability. The essential propulsion element is the head of the first distal phalange 98. FIG. 19 shows that the naturally contoured stability sides need not be used except in the identified essential areas. Weight savings and flexibility improvements can be made by omitting the non-essential stability sides.

The design of the portion of the shoe sole directly underneath the foot shown in FIG. 19 allows for unobstructed natural inversion/eversion motion of the calcaneus by providing maximum shoe sole flexibility particularly between the base of the calcaneus 125 (heel) and the metatarsal heads 126 (forefoot) along an axis 120. An unnatural torsion occurs about that axis if flexibility is insufficient so that a conventional shoe sole interferes with the inversion/eversion motion by restraining it. The object of the design is to allow the relatively more mobile (in inversion and eversion) calcaneus to articulate freely and independently from the relatively more fixed forefoot instead of the fixed or fused structure or lack of stable structure between the two in conventional designs. In a sense, freely articulating joints are created in the shoe sole that parallel those of the foot. The design is to remove nearly all of the shoe sole material between the heel and the forefoot, except under one of the previously described essential structural support elements, the base of the fifth metatarsal 97. An optional support for the main longitudinal arch 121 may also be retained for runners with substantial foot pronation, although would not be necessary for many runners.

The forefoot can be subdivided (not shown) into its component essential structural support and propulsion elements, the individual heads of the metatarsal and the heads of the distal phalanges, so that each major articulating joint set of the foot is paralleled by a freely articulating shoe sole support propulsion element, an anthropomorphic design; various aggregations of the subdivision are also possible.

The design in FIG. 19 features an enlarged structural support at the base of the fifth metatarsal in order to include the cuboid, which can also come into contact with the ground under arch comPrEssion in some individuals. In addition, the design can provide general side support in the heel area, as in FIG. 19E or alternatively can carefully orient the stability sides in the heel area to the exact positions of the lateral calcaneal tuberosity 108 and the main base of the calcaneus 109, as in FIG. 19E' (showing heel area only of the right foot). FIGS. 19A–D show frontal plane cross sections of the left shoe and FIG. 19E shows a bottom view of the right foot, with flexibility axes 120, 122, 111, 112 and 113 indicated. FIG. 19F shows a sagittal plane cross section showing the structural elements joined by very thin and relatively soft upper midsole layer. FIGS. 19G and 19H show similar cross sections with slightly different designs featuring durable fabric only (slip-lasted shoe), or a structurally sound arch design, respectively. FIG. 19I shows a side medial view of the shoe sole.

Figure 19J:
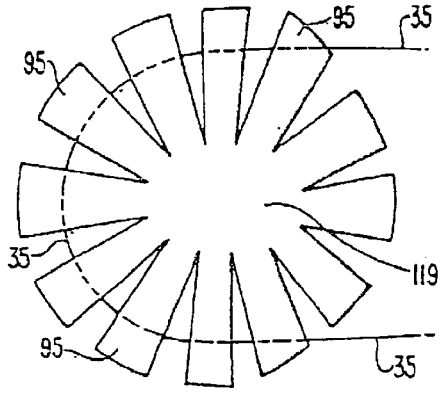
Figure 19F:
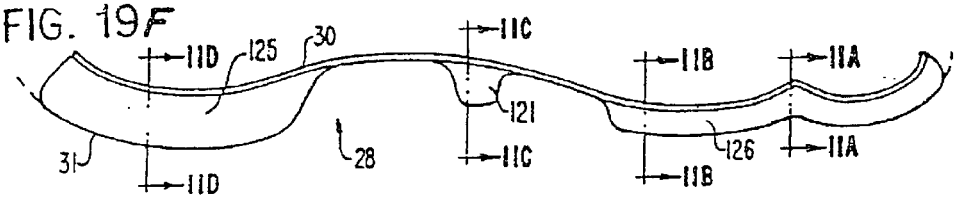
Figure 19G:
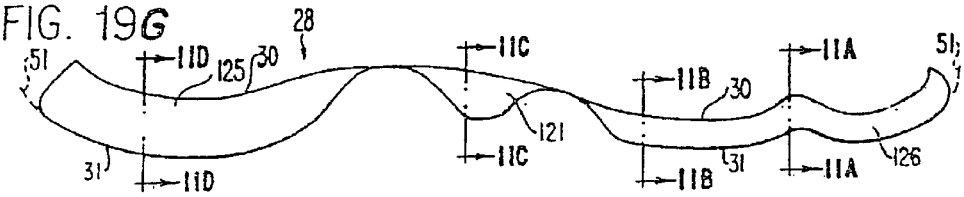
Figure 19H:
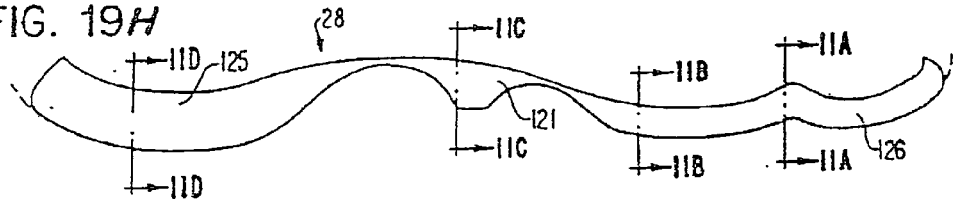
Figure 19I:
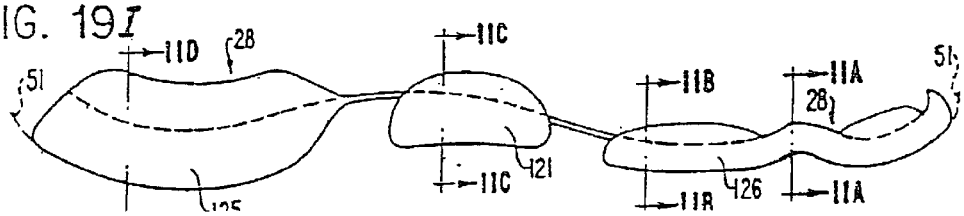

FIG. 19J shows a simple interim or low cost construction for the articulating shoe sole support element 95 for the heel (showing the heel area only of the right foot); while it is most critical and effective for the heel support element 95, it can also be used with the other elements, such as the base of the fifth metatarsal 97 and the long arch 121. The heel sole element 95 shown can be a single flexible layer or a lamination of layers. When cut from a flat sheet or molded in the general pattern shown, the outer edges can be easily bent to follow the contours of the foot, particularly the sides. The shape shown allows a flat or slightly contoured heel element 95 to be attached to a highly contoured shoe upper or very thin upper sole layer like that shown in FIG. 19F. Thus, a very simple construction technique can yield a highly sophisticated shoe sole design. The size of the center section 119 can be small to conform to a fully or nearly fully contoured design or larger to conform to a contoured sides design, where there is a large flattened sole area under the heel. The flexibility is provided by the removed diagonal sections, the exact proportion of size and shape can vary.

Figure 20:
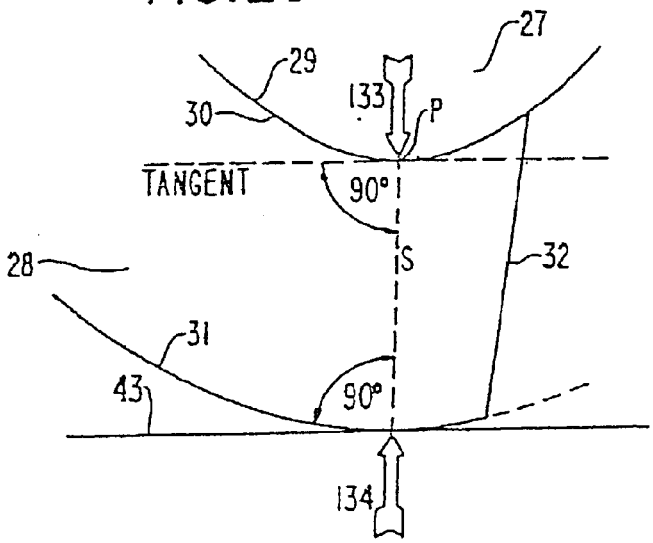
Figure 21A:
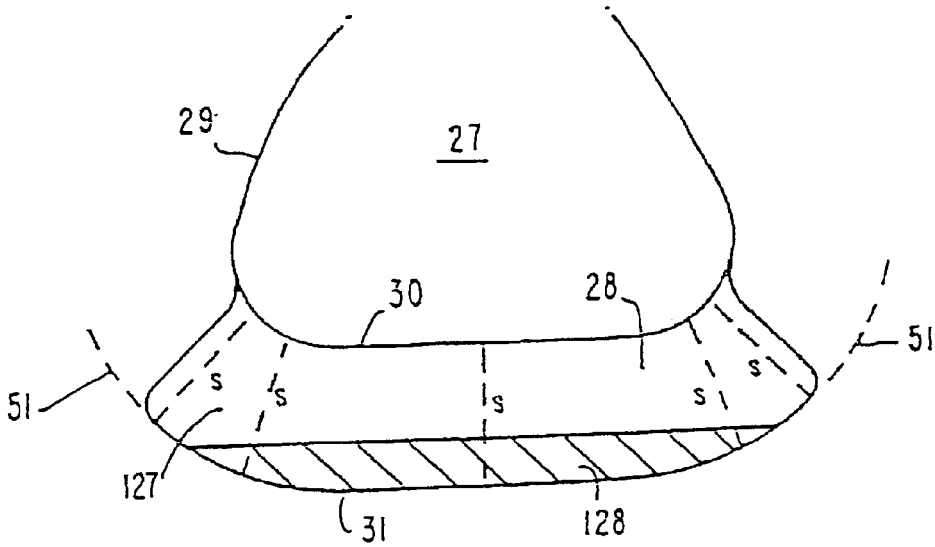
Figure 21C:
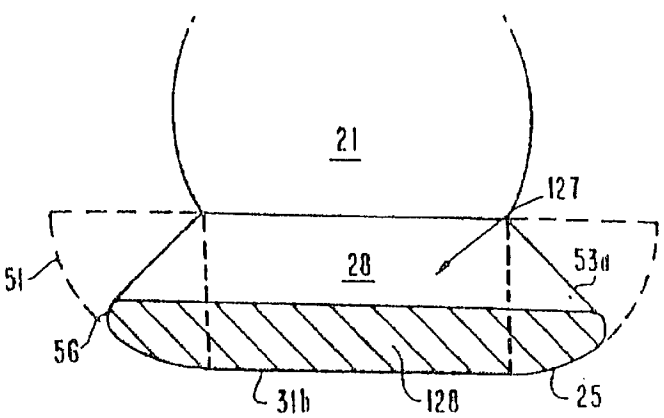
Figure 21D:
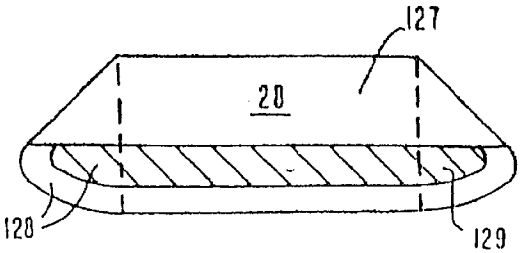
Figure 21B:
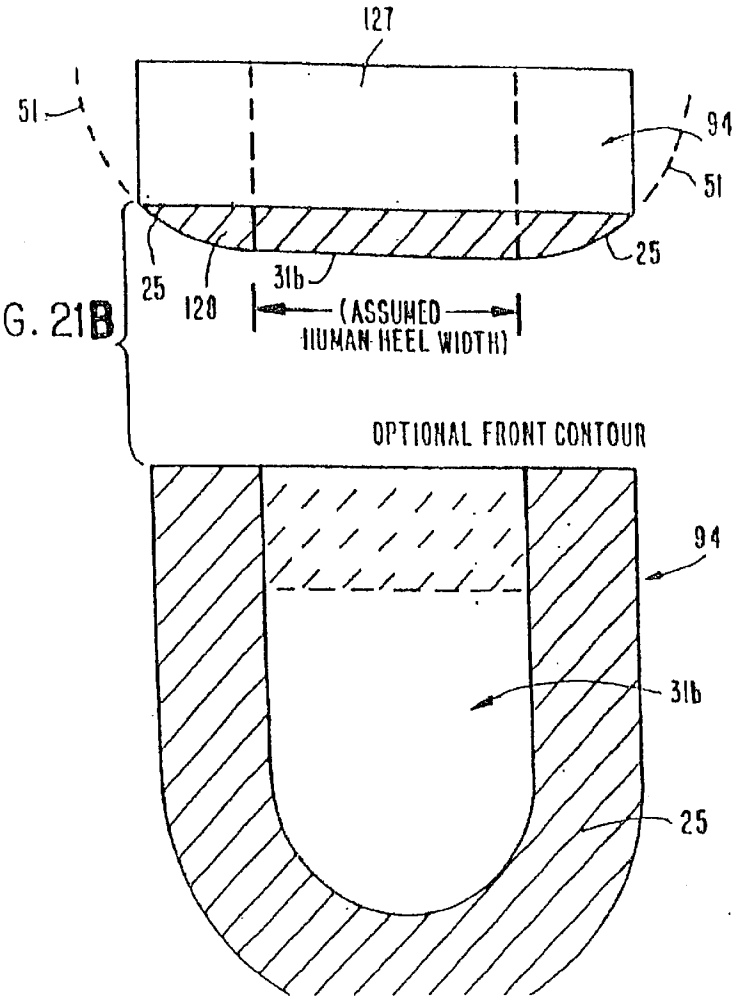
Figure 21E:
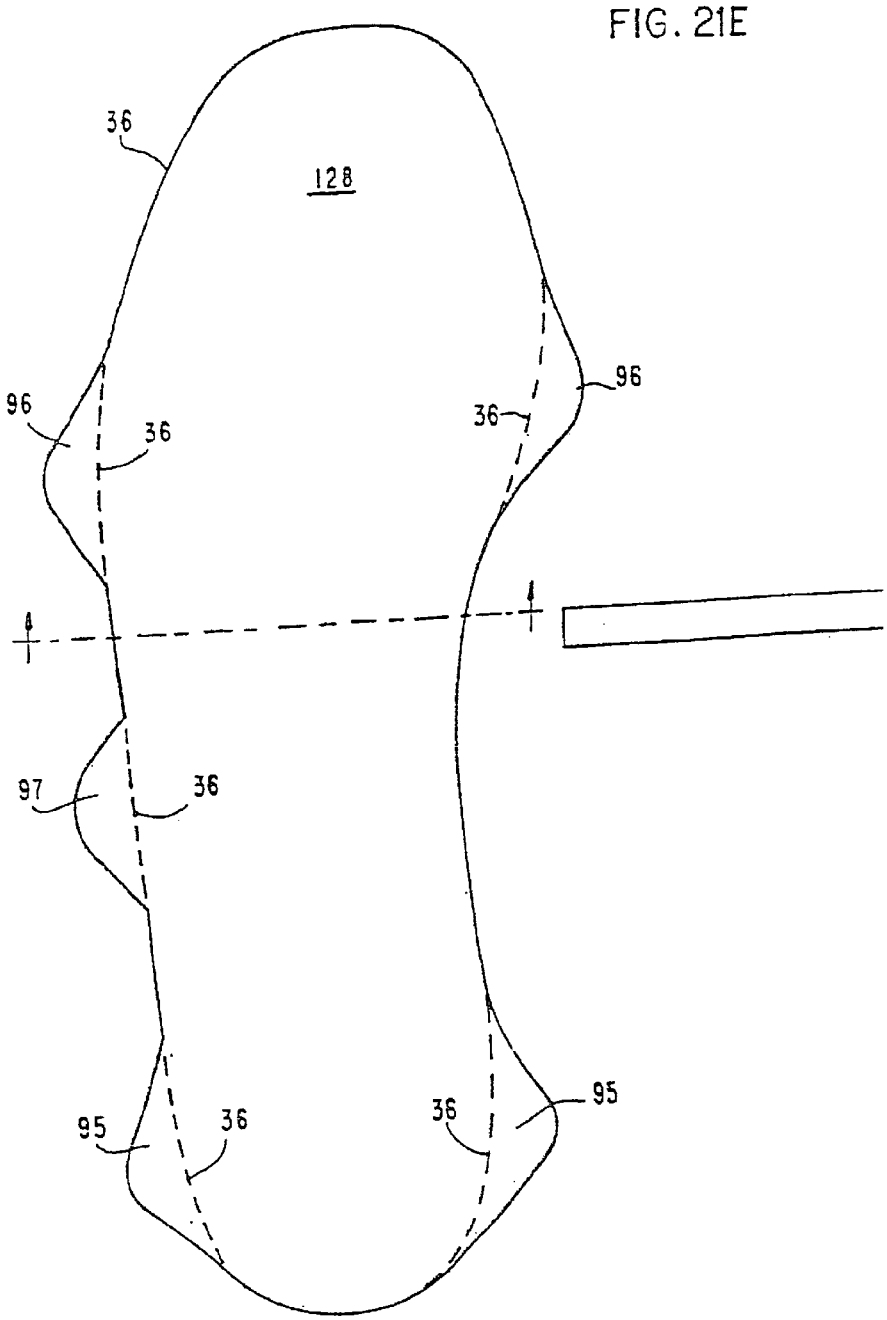

FIG. 20 illustrates an expanded explanation of the correct approach for measuring shoe sole thickness according to the naturally contoured design, as described previously in FIGS. 23 and 24 of U.S. patent application Ser. No. 07/239,667 (filed 02 Sep. 1988). The tangent described in those figures would be parallel to the ground when the shoe sole is tilted out sideways, so that measuring shoe sole thickness along the perpendicular will provide the least distance between the point on the upper shoe sole surface closest to the ground and the closest point to it on the lower surface of the shoe sole (assuming no load deformation).

FIG. 21 shows a non-optimal but interim or low cost approach to shoe sole construction, whereby the midsole and heel lift 127 are produced conventionally, or nearly so (at least leaving the midsole bottom surface flat, though the sides can be contoured), while the bottom or outer sole 128 includes most or all of the special contours of the new design. Not only would that completely or mostly limit the special contours to the bottom sole, which would be molded specially, it would also ease assembly, since two flat surfaces of the bottom of the midsole and the top of the bottom sole could be mated together with less difficulty than two contoured surfaces, as would be the case otherwise. The advantage of this approach is seen in the naturally contoured design example illustrated in FIG. 21A, which shows some contours on the relatively softer midsole sides, which are subject to less wear but benefit from greater traction for stability and ease of deformation, while the relatively harder contoured bottom sole provides good wear for the load-bearing areas. FIG. 21B shows in a quadrant side design the concept applied to conventional street shoe heels, which are usually separated from the forefoot by a hollow instep area under the main longitudinal arch. FIG. 21C shows in frontal plane cross section the concept applied to the quadrant sided or single plane design and indicating in FIG. 21D in the shaded area 129 of the bottom sole that portion which should be honeycombed (axis on the horizontal plane) to reduce the density of the relatively hard outer sole to that of the midsole material to provide for relatively uniform shoe density. FIG. 21E shows in bottom view the outline of a bottom sole 128 made from flat material which can be conformed topologically to a contoured midsole of either the one or two plane designs by limiting the side areas to be mated to the essential support areas discussed in FIG. 21 of the '667 application; by that method, the contoured midsole and flat bottom sole surfaces can be made to join satisfactorily by coinciding closely, which would be topologically impossible if all of the side areas were retained on the bottom sole.

FIGS. 22A–22C, frontal plane cross sections, show an enhancement to the previously described embodiments of the shoe sole side stability quadrant invention of the '349 Patent. As stated earlier, one major purpose of that design is to allow the shoe sole to pivot easily from side to side with the foot 90, thereby following the foot's natural inversion and eversion motion; in conventional designs shown in FIG. 22*a*, such foot motion is forced to occur within the shoe upper 21, which resists the motion. The enhancement is to position exactly and stabilize the foot, especially the heel, relative to the preferred embodiment of the shoe sole; doing so facilitates the shoe sole's responsiveness in following the foot's natural motion. Correct positioning is essential to the invention, especially when the very narrow or "hard tissue" definition of heel width is used. Incorrect or shifting relative position will reduce the inherent efficiency and stability of the side quadrant design, by reducing the effective thickness of the quadrant side 26 to less than that of the shoe sole 28*b*. As shown in FIG. 22B and 22C, naturally contoured inner stability sides 131 hold the pivoting edge 31 of the load-bearing foot sole in the correct position for direct contact with the flat upper surface of the conventional shoe sole 22, so that the shoe sole thickness (s) is maintained at a constant thickness (s) in the stability quadrant sides 26 when the shoe is everted or inverted, following the theoretically ideal stability plane 51.

The form of the enhancement is inner shoe sole stability sides 131 that follow the natural contour of the sides 91 of the heel of the foot 90, thereby cupping the heel of the foot. The inner stability sides 131 can be located directly on the top surface of the shoe sole and heel contour, or directly under the shoe insole (or integral to it), or somewhere in between. The inner stability sides are similar in structure to heel cups integrated in insoles currently in common use, but differ because of its material density, which can be relatively firm like the typical mid-sole, not soft like the insole. The difference is that because of their higher relative density, preferably like that of the uppermost midsole, the inner stability sides function as part of the shoe sole, which provides structural support to the foot, not just gentle cushioning and abrasion protection of a shoe insole. In the broadest sense, though, insoles should be considered structurally and functionally as part of the shoe sole, as should any shoe material between foot and ground, like the bottom of the shoe upper in a slip-lasted shoe or the board in a board-lasted shoe.

The inner stability side enhancement is particularly useful in converting existing conventional shoe sole design embodiments 22, as constructed within prior art, to an effective embodiment of the side stability quadrant 26 invention. This feature is important in constructing prototypes, and initial production of the invention, as well as an ongoing method of low cost production, since such production would be very close to existing art.

The inner stability sides enhancement is most essential in cupping the sides and back of the heel of the foot and therefore is essential on the upper edge of the heel of the shoe sole 27, but may also be extended around all or any portion of the remaining shoe sole upper edge. The size of the inner stability sides should, however, taper down in proportion to any reduction in shoe sole thickness in the sagittal plane.

FIGS. 23A–23C, frontal plane cross sections, illustrate the same inner shoe sole stability sides enhancement as it applies to the previously described embodiments of the naturally contoured sides '667 application design. The enhancement positions and stabilizes the foot relative to the shoe sole, and maintains the constant shoe sole thickness (s) of the naturally contoured sides 28*a* design, as shown in FIGS. 23B and 23C; FIG. 23A shows a conventional design. The inner shoe sole stability sides 131 conform to the natural contour of the foot sides 29, which determine the theoretically ideal stability plane 51 for the shoe sole thickness (s). The other features of the enhancement as it applies to the naturally contoured shoe sole sides embodiment 28 are the same as described previously under FIGS. 22A–22C for the side stability quadrant embodiment. It is clear from comparing FIGS. 23C and 22C that the two different approaches, that with quadrant sides and that with naturally contoured sides, can yield some similar resulting shoe sole embodiments through the use of inner stability sides 131. In essence, both approaches provide a low cost or interim method of adapting existing conventional "flat sheet" shoe manufacturing to the naturally contoured design described in previous figures.

FIGS. 24–34 are FIGS. 1–3, 6–9, 11–12, and 14–15, respectively, from the '478 application.

Figure 24:
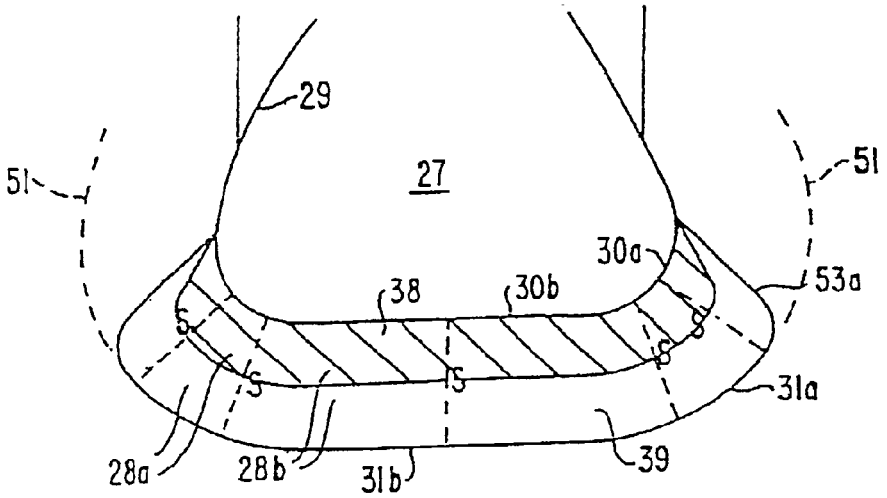
FIGS. 24–34 are from the '478 application.
Figure 25:
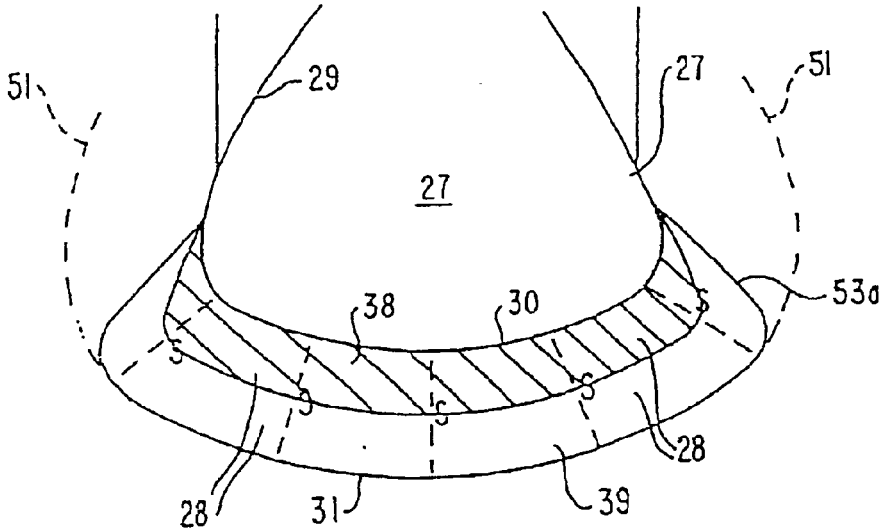
Figure 26A:
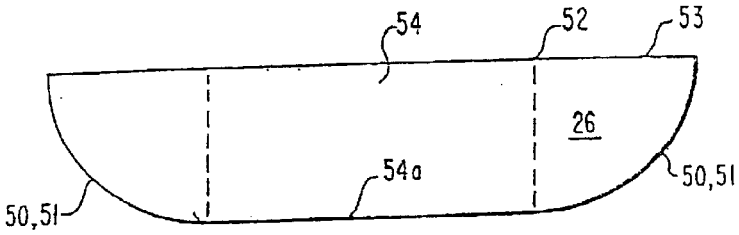
Figure 26B:
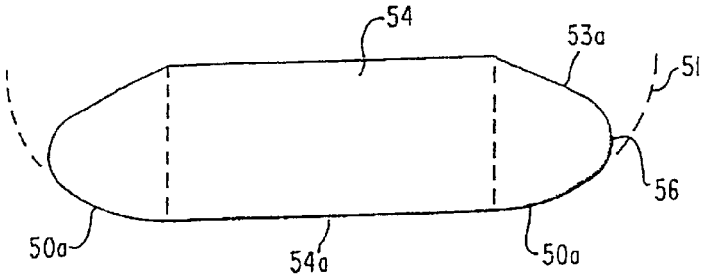
Figure 26C:
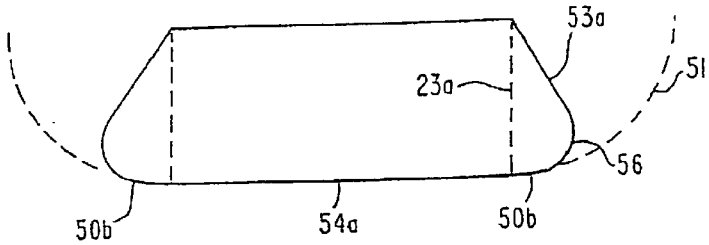

FIGS. 24, 25, and 26 show frontal plane cross sectional views of a shoe sole according to the applicant's prior inventions based on the theoretically ideal stability plane, taken at about the ankle joint to show the heel section of the shoe. FIGS. 4, 5, 8, and 27–32 show the same view of the applicant's enhancement of that invention. The reference numerals are like those used in the prior pending applications of the applicant mentioned above and which are incorporated by reference for the sake of completeness of disclosure, if necessary. In the figures, a foot 27 is positioned in a naturally contoured shoe having an upper 21 and a sole 28. The shoe sole normally contacts the ground 43 at about the lower central heel portion thereof, as shown in FIG. 4. The concept of the theoretically ideal stability plane, as developed in the prior applications as noted, defines the plane 51 in terms of a locus of points determined by the thickness(es) of the sole.

FIG. 24 shows, in a rear cross sectional view, the application of the prior invention showing the inner surface of the shoe sole conforming to the natural contour of the foot and the thickness of the shoe sole remaining constant in the frontal plane, so that the outer surface coincides with the theoretically ideal stability plane.

FIG. 25 shows a fully contoured shoe sole design of the applicant's prior invention that follows the natural contour of all of the foot, the bottom as well as the sides, while retaining a constant shoe sole thickness in the frontal plane.

The fully contoured shoe sole assumes that the resulting slightly rounded bottom when unloaded will deform under load and flatten just as the human foot bottom is slightly rounded unloaded but flattens under load; therefore, shoe sole material must be of such composition as to allow the natural deformation following that of the foot. The design applies particularly to the heel, but to the rest of the shoe sole as well. By providing the closest match to the natural shape of the foot, the fully contoured design allows the foot to function as naturally as possible. Under load, FIG. 2 would deform by flattening to look essentially like FIG. 24. Seen in this light, the naturally contoured side design in FIG. 24 is a more conventional, conservative design that is a special case of the more general fully contoured design in FIG. 25, which is the closest to the natural form of the foot, but the least conventional. The amount of deformation flattening used in the FIG. 24 design, which obviously varies under different loads, is not an essential element of the applicant's invention.

FIGS. 24 and 25 both show in frontal plane cross sections the essential concept underlying this invention, the theoretically ideal stability plane, which is also theoretically ideal for efficient natural motion of all kinds, including running, jogging or walking. FIG. 25 shows the most general case of the invention, the fully contoured design, which conforms to the natural shape of the unloaded foot. For any given individual, the theoretically ideal stability plane 51 is determined, first, by the desired shoe sole thickness(es) in a frontal plane cross section, and, second, by the natural shape of the individual's foot surface 29.

For the special case shown in FIG. 24, the theoretically ideal stability plane for any particular individual (or size average of individuals) is determined, first, by the given frontal plane cross section shoe sole thickness (es); second, by the natural shape of the individual's foot; and, third, by the frontal plane cross section width of the individual's load-bearing footprint 30*b*, which is defined as the upper surface of the shoe sole that is in physical contact with and supports the human foot sole.

The theoretically ideal stability plane for the special case is composed conceptually of two parts. Shown in FIG. 24, the first part is a line segment 31*b* of equal length and parallel to line 30*b* at a constant distance(s) equal to shoe sole thickness. This corresponds to a conventional shoe sole directly underneath the human foot, and also corresponds to the flattened portion of the bottom of the load-bearing foot sole 28*b*. The second part is the naturally contoured stability side outer edge 31*a* located at each side of the first part, line segment 31*b*. Each point on the contoured side outer edge 31*a* is located at a distance which is exactly shoe sole thickness(es) from the closest point on the contoured side inner edge 30*a*.

In summary, the theoretically ideal stability plane is the essence of this invention because it is used to determine a geometrically precise bottom contour of the shoe sole based on a top contour that conforms to the contour of the foot. This invention specifically claims the exactly determined geometric relationship just described.

It can be stated unequivocally that any shoe sole contour, even of similar contour, that exceeds the theoretically ideal stability plane will restrict natural foot motion, while any less than that plane will degrade natural stability, in direct proportion to the amount of the deviation. The theoretical ideal was taken to be that which is closest to natural.

FIG. 26 illustrates in frontal plane cross section another variation of the applicant's prior invention that uses stabilizing quadrants 26 at the outer edge of a conventional shoe sole 28*b* illustrated generally at the reference numeral 28. The stabilizing quadrants would be abbreviated in actual embodiments.

FIG. 27 is based on FIG. 1B but also shows, for purposes of illustration, on the right side of FIG. 27 a relative thickness increase of the contoured shoe sole side for that portion of the contoured shoe sole side beyond the limit of the full range of normal sideways foot inversion and eversion motion, while uniform thickness exists for the load-bearing portions of the contoured shoe sole side. Alternately, the same relative thickness increase of the contoured shoe sole side could exist for that portion of the contoured shoe sole side beyond the limit of the full range of foot inversion and eversion, relatively more uniform or smaller thickness variations exists for the load-bearing portions of the contoured shoe sole side; this design could apply to FIGS. 4, 5, 8, 45, 46 and 49 and others. For purposes of illustration, the left side of FIG. 27 shows a density increase used for the same purpose as the thickness increase. And the same design can be used for embodiments with decreasing thickness variations, like FIG. 7 and FIG. 48.

FIG. 28 shows that the thickness can also increase and then decrease; other thickness variation sequences are also possible. The variation in side contour thickness in the new invention can be either symmetrical on both sides or asymmetrical, particularly with the medial side providing more stability than the lateral side, although many other asymmetrical variations are possible, and the pattern of the right foot can vary from that of the left foot.

FIGS. 29, 30, 6 and 32 show that similar variations in shoe midsole (other portions of the shoe sole area not shown) density can provide similar but reduced effects to the variations in shoe sole thickness described previously in FIGS. 4, 5, 27 and 28. The major advantage of this approach is that the structural theoretically ideal stability plane is retained, so that naturally optimal stability and efficient motion are retained to the maximum extent possible.

Figure 29:
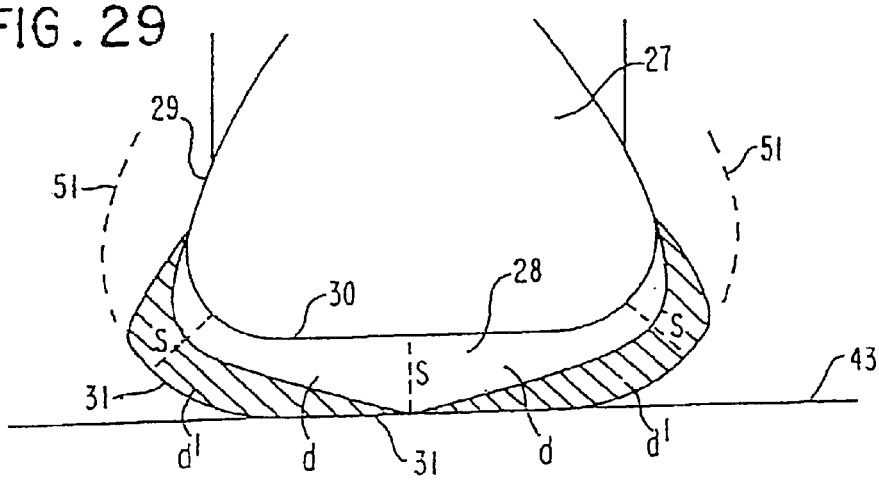
Figure 30:
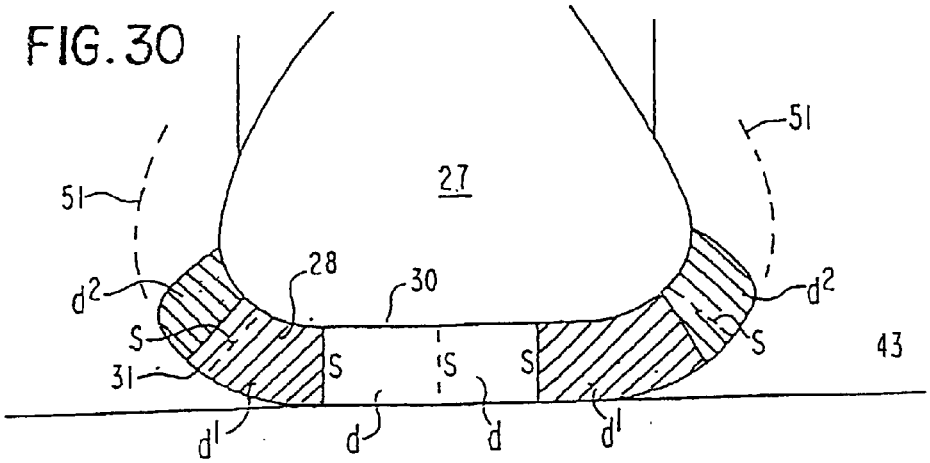
Figure 31:
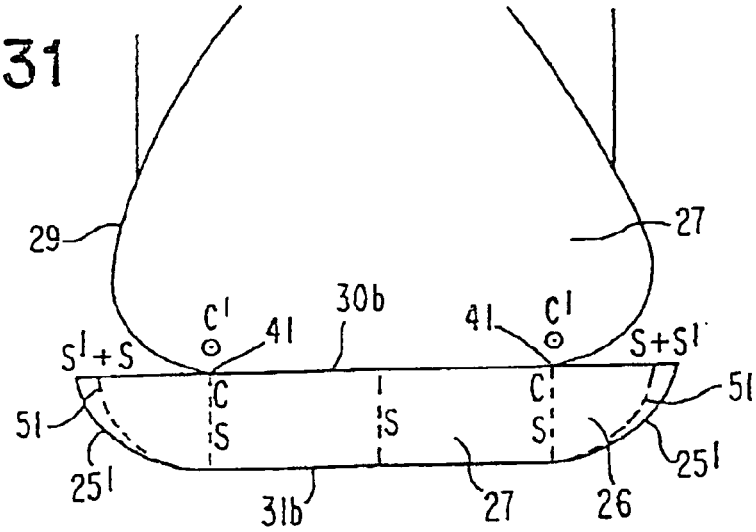
Figure 32:
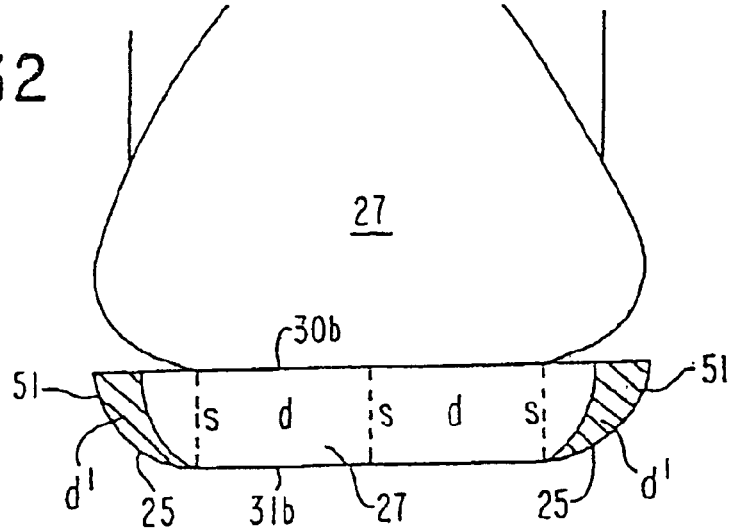

The forms of dual and tri-density midsoles shown in the figures are extremely common in the current art of running shoes, and any number of densities are theoretically possible, although an angled alternation of just two densities like that shown in FIG. 29 provides continually changing composite density. However, the applicant's prior invention did not prefer multi-densities in the midsole, since only a uniform density provides a neutral shoe sole design that does not interfere with natural foot and ankle biomechanics in the way that multi-density shoe soles do, which is by providing different amounts of support to different parts of the foot; it did not, of course, preclude such multi-density midsoles. In these figures, the density of the sole material designated by the legend (d1) is firmer than (d) while (d1) is the firmest of the three representative densities shown. In FIG. 29, a dual density sole is shown, with (d) having the less firm density.

It should be noted that shoe soles using a combination both of sole thicknesses greater than the theoretically ideal stability plane and of midsole densities variations like those just described are also possible but not shown.

In particular, it is anticipated that individuals with overly rigid feet, those with restricted range of motion, and those tending to over-supinate may benefit from the FIG. 33 embodiments. Even more particularly, it is expected that the invention will benefit individuals with significant bilateral foot function asymmetry: namely, a tendency toward pronation on one foot and supination on the other foot. Consequently, it is anticipated that this embodiment would be used only on the shoe sole of the supinating foot, and on the inside portion only, possibly only a portion thereof. It is expected that the range less than the theoretically ideal stability plane would be a maximum of about five to ten percent, though a maximum of up to twenty-five percent may be beneficial to some individuals.

Figure 33A:
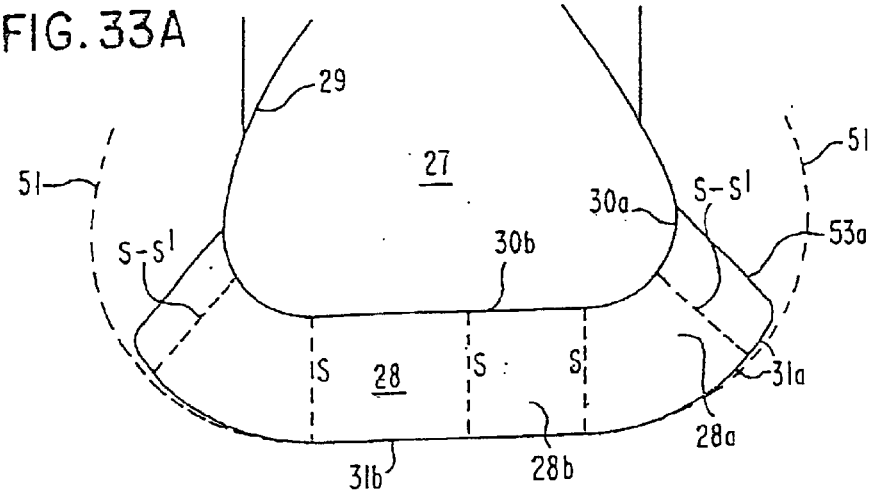
Figure 33B:
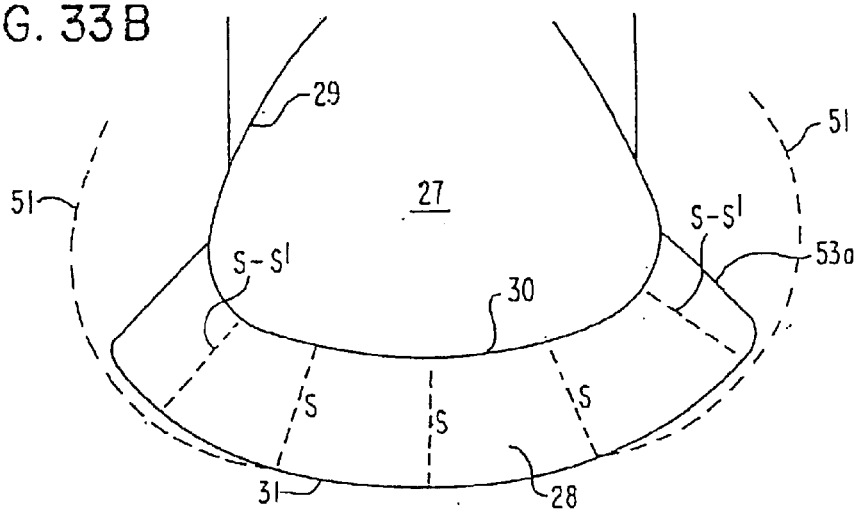
Figure 33C:
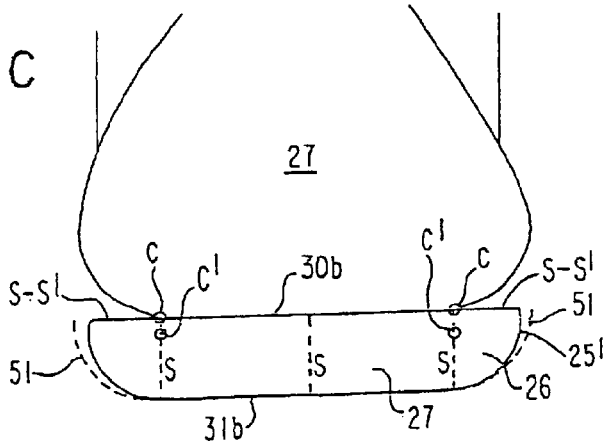

FIG. 33A shows an embodiment like FIGS. 4 and 28, but with naturally contoured sides less than the theoretically ideal stability plane. FIG. 33B shows an embodiment like the fully contoured design in FIGS. 5 and 6, but with a shoe sole thickness decreasing with increasing distance from the center portion of the sole. FIG. 33C shows an embodiment like the quadrant-sided design of FIG. 31, but with the quadrant sides increasingly reduced from the theoretically ideal stability plane.

The lesser-sided design of FIG. 33 would also apply to the FIGS. 29, 30, 6 and 32 density variation approach and to the FIG. 8 approach using tread design to approximate density variation.

Figure 34A:
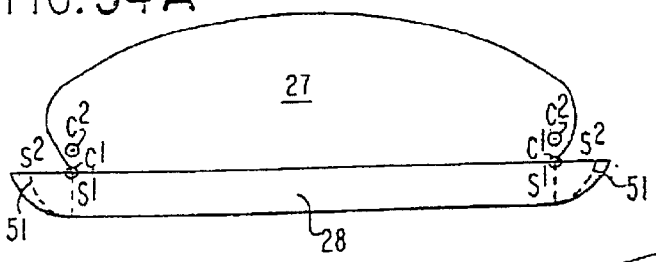
Figure 34D:
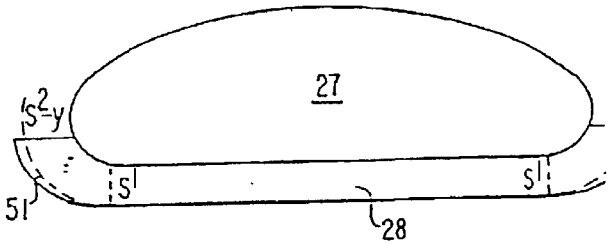
Figure 34B:
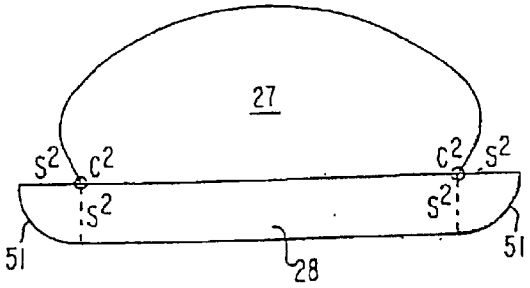
Figure 34E:
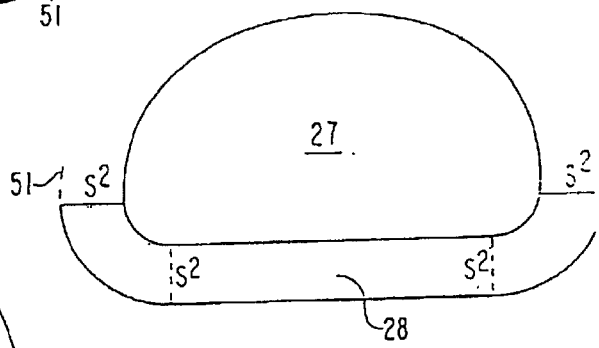
Figure 34C:
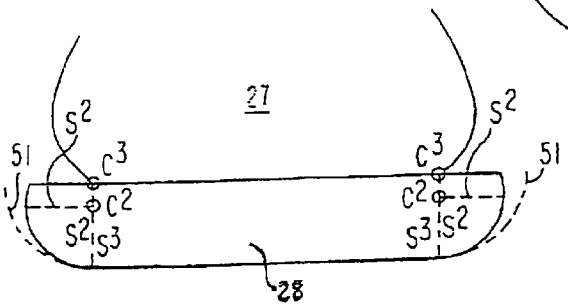

FIGS. 34A–C show, in cross sections similar to those in pending U.S. Patent '349, that with the quadrant-sided design of FIGS. 26, 31, 32 and 33C that it is possible to have shoe sole sides that are both greater and lesser than the theoretically ideal stability plane in the same shoe. The radius of an intermediate shoe sole thickness, taken at ($S^2$) at the base of the fifth metatarsal in FIG. 34B, is maintained constant throughout the quadrant sides of the shoe sole, including both the heel, FIG. 34C, and the forefoot, FIG. 34A, so that the side thickness is less than the theoretically ideal stability plane at the heel and more at the forefoot. Though possible, this is not a preferred approach.

Figure 34F:
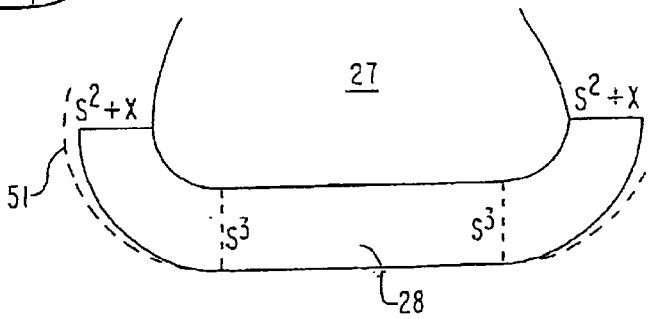

The same approach can be applied to the naturally contoured sides or fully contoured designs described in FIGS. 24, 25, 4, 5, 6, 8, and 27–30, but it is also not preferred. In addition, is shown in FIGS. 34D–F, in cross sections similar to those in pending U.S. application Ser. No. 07/239,667, it is possible to have shoe sole sides that are both greater and lesser than the theoretically ideal stability plane in the same shoe, like FIGS. 34A–C, but wherein the side thickness (or radius) is neither constant like FIGS. 34A–C or varying directly with shoe sole thickness, like in the applicant's pending applications, but instead varying quite indirectly with shoe sole thickness. As shown in FIGS. 34D–F, the shoe sole side thickness varies from somewhat less than shoe sole thickness at the heel to somewhat more at the forefoot. This approach, though possible, is again not preferred, and can be applied to the quadrant sided design, but is not preferred there either.

FIGS. 35–44 are FIGS. 1–10 from the '302 application.

Figure 35:
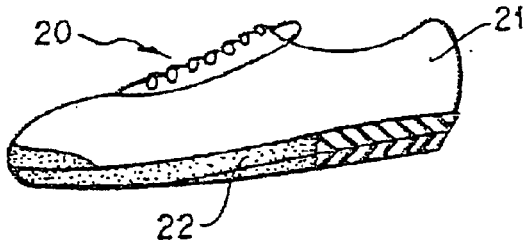
FIG. 35 (PRIOR ART)
FIGS. 35–44 are from the '302 application.

FIG. 35 shows a perspective view of a shoe, such as a typical athletic shoe specifically for running, according to the prior art, wherein the running shoe 20 includes an upper portion 21 and a sole 22.

Figure 36:
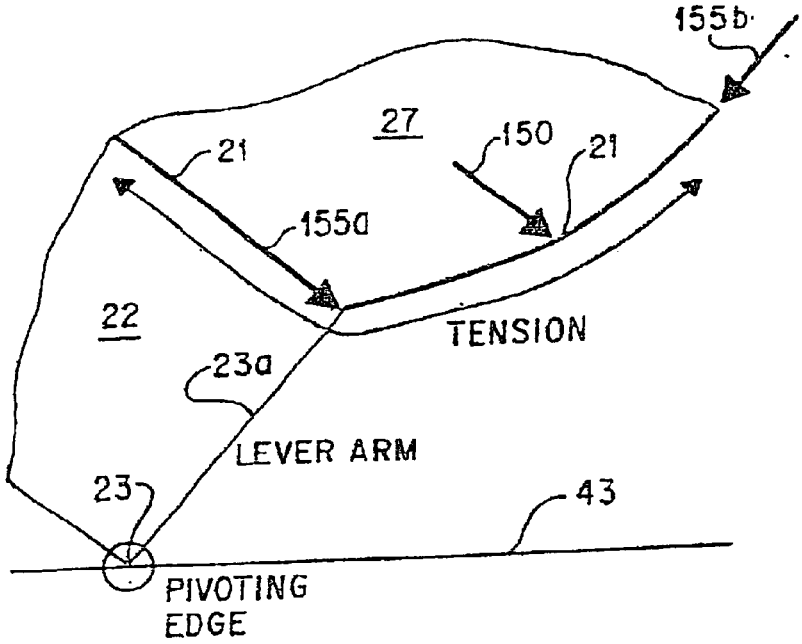

FIG. 36 illustrates, in a close-up cross section of a typical shoe of existing art (undeformed by body weight) on the ground 43 when tilted on the bottom outside edge 23 of the shoe sole 22, that an inherent stability problem remains in existing designs, even when the abnormal torque producing rigid heel counter and other motion devices are removed, as illustrated in FIG. 5 of pending U.S. application Ser. No. 07/400,714, filed on Aug. 30, 1989, shown as FIG. 16 in this application. The problem is that the remaining shoe upper 21 (shown in the thickened and darkened line), while providing no lever arm extension, since it is flexible instead of rigid, nonetheless creates unnatural destabilizing torque on the shoe sole. The torque is due to the tension force 155*a* along the top surface of the shoe sole 22 caused by a compression force 150 (a composite of the force of gravity on the body and a sideways motion force) to the side by the foot 27, due simply to the shoe being tilted to the side, for example. The resulting destabilizing force acts to pull the shoe sole in rotation around a lever arm 23*a* that is the width of the shoe sole at the edge. Roughly speaking, the force of the foot on the shoe upper pulls the shoe over on its side when the shoe is tilted sideways. The compression force 150 also creates a tension force 155*b*, which is the mirror image of tension force 155*a*

Figure 37:
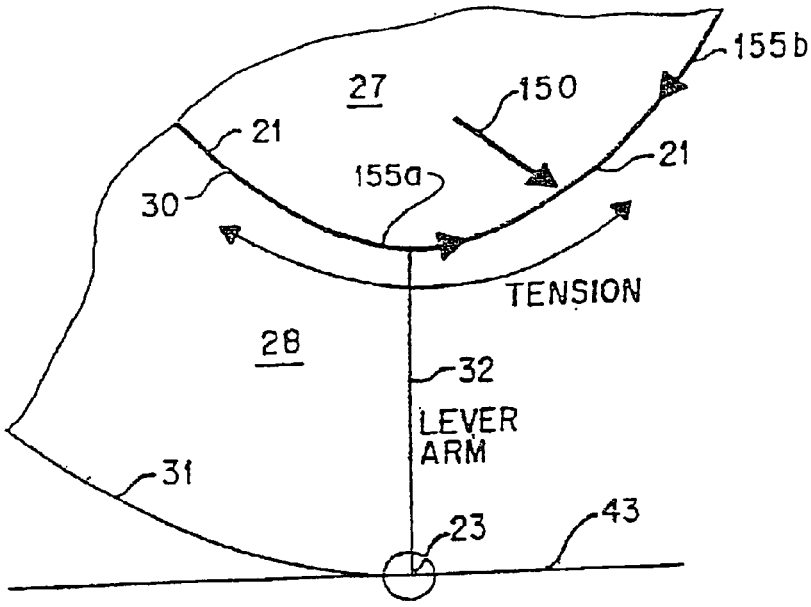

FIG. 37 shows, in a close-up cross section of a naturally contoured design shoe sole 28, described in pending U.S. application Ser. No. 07/239,667, filed on Sep. 2, 1988, (also shown undeformed by body weight) when tilted on the bottom edge, that the same inherent stability problem remains in the naturally contoured shoe sole design, though to a reduced degree. The problem is less since the direction of the force vector 155 along the lower surface of the shoe upper 21 is parallel to the ground 43 at the outer sole edge 32 edge, instead of angled toward the ground as in a conventional design like that shown in FIG. 36, so the resulting torque produced by lever arm created by the outer sole edge 32 would be less, and the contoured shoe sole 28 provides direct structural support when tilted, unlike conventional designs.

Figure 38:
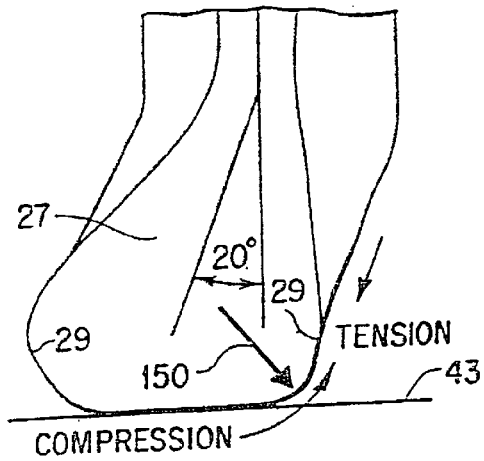

FIG. 38 shows (in a rear view) that, in contrast, the barefoot is naturally stable because, when deformed by body weight and tilted to its natural lateral limit of about 20 degrees, it does not create any destabilizing torque due to tension force. Even though tension paralleling that on the shoe upper is created on the outer surface 29, both bottom and sides, of the bare foot by the compression force of weight-bearing, no destabilizing torque is created because the lower surface under tension (ie the foot's bottom sole, shown in the darkened line) is resting directly in contact with the ground. Consequently, there is no unnatural lever arm artificially created against which to pull. The weight of the body firmly anchors the outer surface of the foot underneath the foot so that even considerable pressure against the outer surface 29 of the side of the foot results in no destabilizing motion. When the foot is tilted, the supporting structures of the foot, like the calcaneus, slide against the side of the strong but flexible outer surface of the foot and create very substantial pressure on that outer surface at the sides of the foot. But that pressure is precisely resisted and balanced by tension along the outer surface of the foot, resulting in a stable equilibrium.

Figure 39A:
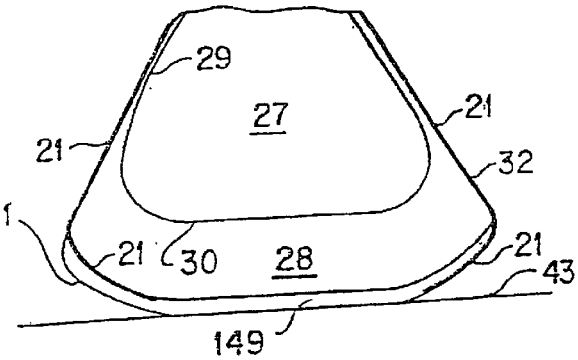
Figure 39B:
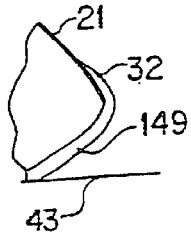

FIG. 39 shows, in cross section of the upright heel deformed by body weight, the principle of the tension stabilized sides of the barefoot applied to the naturally contoured shoe sole design; the same principle can be applied to conventional shoes, but is not shown. The key change from the existing art of shoes is that the sides of the shoe upper 21 (shown as darkened lines) must wrap around the outside edges 32 of the shoe sole 28, instead of attaching underneath the foot to the upper surface 30 of the shoe sole, as done conventionally. The shoe upper sides can overlap and be attached to either the inner (shown on the left) or outer surface i(shown on the right) of the bottom sole, since those sides are not unusually load-bearing, as shown; or the bottom sole, optimally thin and tapering as shown, can extend upward around the outside edges 32 of the shoe sole to overlap and attach to the shoe upper sides (shown FIG. 39B); their optimal position coincides with the Theoretically Ideal Stability Plane, so that the tension force on the shoe sides is transmitted directly all the way down to the bottom shoe, which anchors it on the ground with virtually no intervening artificial lever arm. For shoes with only one sole layer, the attachment of the shoe upper sides should be at or near the lower or bottom surface of the shoe sole.

The design shown in FIG. 39 is based on a fundamentally different conception: that the shoe upper is integrated into the shoe sole, instead of attached on top of it, and the shoe sole is treated as a natural extension of the foot sole, not attached to it separately.

The fabric (or other flexible material, like leather) of the shoe uppers would preferably be non-stretch or relatively so, so as not to be deformed excessively by the tension place upon its sides when compressed as the foot and shoe tilt. The fabric can be reinforced in areas of particularly high tension, like the essential structural support and propulsion elements defined in the applicant's earlier applications (the base and lateral tuberosity of the calcaneus, the base of the fifth metatarsal, the heads of the metatarsals, and the first distal phalange; the reinforcement can take many forms, such as like that of corners of the jib sail of a racing sailboat or more simple straps. As closely as possible, it should have the same performance characteristics as the heavily calloused skin of the sole of an habitually bare foot. The relative density of the shoe sole is preferred as indicated in FIG. 9 of pending U.S. application Ser. No. 07/400,714, filed on Aug. 30, 1989, with the softest density nearest the foot sole, so that the conforming sides of the shoe sole do not provide a rigid destabilizing lever arm.

The change from existing art of the tension stabilized sides shown in FIG. 39 is that the shoe upper is directly integrated functionally with the shoe sole, instead of simply being attached on top of it. The advantage of the tension stabilized sides design is that it provides natural stability as close to that of the barefoot as possible, and does so economically, with the minimum shoe sole side width possible.

Figure 40:
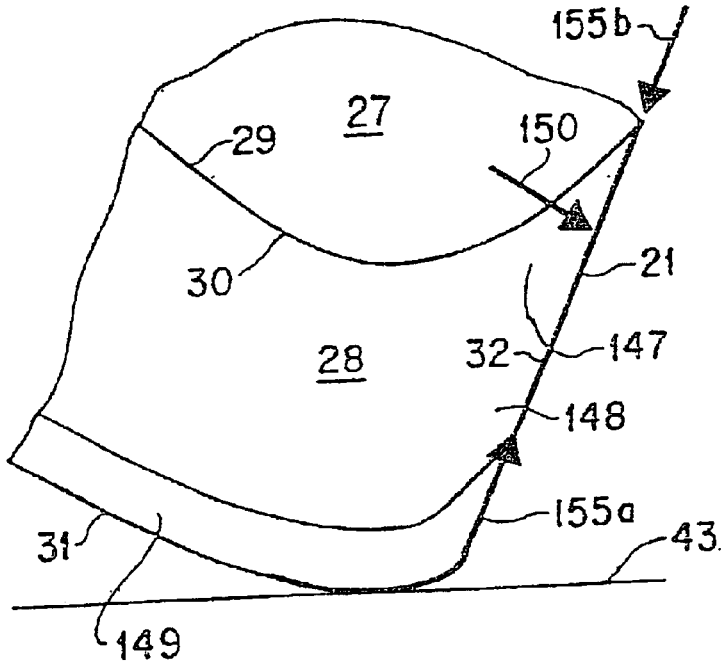

The result is a shoe sole that is naturally stabilized in the same way that the barefoot is stabilized, as seen in FIG. 40, which shows a close-up cross section of a naturally contoured design shoe sole 28 (undeformed by body weight) when tilted to the edge. The same destabilizing force against the side of the shoe shown in FIG. 36 is now stably resisted by offsetting tension in the surface of the shoe upper 21 extended down the side of the shoe sole so that it is anchored by the weight of the body when the shoe and foot are tilted.

In order to avoid creating unnatural torque on the shoe sole, the shoe uppers may be joined or bonded only to the bottom sole, not the midsole, so that pressure shown on the side of the shoe upper produces side tension only and not the destabilizing torque from pulling similar to that described in FIG. 36. However, to avoid unnatural torque, the upper areas 147 of the shoe midsole, which forms a sharp corner, should be composed of relatively soft midsole material; in this case, bonding the shoe uppers to the midsole would not create very much destabilizing torque. The bottom sole is preferably thin, at least on the stability sides, so that its attachment overlap with the shoe upper sides coincide as close as possible to the Theoretically Ideal Stability Plane, so that force is transmitted on the outer shoe sole surface to the ground.

In summary, the FIG. 39 design is for a shoe construction, including: a shoe upper that is composed of material that is flexible and relatively inelastic at least where the shoe upper contacts the areas of the structural bone elements of the human foot, and a shoe sole that has relatively flexible sides; and at least a portion of the sides of the shoe upper being attached directly to the bottom sole, while enveloping on the outside the other sole portions of said shoe sole. This construction can either be applied to convention shoe sole structures or to the applicant's prior shoe sole inventions, such as the naturally contoured shoe sole conforming to the theoretically ideal stability plane.

Figure 41:
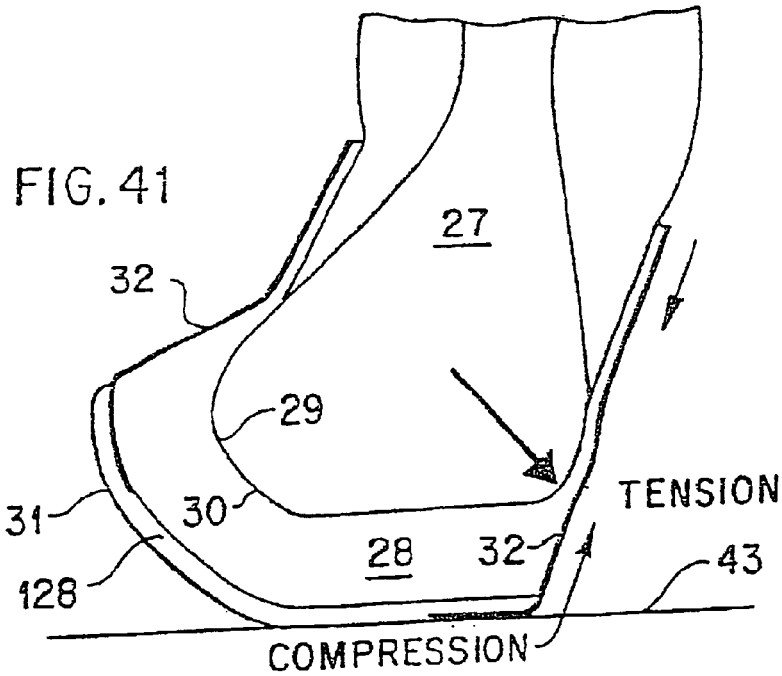

FIG. 41 shows, in cross section at the heel, the tension stabilized sides concept applied to naturally contoured design shoe sole when the shoe and foot are tilted out fully and naturally deformed by body weight (although constant shoe sole thickness is shown undeformed). The figure shows that the shape and stability function of the shoe sole and shoe uppers mirror almost exactly that of the human foot.

Figure 42A:
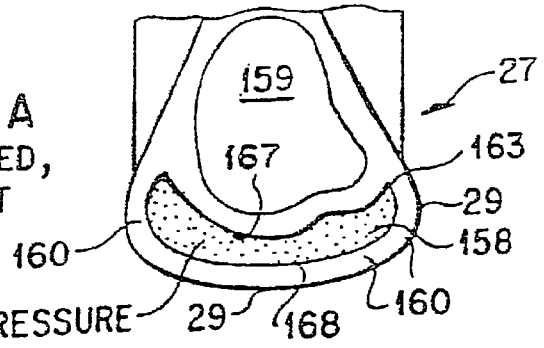

FIGS. 42A–42D show the natural cushioning of the human barefoot, in cross sections at the heel. FIG. 42A shows the bare heel upright and unloaded, with little pressure on the subcalcaneal fat pad 158, which is evenly distributed between the calcaneus 159, which is the heel bone, and the bottom sole 160 of the foot.

Figure 42B:
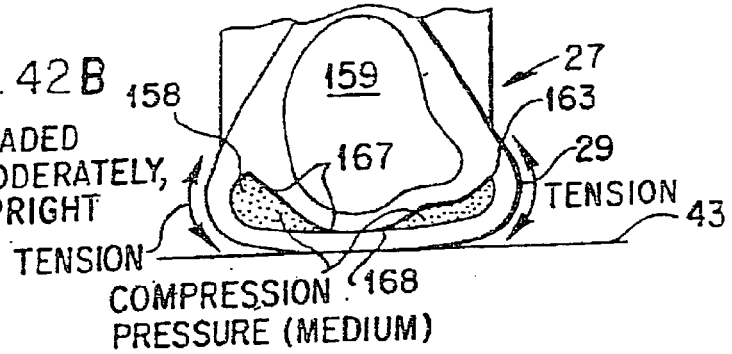

FIG. 42B shows the bare heel upright but under the moderate pressure of full body weight. The compression of the calcaneus against the subcalcaneal fat pad produces evenly balanced pressure within the subcalcaneal fat pad because it is contained and surrounded by a relatively unstretchable fibrous capsule, the bottom sole of the foot. Underneath the foot, where the bottom sole is in direct contact with the ground, the pressure caused by the calcaneus on the compressed subcalcaneal fat pad is transmitted directly to the ground. Simultaneously, substantial tension is created on the sides of the bottom sole of the foot because of the surrounding relatively tough fibrous capsule. That combination of bottom pressure and side tension is the foot's natural shock absorption system for support structures like the calcaneus and the other bones of the foot that come in contact with the ground.

Of equal functional importance is that lower surface 167 of those support structures of the foot like the calcaneus and other bones make firm contact with the upper surface 168 of the foot's bottom sole underneath, with relatively little uncompressed fat pad intervening. In effect, the support structures of the foot land on the ground and are firmly supported; they are not suspended on top of springy material in a buoyant manner analogous to a water bed or pneumatic tire, like the existing proprietary shoe sole cushioning systems like Nike Air or Asics Gel. This simultaneously firm and yet cushioned support provided by the foot sole must have a significantly beneficial impact on energy efficiency, also called energy return, and is not paralleled by existing shoe designs to provide cushioning, all of which provide shock absorption cushioning during the landing and support phases of locomotion at the expense of firm support during the take-off phase.

Figure 42C:
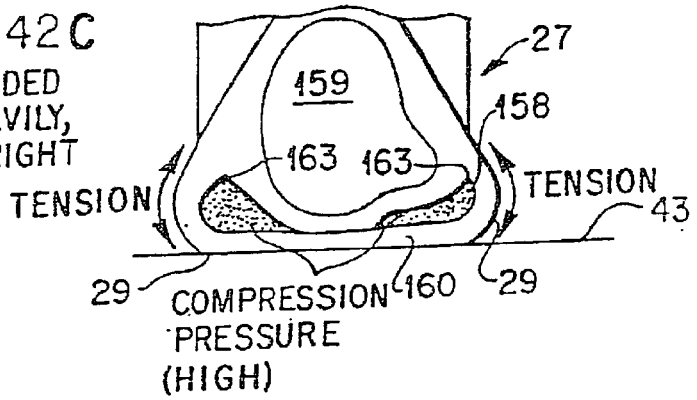

The incredible and unique feature of the foot's natural system is that, once the calcaneus is in fairly direct contact with the bottom sole and therefore providing firm support and stability, increased pressure produces a more rigid fibrous capsule that protects the calcaneus and greater tension at the sides to absorb shock. So, in a sense, even when the foot's suspension system would seem in a conventional way to have bottomed out under normal body weight pressure, it continues to react with a mechanism to protect and cushion the foot even under very much more extreme pressure. This is seen in FIG. 42C, which shows the human heel under the heavy pressure of roughly three times body weight force of landing during routine running. This can be easily verified: when one stands barefoot on a hard floor, the heel feels very firmly supported and yet can be lifted and virtually slammed onto the floor with little increase in the feeling of firmness; the heel simply becomes harder as the pressure increases.

In addition, it should be noted that this system allows the relatively narrow base of the calcaneus to pivot from side to side freely in normal pronation/supination motion, without any obstructing torsion on it, despite the very much greater width of compressed foot sole providing protection and cushioning; this is crucially important in maintaining natural alignment of joints above the ankle joint such as the knee, hip and back, particularly in the horizontal plane, so that the entire body is properly adjusted to absorb shock correctly. In contrast, existing shoe sole designs, which are generally relatively wide to provide stability, produce unnatural frontal plane torsion on the calcaneus, restricting its natural motion, and causing misalignment of the joints operating above it, resulting in the overuse injuries unusually common with such shoes. Instead of flexible sides that harden under tension caused by pressure like that of the foot, existing shoe sole designs are forced by lack of other alternatives to use relatively rigid sides in an attempt to provide sufficient stability to offset the otherwise uncontrollable buoyancy and lack of firm support of air or gel cushions.

Figure 42D:
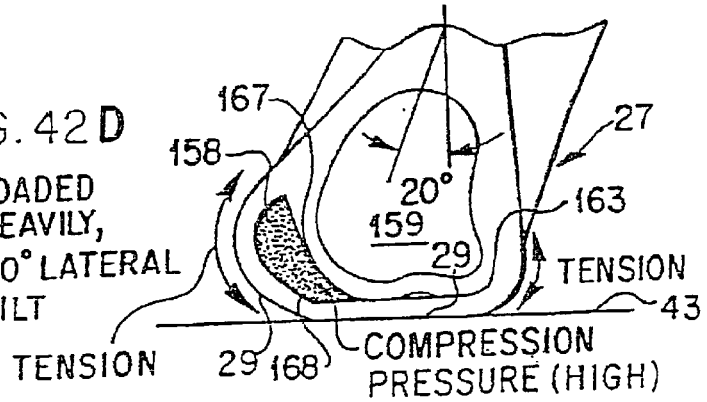
Figure 43A:
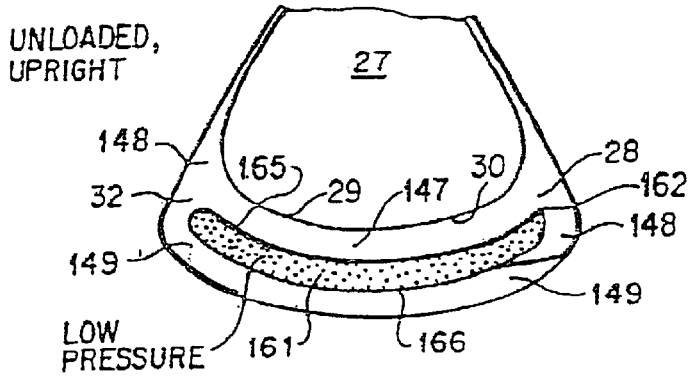
Figure 43B:
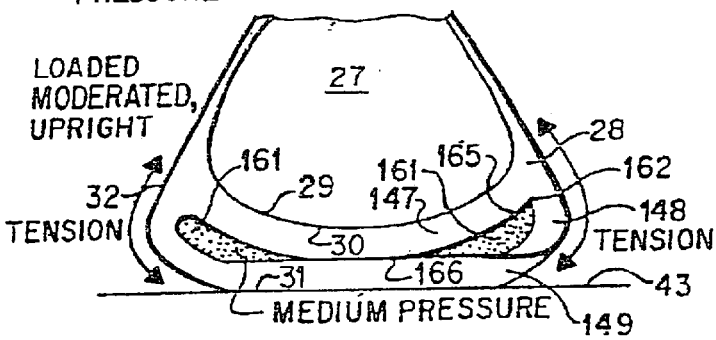
Figure 43C:
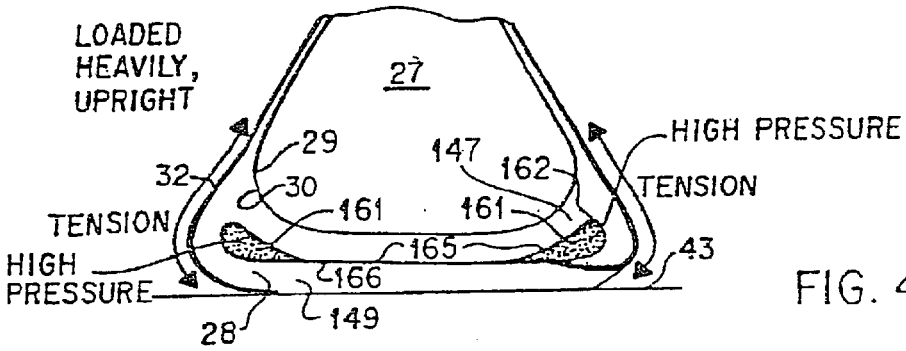
Figure 43D:
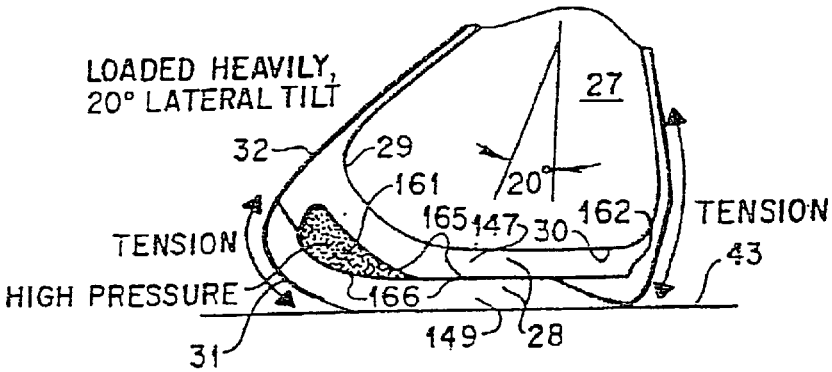

FIG. 42D shows the barefoot deformed under full body weight and tilted laterally to the roughly 20 degree limit of normal range. Again it is clear that the natural system provides both firm lateral support and stability by providing relatively direct contact with the ground, while at the same time providing a cushioning mechanism through side tension and subcalcaneal fat pad pressure.

FIGS. 43A–D show FIGS. 9B–D of the '302 application, in addition to FIG. 9 of this application.

Figure 44A:
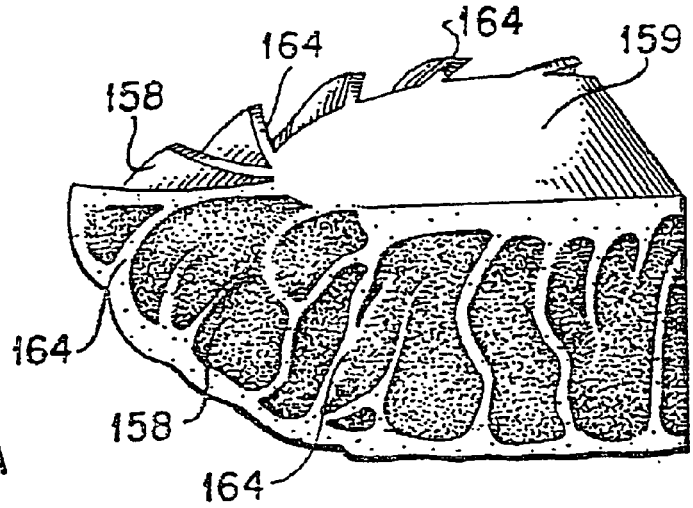
Figure 44B:
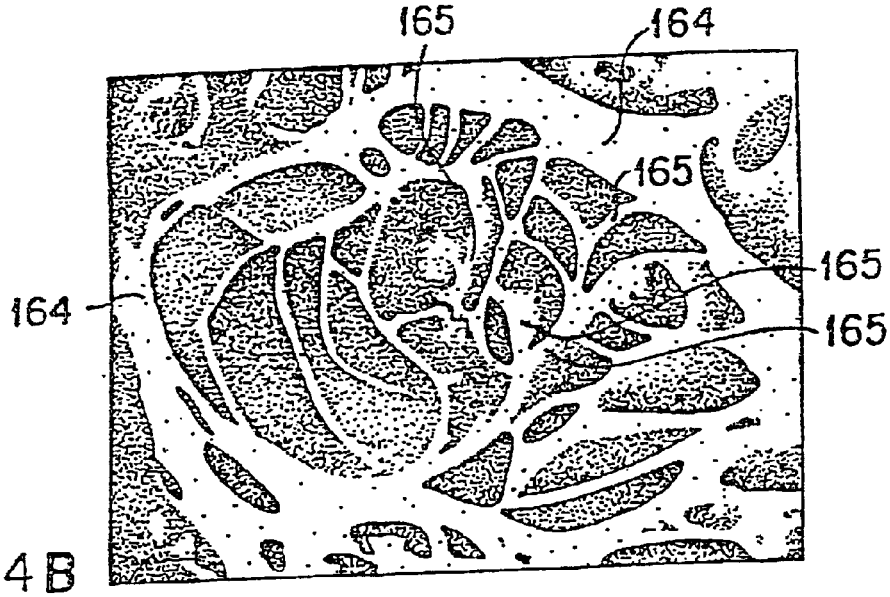
Figure 44C:
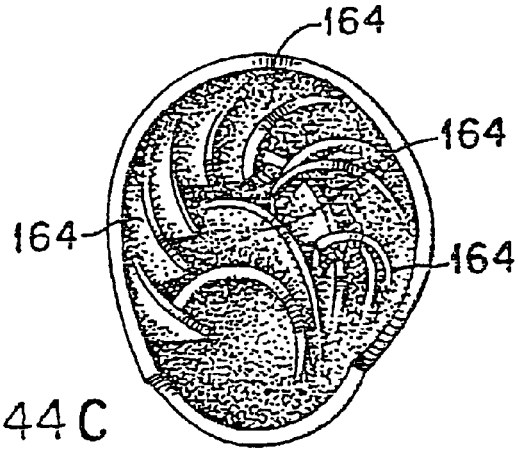

While the FIG. 9 and FIG. 43 design copies in a simplified way the macro structure of the foot, FIGS. 44 [10] A–C focus on a more on the exact detail of the natural structures, including at the micro level. FIGS. 44A and 44C are perspective views of cross sections of the human heel showing the matrix of elastic fibrous connective tissue arranged into chambers 164 holding closely packed fat cells; the chambers are structured as whorls radiating out from the calcaneus. These fibrous-tissue strands are firmly attached to the undersurface of the calcaneus and extend to the subcutaneous tissues. They are usually in the form of the letter U, with the open end of the U pointing toward the calcaneus.

As the most natural, an approximation of this specific chamber structure would appear to be the most optimal as an accurate model for the structure of the shoe sole cushioning compartments 161, at least in an ultimate sense, although the complicated nature of the design will require some time to overcome exact design and construction difficulties; however, the description of the structure of calcaneal padding provided by Erich Blechschmidt in Foot and Ankle, March, 1982, (translated from the original 1933 article in German) is so detailed and comprehensive that copying the same structure as a model in shoe sole design is not difficult technically, once the crucial connection is made that such copying of this natural system is necessary to overcome inherent weaknesses in the design of existing shoes. Other arrangements and orientations of the whorls are possible, but would probably be less optimal.

Pursuing this nearly exact design analogy, the lower surface 165 of the upper midsole 147 would correspond to the outer surface 167 of the calcaneus 159 and would be the origin of the U shaped whorl chambers 164 noted above.

FIG. 44B shows a close-up of the interior structure of the large chambers shown in FIGS. 44A and 44C. It is clear from the fine interior structure and compression characteristics of the mini-chambers 165 that those directly under the calcaneus become very hard quite easily, due to the high local pressure on them and the limited degree of their elasticity, so they are able to provide very firm support to the calcaneus or other bones of the foot sole; by being fairly inelastic, the compression forces on those compartments are dissipated to other areas of the network of fat pads under any given support structure of the foot, like the calcaneus. Consequently, if a cushioning compartment 161, such as the compartment under the heel shown in FIGS. 9 & 43, is subdivided into smaller chambers, like those shown in FIG. 44, then actual contact between the upper surface 165 and the lower surface 166 would no longer be required to provide firm support, so long as those compartments and the pressure-transmitting medium contained in them have material characteristics similar to those of the foot, as described above; the use of gas may not be satisfactory in this approach, since its compressibility may not allow adequate firmness.

In summary, the FIG. 44 design shows a shoe construction including: a shoe sole with a compartments under the structural elements of the human foot, including at least the heel; the compartments containing a pressure-transmitting medium like liquid, gas, or gel; the compartments having a whorled structure like that of the fat pads of the human foot sole; load-bearing pressure being transmitted progressively at least in part to the relatively inelastic sides, top and bottom of the shoe sole compartments, producing tension therein; the elasticity of the material of the compartments and the pressure-transmitting medium are such that normal weight-bearing loads produce sufficient tension within the structure of the compartments to provide adequate structural rigidity to allow firm natural support to the foot structural elements, like that provided the barefoot by its fat pads. That shoe sole construction can have shoe sole compartments that are subdivided into micro chambers like those of the fat pads of the foot sole.

Since the bare foot that is never shod is protected by very hard callouses (called a "seri boot") which the shod foot lacks, it seems reasonable to infer that natural protection and shock absorption system of the shod foot is adversely affected by its unnaturally undeveloped fibrous capsules (surrounding the subcalcaneal and other fat pads under foot bone support structures). A solution would be to produce a shoe intended for use without socks (ie with smooth surfaces above the foot bottom sole) that uses insoles that coincide with the foot bottom sole, including its sides. The upper surface of those insoles, which would be in contact with the bottom sole of the foot (and its sides), would be coarse enough to stimulate the production of natural barefoot callouses. The insoles would be removable and available in different uniform grades of coarseness, as is sandpaper, so that the user can progress from finer grades to coarser grades as his foot soles toughen with use.

Similarly, socks could be produced to serve the same function, with the area of the sock that corresponds to the foot bottom sole (and sides of the bottom sole) made of a material coarse enough to stimulate the production of callouses on the bottom sole of the foot, with different grades of coarseness available, from fine to coarse, corresponding to feet from soft to naturally tough. Using a tube sock design with uniform coarseness, rather than conventional sock design assumed above, would allow the user to rotate the sock on his foot to eliminate any "hot spot" irritation points that might develop. Also, since the toes are most prone to blistering and the heel is most important in shock absorption, the toe area of the sock could be relatively less abrasive than the heel area.

The following Figures are all new with this continuation-in-part application.

Figure 45A:
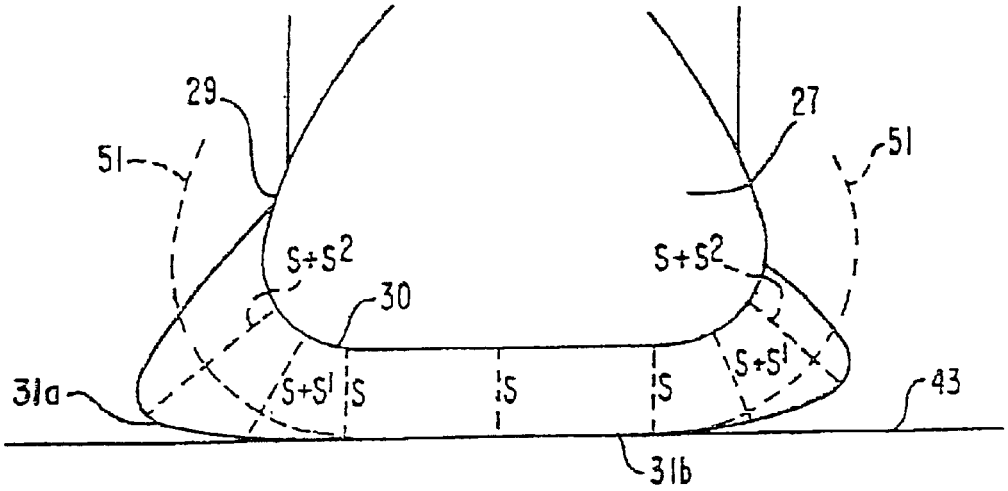

FIG. 45 is new in the continuation-in-part application, but is similar to FIG. 4 from the applicant's copending U.S. patent application Ser. No. 07/416,478, filed Oct. 3, 1989, and described above. FIG. 45 illustrates, in frontal or transverse plane cross section in the heel area, the applicant's new invention of shoe sole side thickness increasing beyond the theoretically ideal stability plane to increase stability somewhat beyond its natural level. The unavoidable trade-off resulting is that natural motion would be restricted somewhat and the weight of the shoe sole would increase somewhat. For purposes of illustration, the right side of FIG. 45 shows roughly a 50 percent thickness increase over the theoretically ideal stability plane 51 and the left side shows roughly a 100 percent increase.

FIG. 45 shows a situation wherein the thickness of the sole at each of the opposed sides is thicker at the portions of the sole 31*a* by a thickness which gradually varies continuously from a thickness (s) through a thickness (s+s1), to a thickness (s+s2).

These designs recognize that lifetime use of existing shoes, the design of which has an inherent flaw that continually disrupts natural human biomechanics, has produced thereby actual structural changes in a human foot and ankle to an extent that must be compensated for. Specifically, one of the most common of the abnormal effects of the inherent existing flaw is a weakening of the long arch of the foot, increasing pronation. These designs therefore modify the applicant's preceding designs to provide greater than natural stability and should be particularly useful to individuals, generally with low arches, prone to pronate excessively, and could be used only on the medial side. Similarly, individuals with high arches and a tendency to over supinate and lateral ankle sprains would also benefit, and the design could be used only on the lateral side. A shoe for the general population that compensates for both weaknesses in the same shoe would incorporate the enhanced stability of the design compensation on both sides.

The new design in FIG. 45 (like FIGS. 1 and 2 of the '478 application) allows the shoe sole to deform naturally closely paralleling the natural deformation of the barefoot under load; in addition, shoe sole material must be of such composition as to allow the natural deformation following that of the foot.

The new designs retain the essential novel aspect of the earlier designs; namely, contouring the shape of the shoe sole to the shape of the human foot. The difference is that the shoe sole thickness in the frontal plane is allowed to vary rather than remain uniformly constant. More specifically, FIG. 45 (and FIGS. 5, 6, 7, and 11 of the '478 application) show, in frontal plane cross sections at the heel, that the shoe sole thickness can increase beyond the theoretically ideal stability plane 51, in order to provide greater than natural stability. Such variations (and the following variations) can be consistent through all frontal plane cross sections, so that there are proportionately equal increases to the theoretically ideal stability plane 51 from the front of the shoe sole to the back, or that the thickness can vary, preferably continuously, from one frontal plane to the next.

The exact amount of the increase in shoe sole thickness beyond the theoretically ideal stability plane is to be determined empirically. Ideally, right and left shoe soles would be custom designed for each individual based on an biomechanical analysis of the extent of his or her foot and ankle disfunction in order to provide an optimal individual correction. If epidemiological studies indicate general corrective patterns for specific categories of individuals or the population as a whole, then mass-produced corrective shoes with soles incorporating contoured sides exceeding the theoretically ideal stability plane would be possible.

Research in the a newly developing scientific field, theoretical human anatomy, indicates unexpected results that the extent of human anatomical structural deformity due to the adverse biomechanical performance of existing footwear is significantly more substantial than might be expected and extends to skeletal, muscular, and other human structures beyond the foot and ankle joint. It appears that knee, hip, and lower back are directly affected, with the entire spinal column thus also affected, and therefore indeed most of the rest of the human body affected as well.

As a consequence of careful review of the implications for shoe sole design based on this surprising discovery, mass-produced corrective shoes for the general population, in some cases, would require unexpectedly the use of contoured side portion thicknesses exceeding the theoretically ideal stability plane by an amount as much as 26 percent to 50 percent, preferably at least in that part of the contoured side which becomes load-bearing under a wearer's body weight during the full range of foot inversion and eversion, which is sideways or lateral foot motion. It is also apparent that some more specific groups or individuals with more severe disfunction could have an empirically demonstrated need for greater corrective thicknesses of the contoured side portion on the order of 51 to 100 percent more than the theoretically ideal stability plane, again, preferably at least in that part of the contoured side which becomes wearer's body weight load-bearing during the full range of inversion and eversion, which is sideways or lateral foot motion. The optimal contour for the increased contoured side thickness may also be determined empirically.

In addition, these extreme modifications of the theoretically ideal stability plane result in shoe sole embodiments with better biomechanical performance in terms of stability and freedom of motion, and comfort, than existing shoes, even for individual wearers with completely normal anatomical structure.

As described in the earlier '478 Application, in its simplest conceptual form, the applicant's FIG. 4 and this new FIG. 45 invention are the structure of a conventional shoe sole that has been modified by having its sides bent up so that their inner surface conforms to a shape of the outer surface of the foot sole of the wearer (instead of the shoe sole sides conforming to the ground by paralleling it, as is conventional); this concept is like that described in FIG. 3 of the applicant's Ser. No. 07/239,667 application. For the applicant's fully contoured design described in FIG. 15 of the '667 application, the entire shoe sole—including both the sides and the portion directly underneath the foot—is bent up to conform to a shape nearly identical but slightly smaller than the contoured shape of the unloaded foot sole of the wearer, rather than the partially flattened load-bearing foot sole shown in FIG. 45.

This theoretical or conceptual bending up must be accomplished in practical manufacturing without any of the puckering distortion or deformation that would necessarily occur if such a conventional shoe sole were actually bent up simultaneously along all of its the sides; consequently, manufacturing techniques that do not require any bending up of shoe sole material, such as injection molding manufacturing of the shoe sole, would be required for optimal results and therefore is preferable.

It is critical to the novelty of this fundamental concept that all layers of the shoe sole in FIG. 45 are bent up around the foot sole. A small number of both street and athletic shoe soles that are commercially available are naturally contoured to a limited extent in that only their bottom soles, which are about one quarter to one third of the total thickness of the entire shoe sole, are wrapped up around portions of the wearers' foot soles; the midsole and heel lift (or heel) of such shoe soles, constituting over half of the thickness of the entire shoe sole, remains flat, conforming to the ground rather than the wearers' feet. (At the other extreme, some shoes in the existing art have flat midsoles and bottom soles, but have insoles that conform to the wearer's foot sole.)

Consequently, in existing contoured shoe soles, the total shoe sole thickness of the contoured side portions, including every layer or portion, is much less than the total thickness of the sole portion directly underneath the foot, whereas in the applicant's '478 shoe sole invention the shoe sole thickness of the contoured side portions are at least similar to the thickness of the sole portion directly underneath the foot, meaning a thickness variation of up to 25 percent, as measured in frontal or transverse plane cross sections.

New FIG. 45 of this continuation-in-part application explicitly defines those thickness variations, as measured in frontal or transverse plane cross sections, of the applicant's shoe soles from 26 percent up to 50 percent, which distinguishes over all known prior art.

In addition, for shoe sole thickness deviating outwardly in a constructive way from the theoretically ideal stability plane, the shoe sole thickness variation of the applicant's shoe soles is increased in this application from 51 percent to 100 percent, as measured in frontal or transverse plane cross sections.

The FIG. 45 invention, and all previous and following figures included in this application, can be used at any one, or combination including all, of the essential structural support and propulsion elements defined in the '819 Patent. Those elements are the base and lateral tuberosity of the calcaneus, the heads of the metatarsals, and the base of the fifth metatarsal, and the head of the first distal phalange, respectively. Of the metatarsal heads, only the first and fifth metatarsal heads are proximate to the contoured shoe sole sides.

This major and conspicuous structural difference between the applicant's underlying concept and the existing shoe sole art is paralleled by a similarly dramatic functional difference between the two: the aforementioned similar thickness of the applicant's shoe sole invention maintains intact the firm lateral stability of the wearer's foot, as demonstrated when the foot is unshod and tilted out laterally in inversion to the extreme limit of the normal range of motion of the ankle joint of the foot; in a similar demonstration in a conventional shoe sole, the wearer's foot and ankle are unstable. The sides of the applicant's shoe sole invention extend sufficiently far up the sides of the wearer's foot sole to maintain the lateral stability of the wearer's foot when bare.

In addition, the applicant's shoe sole invention maintains the natural stability and natural, uninterrupted motion of the wearer's foot when bare throughout its normal range of sideways pronation and supination motion occurring during all load-bearing phases of locomotion of the wearer, including when the wearer is standing, walking, jogging, and running, even when said foot is tilted to the extreme limit of that normal range, in contrast to unstable and inflexible conventional shoe soles, including the partially contoured existing art described above. The sides of the applicant's shoe sole invention extend sufficiently far up the sides of the wearer's foot sole to maintain the natural stability and uninterrupted motion of the wearer's foot when bare. The exact thickness of the shoe sole sides and their specific contour will be determined empirically for individuals and groups using standard biomechanical techniques of gait analysis to determine those combinations that best provide the barefoot stability described above.

For the FIG. 45 shoe sole invention, the amount of any shoe sole side portions coplanar with the theoretically ideal stability plane is determined by the degree of shoe sole stability desired and the shoe sole weight and bulk required to provide said stability; the amount of said coplanar contoured sides that is provided said shoe sole being sufficient to maintain intact the firm stability of the wearer's foot throughout the range of foot inversion and eversion motion typical of the use for which the shoe is intended and also typical of the kind of wearer—such as normal or excessive pronator—for which said shoe is intended.

In general, the applicant's preferred shoe sole embodiments include the structural and material flexibility to deform in parallel to the natural deformation of the wearer's foot sole as if it were bare and unaffected by any of the abnormal foot biomechanics created by rigid conventional shoe sole.

At the same time, the applicant's preferred shoe sole embodiments are sufficiently firm to provide the wearer's foot with the structural support necessary to maintain normal pronation and supination, as if the wearer's foot were bare; in contrast, the excessive softness of many of the shoe sole materials used in shoe soles in the existing art cause abnormal foot pronation and supination.

As mentioned earlier regarding FIG. 1A, the applicant has previously shown heel lifts with constant frontal or transverse plane thickness, since it is oriented conventionally in alignment with the frontal or transverse plane and perpendicular to the long axis of the shoe sole. However, the heel wedge (or toe taper or other shoe sole thickness variations in the sagittal plane along the long axis of the shoe sole) can be located at an angle to the conventional alignment in the FIG. 45 design.

For example, the heel wedge can be located perpendicular to the subtalar axis, which is located in the heel area generally about 20 to 25 degrees medially, although a different angle can be used base on individual or group testing; such a orientation may provide better, more natural support to the subtalar joint, through which critical pronation and supination motion occur. The applicant's theoretically ideal stability plane concept would teach that such a heel wedge orientation would require constant shoe sole thickness in a vertical plane perpendicular to the chosen subtalar joint axis, instead of the frontal plane.

In addition, any of the above described thickness variations from a theoretically ideal stability plane can be used together with any of the below described density or bottom sole design variations. All portions of the shoe sole are included in thickness and density measurement, including the sockliner or insole, the midsole (including heel lift or other thickness variation measured in the sagittal plane) and bottom or outer sole.

The above described thickness of FIG. 45 and below described thickness and density variations apply to the load-bearing portions of the contoured sides of the applicant's shoe sole inventions, the side portion being identified in FIG. 4 of the '819 Patent. Thickness and density variations described above are measured along the contoured side portion. The side portion of the fully contoured design introduced in the '819 Patent in FIG. 15 cannot be defined as explicitly, since the bottom portion is contoured like the sides, but should be measured by estimating the equivalent FIG. 4 figure; generally, like FIG. 14 and FIG. 15 of the '819 Patent, assuming the flattened sole portion shown in FIG. 14 corresponds to a load-bearing equivalent of FIG. 15, so that the contoured sides of FIG. 14 and FIG. 15 are essentially the same.

Alternately, the thickness and density variations described above can be measured from the center of the essential structural support and propulsion elements defined in the '819 Patent. Those elements are the base and lateral tuberosity of the calcaneus, the heads of the metatarsals, and the base of the fifth metatarsal, and the head of the first distal phalange, respectively. Of the metatarsal heads, only the first and fifth metatarsal heads are used for such measurement, since only those two are located on lateral portions of the foot and thus proximate to contoured stability sides of the applicant's shoe sole.

Figure 46:
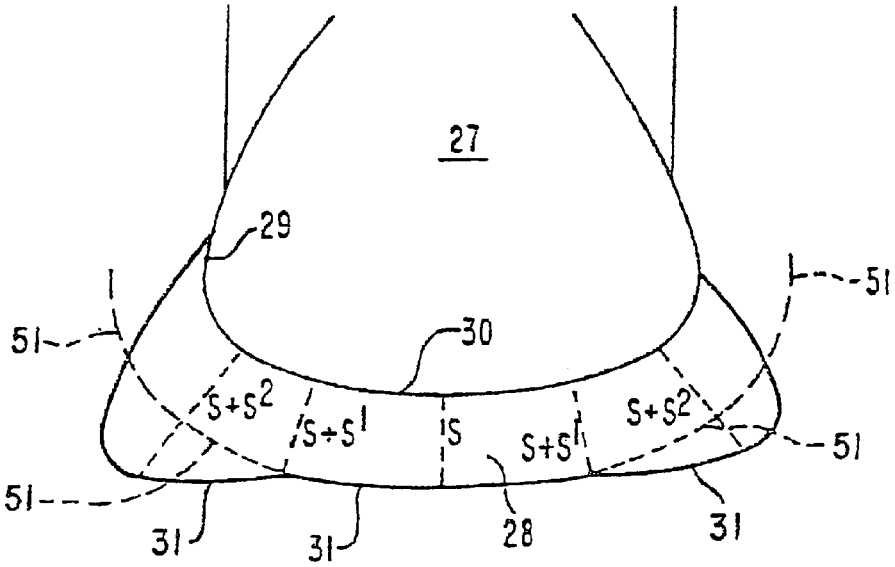

FIG. 46 is similar to FIG. 5 in the applicant's copending U.S. patent application Ser. No. 07/416,478, but including the shoe sole thickness variations as described in FIG. 45 above. FIG. 46 shows, in frontal or transverse plane cross section in the heel area, a variation of the enhanced fully contoured design wherein the shoe sole begins to thicken beyond the theoretically ideal stability plane 51 at the contoured sides portion, preferably at least in that part of the contoured side which becomes wearer's body weight load-bearing during the full range of inversion and eversion, which is sideways or lateral foot motion. For purposes of illustration, the right side of FIG. 46 shows roughly a 50 percent thickness increase over the theoretically ideal stability plane 51 and the left side shows roughly a 100 percent increase.

Figure 47:
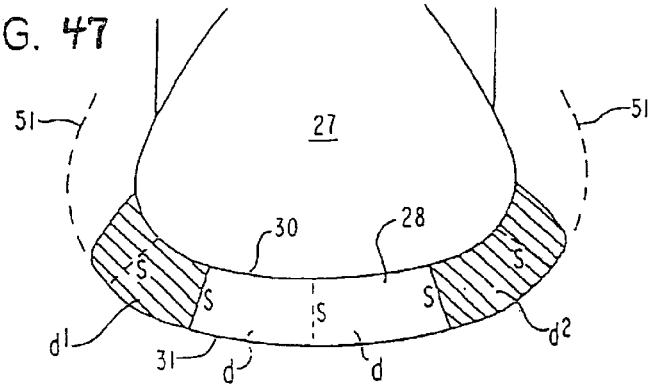

FIG. 47 is similar to FIG. 6 of the parent '598 application, which is FIG. 10 in the applicant's copending '478 Application and shows, in frontal or transverse plane cross section in the heel area, that similar variations in shoe midsole (other portions of the shoe sole area not shown) density can provide similar but reduced effects to the variations in shoe sole thickness described previously in FIGS. 4 and 5. The major advantage of this approach is that the structural theoretically ideal stability plane is retained, so that naturally optimal stability and efficient motion are retained to the maximum extent possible. The more extreme constructive density variations of FIG. 47 are, as most typically measured in durometers on a Shore A scale, to include from 26 percent to 50 percent and from 51 percent up to 200 percent. The density variations are located preferably at least in that part of the contoured side which becomes wearer's body weight load-bearing during the full range of inversion and eversion, which is sideways or lateral foot motion.

The '478 Application showed midsole only, since that is where material density variation has historically been most common. Density variations can and do, of course, also occur in other layers of the shoe sole, such as the bottom sole and the inner sole, and can occur in any combination and in symmetrical or asymmetrical patterns between layers or between frontal or transverse plane cross sections.

The major and conspicuous-structural difference between the applicant's underlying concept and the existing shoe sole art is paralleled by a similarly dramatic functional difference between the two: the aforementioned similar thickness of the applicant's shoe sole invention maintains intact the firm lateral stability of the wearer's foot, as demonstrated when the foot is unshod and tilted out laterally in inversion to the extreme limit of the normal range of motion of the ankle joint of the foot; in a similar demonstration in a conventional shoe sole, the wearer's foot and ankle are unstable. The sides of the applicant's shoe sole invention extend sufficiently far up the sides of the wearer's foot sole to maintain the lateral stability of the wearer's foot when bare.

In addition, the applicant's shoe sole invention maintains the natural stability and natural, uninterrupted motion of the wearer's foot when bare throughout its normal range of sideways pronation and supination motion occurring during all load-bearing phases of locomotion of the wearer, including when the wearer is standing, walking, jogging and running, even when said foot is tilted to the extreme limit of that normal range, in contrast to unstable and inflexible conventional shoe soles, including the partially contoured existing art described above. The sides of the applicant's shoe sole invention extend sufficiently far up the sides of the wearer's foot sole to maintain the natural stability and uninterrupted motion of the wearer's foot when bare. The exact material density of the shoe sole sides will be determined empirically for individuals and groups using standard biomechanical techniques of gait analysis to determine those combinations that best provide the barefoot stability described above.

For the FIG. 47 shoe sole invention, the amount of any shoe sole side portions coplanar with the theoretically ideal stability plane is determined by the degree of shoe sole stability desired and the shoe sole weight and bulk required to provide said stability; the amount of said coplanar contoured sides that is provided said shoe sole being sufficient to maintain intact the firm stability of the wearer's foot throughout the range of foot inversion and eversion motion typical of the use for which the shoe is intended and also typical of the kind of wearer—such as normal or excessive pronator—for which said shoe is intended.

In general, the applicant's preferred shoe sole embodiments include the structural and material flexibility to deform in parallel to the natural deformation of the wearer's foot sole as if it were bare and unaffected by any of the abnormal foot biomechanics created by rigid conventional shoe sole.

At the same time, the applicant's preferred shoe sole embodiments are sufficiently firm to provide the wearer's foot with the structural support necessary to maintain normal pronation and supination, as if the wearer's foot were bare; in contrast, the excessive softness of many of the shoe sole materials used in shoe soles in the existing art cause abnormal foot pronation and supination.

As mentioned earlier regarding FIG. 1A, the applicant has previously shown heel lifts with constant frontal or transverse plane thickness, since it is oriented conventionally in alignment with the frontal or transverse plane and perpendicular to the long axis of the shoe sole. However, the heel wedge (or toe taper or other shoe sole thickness variations in the sagittal plane along the long axis of the shoe sole) can be located at an angle to the conventional alignment in the FIG. 4 design.

For example, the heel wedge can be located perpendicular to the subtalar axis, which is located in the heel area generally about 20 to 25 degrees medially, although a different angle can be used base on individual or group testing; such a orientation may provide better, more natural support to the subtalar joint, through which critical pronation and supination motion occur. The applicant's theoretically ideal stability plane concept would teach that such a heel wedge orientation would require constant shoe sole thickness in a vertical plane perpendicular to the chosen subtalar joint axis, instead of the frontal plane.

FIG. 48 is similar to FIG. 7 of the parent '598 application, but with more the extreme thickness variation similar to FIG. 45 above. FIG. 48 is like FIG. 7, which is FIG. 14B of the applicant's '478 Application and shows, in frontal or transverse plane cross sections in the heel area, embodiments like those in FIG. 4 through 6 but wherein a portion of the shoe sole thickness is decreased to less than the theoretically ideal stability plane, the amount of the thickness variation as defined for FIG. 45 above, except that the most extreme maximum inwardly variation is 41 to 50 percent, and the more typical maximum inwardly thickness variation would be 26 to 40 percent, preferably at least in that part of the contoured side which becomes wearer's body weight load-bearing during the full range of inversion and eversion, which is sideways or lateral foot motion. For purposes of illustration, the right side of FIG. 48 shows a thickness reduction of approximately 40 percent and the left side a reduction of approximately 50 percent.

It is anticipated that some individuals with foot and ankle biomechanics that have been degraded by existing shoes may benefit from such embodiments, which would provide less than natural stability but greater freedom and motion, and less shoe sole weight and bulk. FIG. 7 shows a embodiment like the fully contoured design in FIG. 5, but with a show sole thickness decreasing with increasing distance from the center portion of the sole.

FIG. 49 is similar to FIG. 8 of the parent '598 application which was FIG. 13 of the '478 Application and shows, in frontal or transverse plane cross section, a bottom sole tread design that provides about the same overall shoe sole density variation as that provided in FIG. 6 by midsole density variation. The less supporting tread there is under any particular portion of the shoe sole, the less effective overall shoe density there is, since the midsole above that portion will deform more easily than if it were fully supported. FIG. 49 shows more extreme shoe sole tread design, roughly equivalent to the structural changes in shoe sole thickness and/or density described in FIGS. 45–48 above.

FIG. 49, like FIG. 8 from the '478, is illustrative of the applicant's point that bottom sole tread patterns, just like midsole or bottom sole or inner sole density, directly affect the actual structural support the foot receives from the shoe sole. Not shown, but a typical example in the real world, is the popular "center of pressure" tread pattern, which is like a backward horseshoe attached to the heel that leaves the heel area directly under the calcaneus unsupported by tread, so that all of the weight bearing load in the heel area is transmitted to outside edge treads. Variations of this pattern are extremely common in athletic shoes and are nearly universal in running shoes, of which the 1991 Nike 180 model and the Avia "cantilever" series are examples.

Like the applicant's '478 shoe sole invention, the FIG. 49 invention can, therefore, utilize bottom sole tread patterns like any these common examples, together or even in the absence of any other shoe sole thickness or density variation, to achieve an effective thickness greater than the theoretically ideal stability plane, in order to achieve greater stability than the shoe sole would otherwise provide, as discussed earlier under FIGS. 4–6.

Since shoe bottom or outer sole tread patterns can be fairly irregular and/or complex and can thus make difficult the measurement of the outer load-bearing surface of the shoe sole. Consequently, thickness variations in small portions of the shoe sole that will deform or compress without significant overall resistance under a wearer's body weight load to the thickness of the overall load-bearing plane of the shoe out sole should be ignored during measurement, whether such easy deformation is made possible by very high point pressure or by the use of relatively compressible outsole (or underlying midsole) materials.

Portions of the outsole bottom surface composed of materials (or made of a delicate structure, much like the small raised markers on new tire treads to prove the tire is brand new and unused) that wear relatively quickly, so that thickness variations that exist when the shoe sole is new and unused, but disappear quickly in use, should also be ignored when measuring shoe sole thickness in frontal or transverse plane cross sections. Similarly, midsole thickness variations of unused shoe soles due to the use of materials or structures that compact or expand quickly after use should also be ignore when measuring shoe sole thickness in frontal or transverse plane cross sections.

The applicant's shoe sole invention maintains intact the firm lateral stability of the wearer's foot, that stability as demonstrated when the foot is unshod and tilted out laterally in inversion to the extreme limit of the normal range of motion of the ankle joint of the foot. The sides of the applicant's shoe sole invention extend sufficiently far up the sides of the wearer's foot sole to maintain the lateral stability of the wearer's foot when bare.

In addition, the applicant's shoe sole invention maintains the natural stability and natural, uninterrupted motion of the wearer's foot when bare throughout its normal range of sideways pronation and supination motion occurring during all load-bearing phases of locomotion of the wearer, including when the wearer is standing, walking, jogging and running, even when the foot is tilted to the extreme limit of that normal range, in contrast to unstable and inflexible conventional shoe soles, including the partially contoured existing art described above. The sides of the applicant's shoe sole invention extend sufficiently far up the sides of the wearer's foot sole to maintain the natural stability and uninterrupted motion of the wearer's foot when bare. The exact thickness and material density of the bottom sole tread, as well as the shoe sole sides and their specific contour, will be determined empirically for individuals and groups using standard biomechanical techniques of gait analysis to determine those combinations that best provide the barefoot stability described above.

Figure 50:
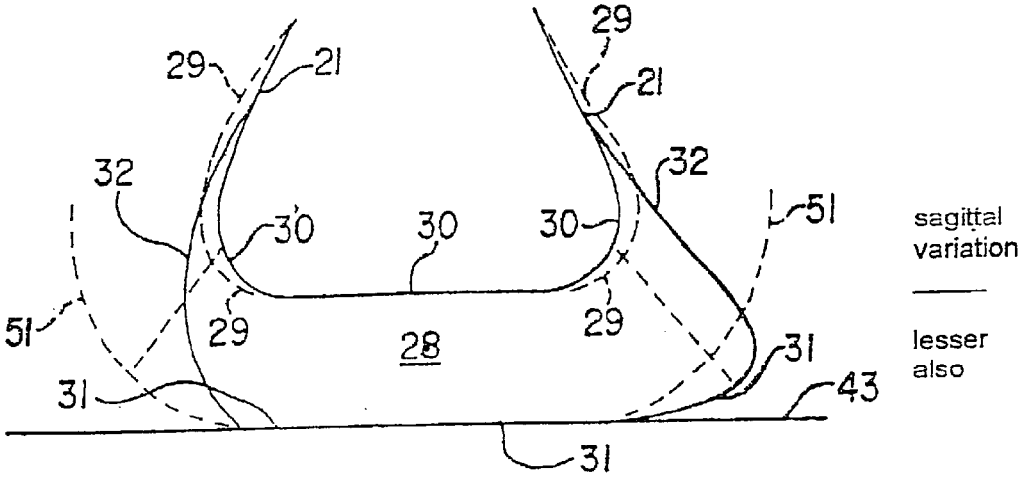

FIG. 50 is similar to FIG. 10, which was new with the '598 application and which was a combination of the shoe sole structure concepts of FIG. 3 and FIG. 4; it combines the custom fit design with the contoured sides greater than the theoretically ideal stability plane. It would apply as well to the FIG. 7 design with contoured sides less than the theoretically ideal stability plane, but that combination is not shown. It would also apply to the FIG. 8 design, which shows one of a typical bottom sole tread designs, but that combination is also not shown.

In this continuation-in-part application, the use of this invention with otherwise conventional shoes with a side sole portion of any thickness, including contoured sides with uniform or any other thickness variation or density variation, including bottom sole tread variation, especially including those defined above and below by the applicant, is further clarified. For purposes of illustration, the right side of FIG. 50 shows a shoe sole thickness increase variation of nearly 50 percent, while the left side shows a thickness reduction of about over 60 percent.

While the FIG. 3 custom fit invention is novel for shoe sole structures as defined by the theoretically ideal stability plane, which specifies constant shoe sole thickness in frontal or transverse plane, the FIG. 3 custom fit invention is also novel for shoe sole structures with sides that exceed the theoretically ideal stability plane: that is, a shoe sole with thickness greater in the sides than underneath the foot. It would also be novel for shoe sole structures with sides that are less than the theoretically ideal stability plane, within the parameters defined in the '714 application. And it would be novel for a shoe sole structure that provides stability like the barefoot, as described in FIGS. 1 and 2 of the '714 application.

In its simplest conceptual form, the applicant's invention is the structure of a conventional shoe sole that has been modified by having its sides bent up so that their inner surface conforms to a shape nearly identical but slightly smaller than the shape of the outer surface of the foot sole of the wearer (instead of the shoe sole sides conforming to the ground by paralleling it, as is conventional); this concept is like that described in FIG. 3 of the applicant's Ser. No. 07/239,667 application. For the applicant's fully contoured design described in FIG. 15 of the '667 Application, the entire shoe sole—including both the sides and the portion directly underneath the foot—is bent up to conform to a shape nearly identical but slightly smaller than the contoured shape of the unloaded foot sole of the wearer, rather than the partially flattened load-bearing foot sole shown in FIG. 3.

This theoretical or conceptual bending up must be accomplished in practical manufacturing without any of the puckering distortion or deformation that would necessarily occur if such a conventional shoe sole were actually bent up simultaneously along all of its the sides; consequently, manufacturing techniques that do not require any bending up of shoe sole material, such as injection molding manufacturing of the shoe sole, would be required for optimal results and therefore is preferable.

It is critical to the novelty of this fundamental concept that all layers of the shoe sole are bent up around the foot sole. A small number of both street and athletic shoe soles that are commercially available are naturally contoured to a limited extent in that only their bottom soles, which are about one quarter to one third of the total thickness of the entire shoe sole, are wrapped up around portions of the wearers' foot soles; the midsole and heel lift (or heel) of such shoe soles, constituting over half of the thickness of the entire shoe sole, remains flat, conforming to the ground rather than the wearers' feet. (At the other extreme, some shoes in the existing art have flat midsoles and bottom soles, but have insoles that conform to the wearer's foot sole.)

Consequently, in existing contoured shoe soles, the total shoe sole thickness of the contoured side portions, including every layer or portion, is much less than the total thickness of the sole portion directly underneath the foot, whereas in the applicant's prior shoe sole inventions the shoe sole thickness of the contoured side portions are at least similar to the thickness of the sole portion directly underneath the foot, meaning a thickness variation of up to either 50 percent or 100 percent or regardless of contoured side thickness so long as side of some thickness conforms or is at least complementary to the shape of the wearer's foot sole when the shoe sole is on the wearer's foot sole, as measured in frontal or transverse plane cross sections.

This major and conspicuous structural difference between the applicant's underlying concept and the existing shoe sole art is paralleled by a similarly dramatic functional difference between the two: the aforementioned similar thickness of the applicant's shoe sole invention maintains intact the firm lateral stability of the wearer's foot, that stability as demonstrated when the wearer's foot is unshod and tilted out laterally in inversion to the extreme limit of the normal range of motion of the ankle joint of the foot; in a similar demonstration in a conventional shoe sole, the wearer's foot and ankle are unstable. The sides of the applicant's shoe sole invention extend sufficiently far up the sides of the wearer's foot sole to maintain the lateral stability of the wearer's foot when bare.

In addition, the applicant's invention maintains the natural stability and natural, uninterrupted motion of the foot when bare throughout its normal range of sideways pronation and supination motion occurring during all load-bearing phases of locomotion of the wearer, including when said wearer is standing, walking, jogging and running, even when the foot is tilted to the extreme limit of that normal range, in contrast to unstable and inflexible conventional shoe soles, including the partially contoured existing art described above. The sides of the applicant's shoe sole invention extend sufficiently far up the sides of the wearer's foot sole to maintain the natural stability and uninterrupted motion of the wearer's foot when bare. The exact thickness and material density of the shoe sole sides and their specific contour will be determined empirically for individuals and groups using standard biomechanical techniques of gait analysis to determine those combinations that best provide the barefoot stability described above.

For the FIG. 50 shoe sole invention, the amount of any shoe sole side portions coplanar with the theoretically ideal stability plane is determined by the degree of shoe sole stability desired and the shoe sole weight and bulk required to provide said stability; the amount of said coplanar contoured sides that is provided said shoe sole being sufficient to maintain intact the firm stability of the wearer's foot throughout the range of foot inversion and eversion motion typical of the use for which the shoe is intended and also typical of the kind of wearer—such as normal or as excessive pronator—for which said shoe is intended.

Finally, the shoe sole sides are sufficiently flexible to bend out easily when the shoes are put on the wearer's feet and therefore the shoe soles gently hold the sides of the wearer's foot sole when on, providing the equivalent of custom fit in a mass-produced shoe sole. In general, the applicant's preferred shoe sole embodiments include the structural and material flexibility to deform in parallel to the natural deformation of the wearer's foot sole as if it were bare and unaffected by any of the abnormal foot biomechanics created by rigid conventional shoe sole.

At the same time, the applicant's preferred shoe sole embodiments are sufficiently firm to provide the wearer's foot with the structural support necessary to maintain normal pronation and supination, as if the wearer's foot were bare; in contrast, the excessive softness of many of the shoe sole materials used in shoe soles in the existing art cause abnormal foot pronation and supination.

As mentioned earlier regarding FIG. 1A and FIG. 3, the applicant has previously shown heel lift with constant frontal or transverse plane thickness, since it is oriented conventionally in alignment with the frontal or transverse plane and perpendicular to the long axis of the shoe sole. However, the heel wedge (or toe taper or other shoe sole thickness variations in the sagittal plane along the long axis of the shoe sole) can be located at an angle to the conventional alignment in the FIG. 45 invention.

For example, the heel wedge can be located perpendicular to the subtalar axis, which is located in the heel area generally about 20 to 25 degrees medially, although a different angle can be used base on individual or group testing; such a orientation may provide better, more natural support to the subtalar joint, through which critical pronation and supination motion occur. The applicant s theoretically ideal stability plane concept would teach that such a heel wedge orientation would require constant shoe sole thickness in a vertical plane perpendicular to the chosen subtalar joint axis, instead of the frontal plane.

Besides providing a better fit, the intentional undersizing of the flexible shoe sole sides allows for simplified design of shoe sole lasts, since the shoe last needs only to be approximate to provide a virtual custom fit, due to the flexible sides. As a result, the undersized flexible shoe sole sides allow the applicant's FIG. 50 shoe sole invention based on the theoretically ideal stability plane to be manufactured in relatively standard sizes in the same manner as are shoe uppers, since the flexible shoe sole sides can be built on standard shoe lasts, even though conceptually those sides conform to the specific shape of the individual wearer's foot sole, because the flexible sides bend to so conform when on the wearer's foot sole.

FIG. 50 shows the shoe sole structure when not on the foot of the wearer; the dashed line 29 indicates the position of the shoe last, which is assumed to be a reasonably accurate approximation of the shape of the outer surface of the wearer's foot sole, which determines the shape of the theoretically ideal stability plane 51. Thus, the dashed lines 29 and 51 show what the positions of the inner surface 30 and outer surface 31 of the shoe sole would be when the shoe is put on the foot of the wearer.

The FIG. 50 invention provides a way make the inner surface 30 of the contoured shoe sole, especially its sides, conform very closely to the outer surface 29 of the foot sole of a wearer. It thus makes much more practical the applicant's earlier underlying naturally contoured designs shown in FIGS. 4 and 5. The shoe sole structures shown in FIG. 4 and 5, then, are similar to what the FIG. 50 shoe sole structure would be when on the wearer's load-bearing foot, where the inner surface 30 of the shoe upper is bent out to virtually coincide with the outer surface of the foot sole of the wearer 29 (the figures in this and prior applications show one line to emphasize the conceptual coincidence of what in fact are two lines; in real world embodiments, some divergence of the surface, especially under load and during locomotion would be unavoidable).

The sides of the shoe sole structure described under FIG. 50 can also be used to form a slightly less optimal structure: a conventional shoe sole that has been modified by having its sides bent up so that their inner surface conforms to shape nearly identical but slightly larger than the shape of the outer surface of the foot sole of the wearer, instead of the shoe sole sides being flat on the ground, as is conventional. Clearly, the closer the sides are to the shape of the wearer's foot sole, the better as a general rule, but any side position between flat on the ground and conforming like FIG. 50 to a shape slightly smaller than the wearer's shape is both possible and more effective than conventional flat shoe sole sides. And in some cases, such as for diabetic patients, it may be optimal to have relatively loose shoe sole sides providing no conforming pressure of the shoe sole on the tender foot sole; in such cases, the shape of the flexible shoe uppers, which can even be made with very elastic materials such as lycra and spandex, can provide the capability for the shoe, including the shoe sole, to conform to the shape of the foot.

As discussed earlier by the applicant, the critical functional feature of a shoe sole is that it deforms under a weight-bearing load to conform to the foot sole just as the foot sole deforms to conform to the ground under a weight-bearing load. So, even though the foot sole and the shoe sole may start in different locations—the shoe sole sides can even be conventionally flat on the ground—the critical functional feature of both is that they both conform under load to parallel the shape of the ground, which conventional shoes do not, except when exactly upright. Consequently, the applicant's shoe sole invention, stated most broadly, includes any shoe sole—whether conforming to the wearer's foot sole or to the ground or some intermediate position, including a shape much smaller than the wearer's foot sole—that deforms to conform to a shape at least similar to the theoretically ideal stability plane, which by definition itself deforms in parallel with the deformation of the wearer's foot sole under weight-bearing load.

Of course, it is optimal in terms of preserving natural foot biomechanics, which is the primary goal of the applicant, for the shoe sole to conform to the foot sole when on the foot, not just when under a weight-bearing load. And, in any case, all of the essential structural support and propulsion elements previously identified by the applicant earlier in discussing FIG. 3 must be supported by the foot sole.

To the extent the shoe sole sides are easily flexible, as has already been specified as desirable, the position of the shoe sole sides before the wearer puts on the shoe is less important, since the sides will easily conform to the shape of the wearer's foot when the shoe is put on that foot. In view of that, even shoe sole sides that conform to a shape more than slightly smaller than the shape of the outer surface of the wearer's foot sole would function in accordance with the applicant's general invention, since the flexible sides could bend out easily a considerable relative distance and still conform to the wearer's foot sole when on the wearer's foot.

Figure 51:
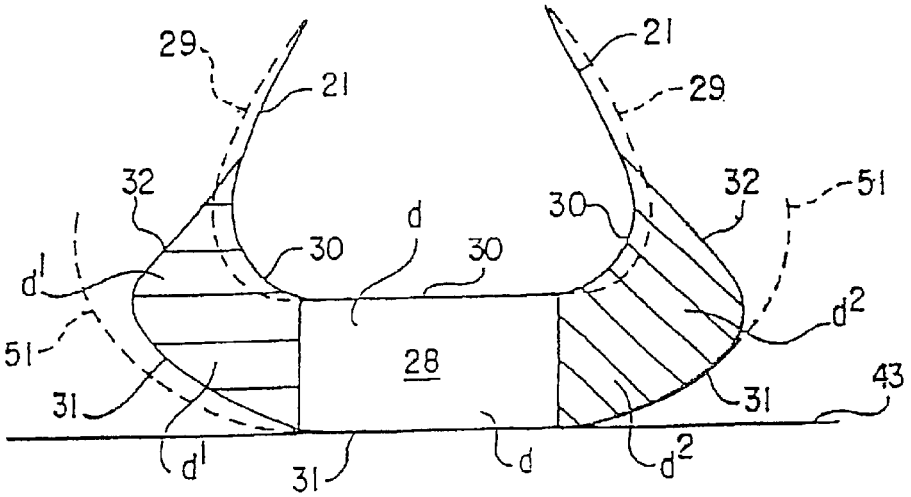

FIG. 51 is new in this application and similar to FIG. 11, which was new with the '598 application and which was is a combination of the shoe sole structure concepts of FIG. 3 and FIG. 6; it combines the custom fit design with the contoured sides having material density variations that produce an effect similar to variations in shoe sole thickness shown in FIGS. 4, 5, and 7; only the midsole is shown. The density variation pattern shown in FIG. 2 can be combined with the type shown in FIG. 11 or FIG. 51. The density pattern can be constant in all cross sections taken along the long the long axis of the shoe sole or the pattern can vary.

The applicant's FIG. 51 shoe sole invention maintains intact the firm lateral stability of the wearer's foot, that stability as demonstrated when the wearer's foot is unshod and tilted out laterally in inversion to the extreme limit of the normal range of motion of the ankle joint of the foot; in a similar demonstration in a conventional shoe sole, the wearer's foot and ankle are unstable. The sides of the applicant's shoe sole invention extend sufficiently far up the sides of the wearer's foot sole to maintain the lateral stability of the wearer's foot when bare.

In addition, the applicant's invention maintains the natural stability and natural, uninterrupted motion of the foot when bare throughout its normal range of sideways pronation and supination motion occurring during all load-bearing phases of locomotion of the wearer, including when said wearer is standing, walking, jogging and running, even when the foot is tilted to the extreme limit of that normal range, in contrast to unstable and inflexible conventional shoe soles, including the partially contoured existing art described above. The sides of the applicant's shoe sole invention extend sufficiently far up the sides of the wearer's foot sole to maintain the natural stability and uninterrupted motion of the wearer's foot when bare. The exact material density of the shoe sole sides will be determined empirically for individuals and groups using standard biomechanical techniques of gait analysis to determine those combinations that best provide the barefoot stability described above.

For the FIG. 51 shoe sole invention, the amount of any shoe sole side portions coplanar with the theoretically ideal stability plane is determined by the degree of shoe sole stability desired and the shoe sole weight and bulk required to provide said stability; the amount of said coplanar contoured sides that is provided said shoe sole being sufficient to maintain intact the firm stability of the wearer's foot throughout the range of foot inversion and eversion motion typical of the use for which the shoe is intended and also typical of the kind of wearer—such as normal or as excessive pronator—for which said shoe is intended.

Finally, the shoe sole sides are sufficiently flexible to bend out easily when the shoes are put on the wearer's feet and therefore the shoe soles gently hold the sides of the wearer's foot sole when on, providing the equivalent of custom fit in a mass-produced shoe sole. In general, the applicant's preferred shoe sole embodiments include the structural and material flexibility to deform in parallel to the natural deformation of the wearer's foot sole as if it were bare and unaffected by any of the abnormal foot biomechanics created by rigid conventional shoe sole.

At the same time, the applicant's preferred shoe sole embodiments are sufficiently firm to provide the wearer's foot with the structural support necessary to maintain normal pronation and supination, as if the wearer's foot were bare; in contrast, the excessive softness of many of the shoe sole materials used in shoe soles in the existing art cause abnormal foot pronation and supination.

As mentioned earlier regarding FIG. 1A and FIG. 3, the applicant has previously shown heel lift with constant frontal or transverse plane thickness, since it is oriented conventionally in alignment with the frontal or transverse plane and perpendicular to the long axis of the shoe sole. However, the heel wedge (or toe taper or other shoe sole thickness variations in the sagittal plane along the long axis of the shoe sole) can be located at an angle to the conventional alignment in the FIG. 1A design.

For example, the heel wedge can be located perpendicular to the subtalar axis, which is located in the heel area generally about 20 to 25 degrees medially, although a different angle can be used base on individual or group testing; such a orientation may provide better, more natural support to the subtalar joint, through which critical pronation and supination motion occur. The applicant's theoretically ideal stability plane concept would teach that such a heel wedge orientation would require constant shoe sole thickness in a vertical plane perpendicular to the chosen subtalar joint axis, instead of the frontal plane.

Besides providing a better fit, the intentional undersizing of the flexible shoe sole sides allows for simplified design of shoe sole lasts, since the shoe last needs only to be approximate to provide a virtual custom fit, due to the flexible sides. As a result, the undersized flexible shoe sole sides allow the applicant's FIG. 50 shoe sole invention based on the theoretically ideal stability plane to be manufactured in relatively standard sizes in the same manner as are shoe uppers, since the flexible shoe sole sides can be built on standard shoe lasts, even though conceptually those sides conform to the specific shape of the individual wearer's foot sole, because the flexible sides bend to so conform when on the wearer's foot sole.

Besides providing a better fit, the intentional undersizing of the flexible shoe sole sides allows for simplified design of shoe sole lasts, since they can be designed according to the simple geometric methodology described in the textual specification of FIG. 27, U.S. application Ser. No. 07/239, 667 (filed 02 Sep. 1988). That geometric approximation of the true actual contour of the human is close enough to provide a virtual custom fit, when compensated for by the flexible undersizing from standard shoe lasts described above.

A flexible undersized version of the fully contoured design described in FIG. 51 can also be provided by a similar geometric approximation. As a result, the undersized flexible shoe sole sides allow the applicant's shoe sole inventions based on the theoretically ideal stability plane to be manufactured in relatively standard sizes in the same manner as are shoe uppers, since the flexible shoe sole sides can be built on standard shoe lasts, even though conceptually those sides conform closely to the specific shape of the individual wearer's foot sole, because the flexible sides bend to conform when on the wearer's foot sole.

FIG. 51 shows the shoe sole structure when not on the foot of the wearer; the dashed line 29 indicates the position of the shoe last, which is assumed to be a reasonably accurate approximation of the shape of the outer surface of the wearer's foot sole, which determines the shape of the theoretically ideal stability plane 51. Thus, the dashed lines 29 and 51 show what the positions of the inner surface 30 and outer surface 31 of the shoe sole would be when the shoe is put on the foot of the wearer.

The FIG. 51 invention provides a way make the inner surface 30 of the contoured shoe sole, especially its sides, conform very closely to the outer surface 29 of the foot sole of a wearer. It thus makes much more practical the applicant's earlier underlying naturally contoured designs shown in FIG. 1A–C and FIG. 6. The shoe sole structure shown in FIG. 51, then, is what the FIG. 11 shoe sole structure would be when on the wearer's foot, where the inner surface 30 of the shoe upper is bent out to virtually coincide with the outer surface of the foot sole of the wearer 29 (the figures in this and prior applications show one line to emphasize the conceptual coincidence of what in fact are two lines; in real world embodiments, some divergence of the surface, especially under load and during locomotion would be unavoidable)

The sides of the shoe sole structure described under FIG. 51 can also be used to form a slightly less optimal structure: a conventional shoe sole that has been modified by having its sides bent up so that their inner surface conforms to shape nearly identical but slightly larger than the shape of the outer surface of the foot sole of the wearer, instead of the shoe sole sides being flat on the ground, as is conventional. Clearly, the closer the side's are to the shape of the wearer's foot sole, the better as a general rule, but any side position between flat on the ground and conforming like FIG. 11 to a shape slightly smaller than the wearer's shape is both possible and more effective than conventional flat shoe sole sides. And in some cases, such as for diabetic patients, it may be optimal to have relatively loose shoe sole sides providing no conforming pressure of the shoe sole on the tender foot sole; in such cases, the shape of the flexible shoe uppers, which can even be made with very elastic materials such as lycra and spandex, can provide the capability for the shoe, including the shoe sole, to conform to the shape of the foot.

As discussed earlier by the applicant, the critical functional feature of a shoe sole is that it deforms under a weight-bearing load to conform to the foot sole just as the foot sole deforms to conform to the ground under a weight-bearing load. So, even though the foot sole and the shoe sole may start in different locations—the shoe sole sides can even be conventionally flat on the ground—the critical functional feature of both is that they both conform under load to parallel the shape of the ground, which conventional shoes do not, except when exactly upright. Consequently, the applicant's shoe sole invention, stated most broadly, includes any shoe sole—whether conforming to the wearer's foot sole or to the ground or some intermediate position, including a shape much smaller than the wearer's foot sole—that deforms to conform to the theoretically ideal stability plane, which by definition itself deforms in parallel with the deformation of the wearer's foot sole under weight-bearing load.

Of course, it is optimal in terms of preserving natural foot biomechanics, which is the primary goal of the applicant, for the shoe sole to conform to the foot sole when on the foot, not just when under a weight-bearing load. And, in any case, all of the essential structural support and propulsion elements previously identified by the applicant earlier in discussing FIG. 3 must be supported by the foot sole.

To the extent the shoe sole sides are easily flexible, as has already been specified as desirable, the position of the shoe sole sides before the wearer puts on the shoe is less important, since the sides will easily conform to the shape of the wearer's foot when the shoe is put on that foot. In view of that, even shoe sole sides that conform to a shape more than slightly smaller than the shape of the outer surface of the wearer's foot sole would function, in accordance with the applicant's general invention, since the flexible sides could bend out easily a considerable relative distance and still conform to the wearer's foot sole when on the wearer's foot.

The applicant's shoe sole inventions described in FIGS. 4, 10, 11 and 51 all attempt to provide structural compensation for actual structural changes in the feet of wearers that have occurred from a lifetime of use of existing shoes, which have a major flaw that has been identified and described earlier by the applicant. As a result, the biomechanical motion of even the wearer's bare feet have been degraded from what they would be if the wearer's feet had not been structurally changed. Consequently, the ultimate design goal of the applicant's inventions is to provide un-degraded barefoot motion. That means to provide wearers with shoe soles that compensate for their flawed barefoot structure to an extent sufficient to provide foot and ankle motion equivalent to that of their bare feet if never shod and therefore not flawed. Determining the biomechanical characteristics of such un-flawed bare feet will be difficult, either on an individual or group basis. The difficulty for many groups of wearers will be in finding un-flawed, never-shod barefoot from similar genetic groups, assuming significant genetic differences exist, as seems at least possible if not probable.

The ultimate goal of the applicant's invention is to provide shoe sole structures that maintain the natural stability and natural, uninterrupted motion of the foot when bare throughout its normal range of sideways pronation and supination motion occurring during all load-bearing phases of locomotion of a wearer who has never been shod in conventional shoes, including when said wearer is standing, walking, jogging and running, even when the foot is tilted to the extreme limit of that normal range, in contrast to unstable and inflexible conventional shoe soles.

FIG. 51, like FIG. 47, increases constructive density variations, as most typically measured in durometers on a Shore A scale, to include 26 percent up to 50 percent and from 51 percent to 200 percent. The same variations in shoe bottom sole design can provide similar effects to the variation in shoe sole density described above.

In addition, any of the above described thickness variations from a theoretically ideal stability plane can be used together with any of the above described density or bottom sole design variations. FIG. 51 show such a combination; for illustration purposes, it shows a thickness increase greater than the theoretically ideal stability plane on the right side and a lesser thickness on the left side—both sides illustrate the density variations described above. All portions of the shoe sole are included in thickness and density measurement, including the sockliner or insole, the midsole (including heel lift or other thickness variation measured in the sagittal plane) and bottom or outer sole.

In addition the FIG. 51 invention and the FIG. 11 invention can be combined with the invention shown in FIG. 12 of the '870 application, which can also be combined with the other figures of this application, as can FIG. 9A–9D of the '870 application. Any of these figures can also be combined alone or together with FIG. 9 of this application, which is FIG. 9 of the '302 application or FIG. 10 of that application, or with FIGS. 11–15, 19–28, 30, and 33A–33M of the '523 application, or with FIGS. 7–9 of the '313 application, or FIG. 8 of the '748 application.

The above described thickness and density variations apply to the load-bearing portions of the contoured sides of the applicant's shoe sole inventions, the side portion being identified in FIG. 4 of the '819 Patent. Thickness and density variations described above are measured along the contoured side portion. The side portion of the fully contoured design introduced in the '819 Patent in FIG. 15 cannot be defined as explicitly, since the bottom portion is contoured like the sides, but should be measured by estimating the equivalent FIG. 4 figure; generally, like FIGS. 14 and FIG. 15 of the '819 Patent, assuming the flattened sole portion shown in° FIG. 14 corresponds to a load-bearing equivalent of FIG. 15, so that the contoured sides of FIGS. 14 and FIG. 15 are essentially the same.

Alternately, the thickness and density variations described above can be measured from the center of the essential structural support and propulsion elements defined in the '819 Patent. Those elements are the base and lateral tuberosity of the calcaneus, the heads of the metatarsals, and the base of the fifth metatarsal, and the head of the first distal phalange, respectively. Of the metatarsal heads, only the first and fifth metatarsal heads are used for such measurement, since only those two are located on lateral portions of the foot and thus proximate to contoured stability sides of the applicant's shoe sole.

FIG. 52A–B is new with this continuation-in-part application; it broadens the definition of the theoretically ideal stability plane, as defined in the '786 and all prior applications filed by the applicant. The '819 Patent and subsequent applications have defined the inner surface of the theoretically ideal stability plane as conforming to the shape of the wearer's foot, especially its sides, so that the inner surface of the applicant's shoe sole invention conforms to the outer surface of the wearer's foot sole, especially it sides, when measured in frontal plane or transverse plane cross sections.

Figure 52:
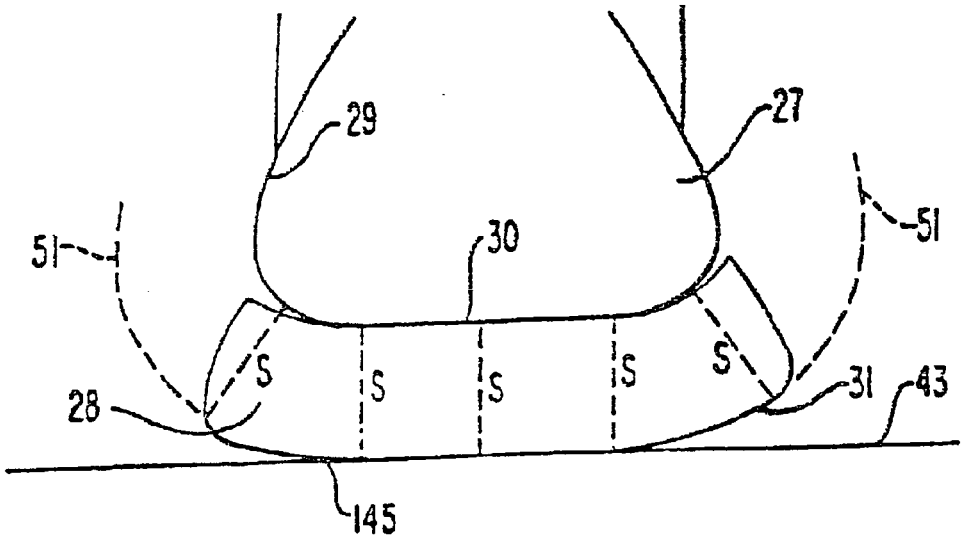

For illustration purposes, the right side of FIG. 52 explicitly includes an upper shoe sole surface that is complementary to the shape of all or a portion the wearer's foot sole. In addition, this application describes shoe contoured sole side designs wherein the inner surface of the theoretically ideal stability plane lies at some point between conforming or complementary to the shape of the wearer's foot sole, that is—roughly paralleling the foot sole including its side—and paralleling the flat ground; that inner surface of the theoretically ideal stability plane becomes load-bearing in contact with the foot sole during foot inversion and eversion, which is normal sideways or lateral motion. The basis of this design was introduced in the applicant's '302 application relative to FIG. 9 of that application.

Again, for illustration purposes, the left side of FIG. 52B describes shoe sole side designs wherein the lower surface of the theoretically ideal stability plane, which equates to the load-bearing surface of the bottom or outer shoe sole, of the shoe sole side portions is above the plane of the underneath portion of the shoe sole, when measured in frontal or transverse plane cross sections; that lower surface of the theoretically ideal stability plane becomes load-bearing in contact with the ground during foot inversion and eversion, which is normal sideways or lateral motion.

Although the inventions described in this application may in many cases be less optimal than those previously described by the applicant in earlier applications, they nonetheless distinguish over all prior art and still do provide a significant stability improvement over existing footwear and thus provide significantly increased injury prevention benefit compared to existing footwear.

Figure 53:
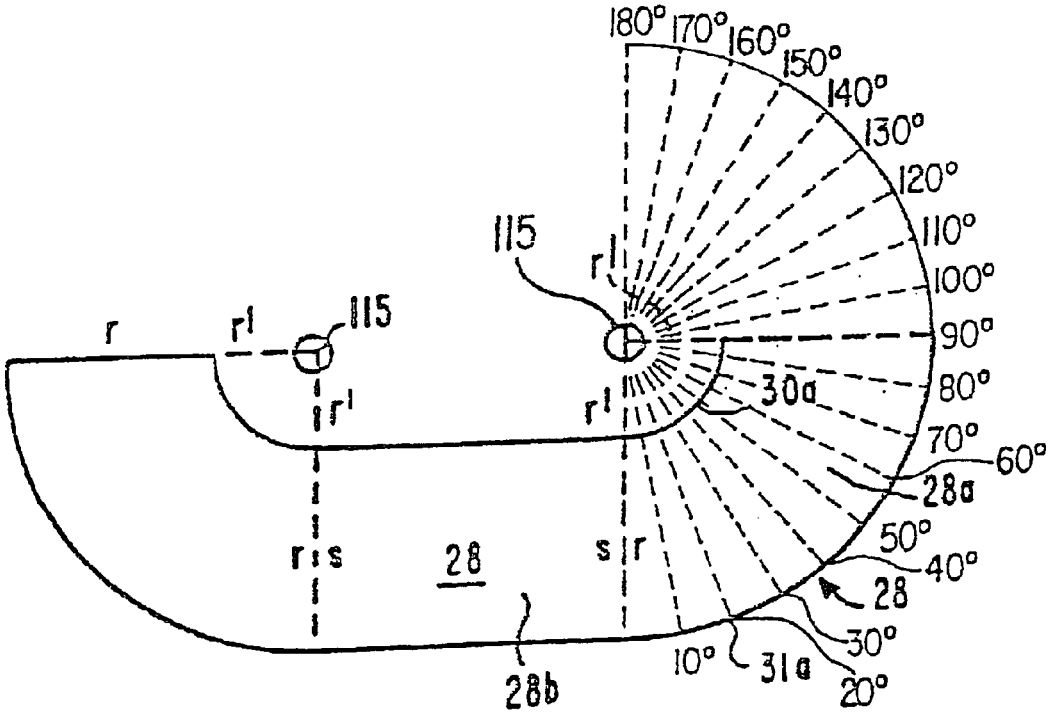

FIG. 53 is new in this continuation-in-part application and provides a means to measure the contoured shoe sole sides incorporated in the applicant's inventions described above. FIG. 53 is FIG. 27 of the '819 Patent modified to correlate the height or extent of the contoured side portions of the shoe sole with a precise angular measurement from zero to 180 degrees. That angular measurement corresponds roughly with the support for sideways tilting provided by the contoured shoe sole sides of any angular amount from zero degrees to 180 degrees, at least for such contoured sides proximate to any one or more or all of the essential stability or propulsion structures of the foot, as defined above and previously, including in the '523 patent application. The contoured shoe sole sides as described in this application can have any angular measurement from zero degrees to 180 degrees.

FIGS. 54A–54F, FIG. 55A–E, and FIG. 56 are new to this continuation-in-part application and describe shoe sole structural inventions that are formed with an upper surface to conform, or at least be complementary, to the all or most or at least part of the shape of the wearer's foot sole, whether under a body weight load or unloaded, but without contoured stability sides as defined by the applicant. As such, FIGS. 54–56 are similar to FIGS. 19–21 of the '819 Patent, but without the contoured stability sides 28*a* defined in FIG. 4 of the '819 Patent and with shoe sole contoured side thickness variations, as measured in frontal or transverse plane cross sections as defined in this and earlier applications.

Those contoured side thickness variations from the theoretically ideal stability plane, as previously defined, are uniform thickness, variations of 5 to 10 percent, variations of 11 to 25 percent, variations of 26 to 40 percent and 41 to 50 for thicknesses decreasing from the theoretically ideal stability plane, thickness variations of 26 to 50 percent and 51 percent to 100 percent for thickness variations increasing from the theoretically ideal stability plane.

FIGS. 54A–54F, FIG. 55A–E, and FIG. 56, like the many other variations of the applicant's naturally contoured design described in this and earlier applications, shown a shoe sole invention wherein both the upper, foot sole-contacting surface of the shoe sole and the bottom, ground-contacting surface of the shoe sole mirror the contours of the bottom surface of the wearer's foot sole, forming in effect a flexible three dimensional mirror of the load-bearing portions of that foot sole when bare.

The shoe sole shown in FIGS. 54–56 preferably include an insole layer, a midsole layer, and bottom sole layer, and variation in the thickness of the shoe sole, as measured in sagittal plane cross sections, like the heel lift common to most shoes, as well as a shoe upper.

Figure 57A:
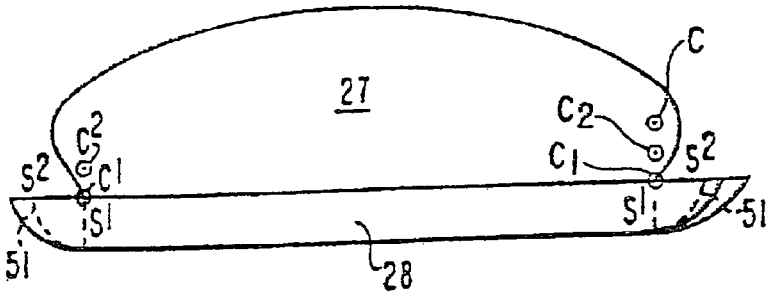
Figure 57B:
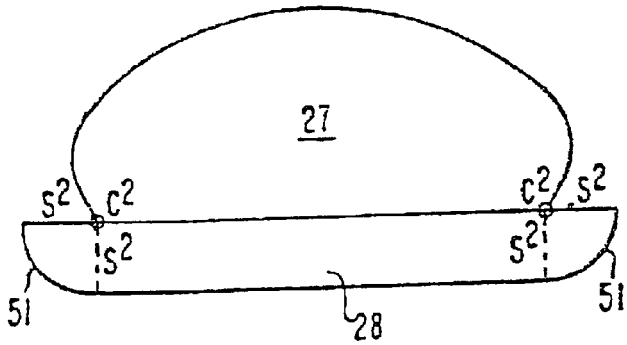
Figure 57C:
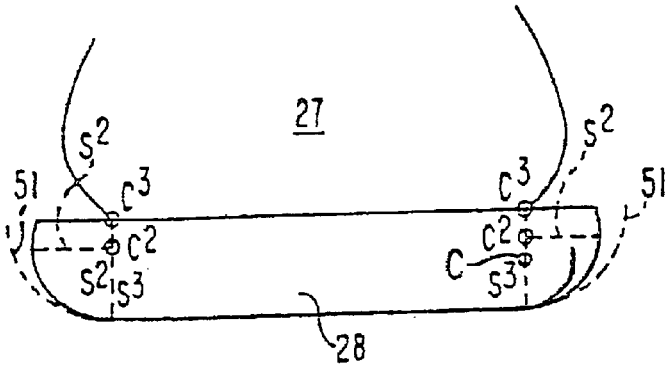

FIG. 57A–57C is similar to FIG. 34A–34C, which show, in cross sections similar to those in pending U.S. Patent '349, that with the quadrant-sided design of FIGS. 26, 31, 32 and 33C that it is possible to have shoe sole sides that are both greater and lesser than the theoretically ideal stability plane in the same shoe. FIG. 57A–C shows the same range of thickness variation in contoured shoe side as FIG. 45 and used to show simultaneously the general case for both extreme increases and extreme decreases. The quadrant design determines the shape of the load-bearing portion of outer surface of the bottom or outer sole, which is coincident with the theoretically ideal stability plane; the finishing edge 53 or 53*a* is optional, not a mandatory part of the invention.

The relationship between the applicant's two different contoured shoe sole side designs, the quadrant sided design and the naturally contoured design are discussed in published PCT Application PCT/US89/03076, from which is quoted the following three paragraphs.

A corrected shoe sole design, however, avoids such unnatural interference by neutrally maintaining a constant distance between foot and ground, even when the shoe is tilted sideways, as if in effect the shoe sole were not there except to cushion and protect. Unlike existing shoes, the corrected shoe would move with the foot's natural sideways pronation and supination motion on the ground. To the problem of using a shoe sole to maintain a naturally constant distance during that sideways motion, there are two possible geometric solutions, depending upon whether just the lower horizontal plane of the shoe sole surface varies to achieve natural contour or both upper and lower surface planes vary.

In the two plane solution, the naturally contoured design, which will be described in FIGS. 1–28, both upper and lower surfaces or planes of the shoe sole vary to conform to the natural contour of the human foot. The two plane solution is the most fundamental concept and naturally most effective. It is the only pure geometric solution to the mathematical problem of maintaining constant distance between foot and ground, and the most optimal, in the same sense that round is only shape for a wheel and perfectly round is most optimal. On the other hand, it is the least similar to existing designs of the two possible solutions and requires computer aided design and injection molding manufacturing techniques.

In the more conventional one plane solution, the quadrant contour side design, which will be described in FIGS. 29–37, the side contours are formed by variations in the bottom surface alone. The upper surface or plane of the shoe sole remains unvaryingly flat in frontal plane cross sections, like most existing shoes, while the plane of the bottom shoe sole varies on the sides to provide a contour that preserves natural foot and ankle biomechanics. Though less optimal than the two plane solution, the one plane quadrant contour side design is still the only optimal single plane solution to the problem of avoiding disruption of natural human biomechanics. The one plane solution is the closest to existing shoe sole design, and therefore the easiest and cheapest to manufacture with existing equipment. Since it is more conventional in appearance than the two plane solution, but less biomechanically effective, the one plane quadrant contour side design is preferable for dress or street shoes and for light exercise, like casual walking.

FIG. 57A–C, and FIG. 34A–34F, shows a general embodiment of the applicant's invention for thickness or density variations, whether quadrant sided or naturally contoured sides: that whatever the shoe sole side thickness variation defined for a particular embodiment, that thickness variation definition is maintained as measured in two different frontal or transverse plane cross sections and those two cross sections must be taken from sections of the shoe sole that have different thicknesses, as measured in sagittal plane cross sections or cross sections along the long axis of the shoe sole.

FIG. 57A–C also shows the special case of the radius of an intermediate shoe sole thickness, taken at ($S^2$) at the base of the fifth metatarsal in FIG. 34B, is maintained constant throughout the quadrant sides of the shoe sole, including both the heel, FIG. 34C, and the forefoot, FIG. 34A, so that the side thickness is less than the theoretically ideal stability plane at the heel and more at the forefoot. Though possible, this is not a preferred approach.

That normal range of foot inversion or eversion, and its corresponding limits of load-bearing outer or bottom sole surface 211, noted above and elsewhere in this application can be determined either by individual measurement by means known in the art or by using general existing ranges or ranges developed by statistically meaningful studies, including using new, more dynamically based testing procedures; such ranges may also include a extra margin for error to protect the individual wearer.

Thus, it will clearly be understood by those skilled in the art that the foregoing description has been made in terms of the preferred embodiment and various changes and modifications may be made without departing from the scope of the present invention which is to be defined by the appended claims.

What is claimed is:

1. A shoe having a shoe sole suitable for use in an athletic shoe, the shoe sole comprising:

a sole inner surface for supporting the foot of an intended wearer;

a sole outer surface;

a heel portion at a location substantially corresponding to a heel of the intended wearer's foot;

a forefoot portion at a location substantially corresponding to a forefoot of the intended wearer's foot;

a midtarsal portion at a location corresponding to an area of the sole between the heel portion and the forefoot portion; and a bottom sole;

a midsole defined by an inner midsole surface and an outer midsole surface;

the heel, midtarsal, and forefoot portions having a sole middle portion, a sole medial side located medially to the sole middle portion, and a sole lateral side located laterally to the sole middle portion, the midsole having a middle midsole portion, a medial midsole side located medially to the middle midsole portion and a lateral midsole side located laterally to the middle midsole portion, the inner midsole surface located in each of the medial and lateral midsole sides comprising a convexly rounded portion, as viewed in a heel portion frontal plane cross-section when the shoe sole is upright and in an unloaded condition, the convexity existing with respect to a portion of the midsole directly adjacent to the convexly rounded portion of the inner midsole surface, and the outer midsole surface located in each of the medial and lateral midsole sides comprising a concavely rounded portion extending down from a level corresponding to a lowest point of the inner midsole surface, as viewed in said heel portion frontal plane cross-section when the shoe sole is upright and in an unloaded condition, the concavity existing with respect to an inner section of the midsole directly adjacent to the concavely rounded portion of the outer midsole surface;

each sole side having an uppermost portion that extends above the lowest point of the sole inner surface, as viewed in a heel portion frontal plane cross-section when the shoe sole is upright and in an unloaded condition;

the midsole comprising a first midsole portion located completely on one side of a centerline of said midsole, said first midsole portion having a first density or firmness, and a second midsole portion located completely on another side of a centerline of said midsole, said second midsole portion having a second density or firmness which is different than the density or firmness of said first midsole portion, as viewed in said heel portion frontal plane cross-section when the shoe sole is upright and in an unloaded condition;

each midsole side comprises a sidemost section of the midsole defined by that portion of the midsole located outside of a straight vertical line drawn through the sidemost extent of the inner midsole surface of the midsole, as viewed in a frontal plane cross-section when the shoe sole is upright and in an unloaded condition;

at least a part of the midsole extends into the sidemost section of each midsole side, as viewed in the heel portion frontal plane cross-section when the shoe sole is upright and in an unloaded condition;

the part of the midsole that extends into the sidemost section of each midsole side further extends to above a lowermost point of the inner midsole surface of the midsole on the same sole side, as viewed in the heel portion frontal plane cross-section when the shoe sole is upright and in an unloaded condition;

each sole side having a sole thickness between said sole inner and outer surfaces that is greater than a sole thickness between said sole inner and outer surfaces of the sole middle portion, as viewed in said heel portion frontal plane cross-section when the shoe sole is upright and in an unloaded condition; and the sole thickness between the sole inner surface and the sole outer surface increases gradually and substantially continuously from the uppermost point of each sole side through at least a substantial part of the uppermost portion of the sole side, as viewed in said heel portion frontal plane cross-section when the shoe sole is upright and in an unloaded condition.

2. The shoe according to claim 1, wherein the thickness of the sole middle portion gradually increases from a vertical centerline of the shoe sole to the each sole side, as viewed in said heel portion frontal plane cross-section when the shoe sole is upright and in an unloaded condition.

3. The shoe according to claim 1, wherein the sole thickness of a portion of the sole middle portion gradually increases, and the gradual sole thickness increase continues into each sole side, as viewed in said heel portion frontal plane cross-section when the shoe sole is upright and in an unloaded condition.

4. The shoe according to claim 1, wherein the outer midsole surface concavely rounded portions extend to a lowest point on each said midsole sidemost section, as viewed in said heel portion frontal plane cross-section when the shoe sole is upright and in an unloaded condition.

5. The shoe according to claim 4, wherein at least one outer midsole surface concavely rounded portion extends to a part of the middle midsole portion adjacent to the midsole sidemost section on the same midsole side, as viewed in said heel portion frontal plane when the shoe sole is upright and in an unloaded condition.

6. The shoe according to claim 4, wherein the outer midsole surface concavely rounded portions extend to above a sidemost extent of each midsole side, as viewed in said heel portion frontal plane when the shoe sole is upright and in an unloaded condition.

7. The shoe according to claim 4, wherein the outer midsole surface concavely rounded portions further extend to a vertical centerline of the middle midsole portion, as viewed in said heel portion frontal plane when the shoe sole is upright and in an unloaded condition.

8. The shoe according to claim 4, wherein each outer midsole surface concavely rounded portion extends to a part of the middle midsole portion adjacent its respective midsole sidemost section, as viewed in said heel portion frontal plane when the shoe sole is upright and in an unloaded condition.

9. The shoe sole according to claim 1, wherein the outer midsole surface of an uppermost portion of each of the midsole medial and lateral sides includes a concavely rounded portion, as viewed in said heel portion frontal plane cross-section when the shoe soleis upright and in an unloaded condition, the concavity existing with respect to an inner section of the midsole directly adjacent to the concavely rounded portion of the outer midsole surface.

10. The shoe according to claim 9, wherein the outer midsole surface of at least the entire uppermost portion of each midsole sidemost section is concavely rounded relative to an inner section of the midsole directly adjacent to the concavely rounded portion of the outer midsole surface, as viewed in said heel portion frontal plane cross-section when the shoe sole is upright and in an unloaded condition.

11. The shoe sole according to claim 1, wherein the sole thickness increases gradually and substantially continuously from said uppermost point of each shoe sole side through the entire uppermost portion of the shoe sole side.

12. The shoe sole according to claim 11, wherein the inner midsole surface of the uppermost portion of each midsole side comprises a convexly rounded portion, said convexity being determined relative to a section of the midsole directly adjacent to said convexly rounded portion of the inner midsole surface, as viewed in said heel portion frontal plane cross-section when the shoe sole is upright and in an unloaded condition.

13. The shoe sole according to claim 1, wherein the sole thickness is defined as the length of a line extending from a point on the sole inner surface to the sole outer surface in a direction perpendicular to a line tangent to the sole inner surface at said point on the sole inner surface, as viewed in said heel portion frontal plane cross-section when the shoe sole is upright and in an unloaded condition.

14. The shoe sole according to claim 1, wherein the midsole comprises at least three midsole portions having three different densities or firmnesses.

15. The shoe sole according to claim 14, wherein the midsole portion having the third density or firmness is located completely between the midsole portions having first and second densities or firmnesses, as viewed in said heel portion frontal plane cross-section when the shoe sole is upright and in an unloaded condition.

16. The shoe sole according to claim 15, wherein the midsole portion having the third density or firmness has the least density or firmness of said midsole portions having different densities or firmnesses.

17. A shoe having a shoe sole suitable for use in an athletic shoe, the shoe sole comprising:

a sole inner surface for supporting the foot of an intended wearer;

a sole outer surface;

a heel portion at a location substantially corresponding to a heel of the intended wearer's foot;

a forefoot portion at a location substantially corresponding to a forefoot of the intended wearer's foot;

a midtarsal portion at a location corresponding to an area of the sole between the heel portion and the forefoot portion; and a bottom sole and a midsole, the midsole defined by an inner midsole surface and an outer midsole surface;

the heel, midtarsal, and forefoot portions having a sole middle portion, a sole medial side located medially to the sole middle portion, and a sole lateral side located laterally to the sole middle portion, each sole side defined by that portion of said sole located outside a vertical line extending through each sidemost extent of the sole inner surface, as viewed in a heel portion frontal plane cross-section when the shoe sole is upright and in an unloaded condition;

the midsole having a middle midsole portion, a medial midsole side located medially to the middle midsole portion and a lateral midsole side located laterally to the middle midsole portion;

the inner midsole surface of each of the midsole medial and lateral sides comprising a convexly rounded portion, as viewed in said heel portion frontal plane cross-section when the shoe sole is upright and in an unloaded condition, the convexity existing with respect to a section of the midsole directly adjacent to each convexly rounded portion of the inner midsole surface;

the outer midsole surface of each of the midsole medial and lateral sides comprising a concavely rounded portion, as viewed in said heel portion frontal plane cross-section when the shoe sole is upright and in an unloaded condition, the concavity existing with respect to an inner section of the midsole directly adjacent to the concavely rounded portion of the outer midsole surface;

the midsole comprising a first midsole portion located completely on one side of a centerline of said midsole, said first midsole portion having a first density or firmness, and a second midsole portion located completely on another side of a centerline of said midsole, said second midsole portion having a second density or firmness which is different than the density or firmness of said first midsole portion, as viewed in said heel portion frontal plane cross-section when the shoe sole is upright and in an unloaded condition;

each midsole side comprises a sidemost section of the midsole defined by that portion of the midsole located outside of a straight vertical line drawn through the sidemost extent of the inner midsole surface of the midsole, as viewed in a frontal plane cross-section when the shoe sole is upright and in an unloaded condition;

at least a part of the midsole extends into the sidemost section of each midsole side, as viewed in the heel portion frontal plane cross-section when the shoe sole is upright and in an unloaded condition;

the part of the midsole that extends into the sidemost section of each midsole side further extends to above a lowermost point of the inner midsole surface of the midsole on the same sole side, as viewed in the heel portion frontal plane cross-section when the shoe sole is upright and in an unloaded condition; and each sole side having a sole thickness that is greater than a sole thickness in the sole middle portion, as viewed in said heel portion frontal plane cross-section when the shoe sole is upright and in an unloaded condition.

18. The shoe sole according to claim 17, wherein the midsole middle portion having a higher density or firmness forms at least a part of at least one midsole side and the midsole portion having a lower density or firmness forms at least a part of the middle midsole portion of the shoe sole, as viewed in said heel portion frontal plane cross-section when the shoe sole is upright and in an unloaded condition.

19. The shoe sole according to claim 18, wherein the midsole portion having a higher density or firmness forms the entire midsole portion of at least one midsole side, as viewed in said heel portion frontal plane cross-section when the shoe sole is upright and in an unloaded condition.

20. The shoe sole according to claim 17, wherein the midsole portion forms one side of the midsole and has a different density or firmness than a midsole portion which forms the other side of the shoe sole, as viewed in said heel portion frontal plane cross-section when the shoe sole is upright and in an unloaded condition.

21. The shoe sole according to claim 17, wherein the sole thickness is defined as the length of a line extending from a point on the sole inner surface to the sole outer surface in a direction perpendicular to a line tangent to the sole inner surface at said point on the sole inner surface, as viewed in said heel portion frontal plane cross-section when the shoe sole is upright and in an unloaded condition.

22. The shoe sole according to claim 17, wherein the midsole comprises at least three midsole portions having three different densities or firmnesses.

23. The shoe sole according to claim 22, wherein the midsole portion having the third density or firmness is located completely between the midsole portions having first and second densities or firmnesses, as viewed in said heel portion frontal plane cross-section when the shoe sole is upright and in an unloaded condition.

24. The shoe sole according to claim 23, wherein the midsole portion having the third density or firmness has the least density or firmness of said midsole portions having different densities or firmnesses.

* * * * *

UNITED STATES PATENT AND TRADEMARK OFFICE

CERTIFICATE OF CORRECTION

PATENT NO. : 6,789,331 B1
APPLICATION NO. : 08/462531
DATED : September 14, 2004
INVENTOR(S) : Ellis, III It is certified that error appears in the above-identified patent and that said Letters Patent is hereby corrected as shown below:

On the title page,
[*] delete "Subject to any disclaimer, the term of this patent is extended or adjusted under 35 U.S.C. 154(b) by 1,156 days." and substitute On the title page,
[*] --Subject to any disclaimer, the term of this patent is extended or adjusted under 35 U.S.C. 154(b) by 0 days.--

Signed and Sealed this

Twenty-seventh Day of February, 2007

JON W. DUDAS
*Director of the United States Patent and Trademark Office*